US009573363B2

(12) United States Patent
Kyoso et al.

(10) Patent No.: US 9,573,363 B2
(45) Date of Patent: Feb. 21, 2017

(54) INK JET RECORDING APPARATUS AND ABNORMALITY DETECTION METHOD OF EJECTOR

(71) Applicant: FUJIFILM Corporation, Tokyo (JP)

(72) Inventors: Tadashi Kyoso, Ashigarakami-gun (JP); Katsuto Sumi, Ashigarakami-gun (JP); Jun Yamanobe, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/716,129

(22) Filed: May 19, 2015

(65) Prior Publication Data

US 2015/0336381 A1 Nov. 26, 2015

(30) Foreign Application Priority Data

May 26, 2014 (JP) ..... 2014-108449

(51) Int. Cl.
*B41J 2/045* (2006.01)
*B41J 2/165* (2006.01)

(52) U.S. Cl.
CPC ..... *B41J 2/0451* (2013.01); *B41J 2/04581* (2013.01); *B41J 2/165* (2013.01); *B41J 2/16579* (2013.01); *B41J 2202/20* (2013.01)

(58) Field of Classification Search
CPC ..... B41J 2/2142; B41J 2/04501; B41J 2/125; B41J 2/04581; B41J 2/165; B41J 2/16579; B41J 2202/20; B41J 2/2139; B41J 2/2146
See application file for complete search history.

(56) References Cited

U.S. PATENT DOCUMENTS

2007/0229559 A1* 10/2007 Oku ..... B41J 2/04505 347/9
2015/0043836 A1* 2/2015 Shibata ..... B41J 2/2139 382/299

FOREIGN PATENT DOCUMENTS

JP S63-260448 A 10/1988
JP 2011-161753 A 8/2011
JP 2012-232542 A 11/2012
JP 2014-004736 A 1/2014

OTHER PUBLICATIONS

An Office Action "Notification of Reasons for Refusal" issued by the Japanese Patent Office on Aug. 30, 2016, which corresponds to Japanese Patent Application No. 2014-108449 and is related to U.S. Appl. No. 14/716,129; with English language translation.

* cited by examiner

*Primary Examiner* — Thinh H Nguyen
(74) *Attorney, Agent, or Firm* — Studebaker & Brackett PC

(57) ABSTRACT

Provided are an ink jet recording apparatus and an abnormality detection method of an ejector which are capable of performing high-accuracy abnormality detection and suppressing the generation of excessive abnormality detection with respect to a required image quality. An ink jet recording apparatus (10) includes an ink jet head (20C, 20M, 20Y, 20K) having a plurality of ejectors, a medium transport unit (22), a calculation unit (34) that calculates an index value relevant to a droplet ejection amount for each ejector on the basis of printing data, a threshold determination unit (40) that determines a threshold for ejection abnormality determination for each ejector in accordance with the index value, a threshold storage unit (44) that stores the threshold determined for each ejector, and an abnormality determination unit (54) that determines the presence or absence of ejection abnormality by comparing the threshold with a measurement amount for each ejector.

16 Claims, 26 Drawing Sheets

INK JET RECORDING APPARATUS AND ABNORMALITY DETECTION METHOD OF EJECTOR

CROSS-REFERENCE TO RELATED APPLICATIONS

The present application claims priority under 35 U.S.C. §119 to Japanese Patent Application No. 2014-108449, filed on May 26, 2014. Each of the above application(s) is hereby expressly incorporated by reference, in its entirety, into the present application.

BACKGROUND OF THE INVENTION

1. Field of the Invention

The present invention relates to an ink jet recording apparatus and an abnormality detection method of an ejector, and particularly relates to a technique for detecting an abnormality of an ejector in an ink jet head having a plurality of ejectors.

2. Description of the Related Art

An ink jet head which is used in a recording head of an ink jet recording apparatus has a plurality of ejectors as an ejection mechanism that ejects droplets. Regarding techniques for detecting an abnormality of an ejector in a recording head, techniques disclosed in JP1988-260448 (JP-563-260448) and JP2012-232542 are known.

JP1988-260448 (JP-S63-260448) discloses a technique in which, in an ink jet printer, an image printed during a print job is read by an image sensor, and a jet error of a jet nozzle of a recording head is detected by comparing printed dots with printing data for comparison. The terms "ink jet printer", "image sensor", "printing data", "recording head", "jet nozzle", and "jet error" disclosed in JP1988-260448 (JP-S63-260448) can be comprehended as the terms corresponding to "ink jet recording apparatus", "image reading unit", "print data", "ink jet head", "nozzle", and "ejection abnormality", respectively.

JP2012-232542 discloses a method of implementing ejection inspection with an appropriate detection sensitivity by changing an allowable upper limit of the number of detections of a non-ejecting nozzle within a corresponding ejection head which serves as a determination criterion when "defective ejection" of an ejection head is determined, in accordance with a printing resolution or the type of printing data. The terms "ejection head" and "non-ejecting nozzle" disclosed in JP2012-232542 can be comprehended as the terms corresponding to "ink jet head" and "non-ejecting nozzle", respectively.

SUMMARY OF THE INVENTION

In the technique disclosed in JP1988-260448 (JP-S63-260448), since an image quality determination criterion on the user side is not sufficiently considered during determination of whether ejection is abnormal, excessive detection, insufficient detection or the like is generated depending on printing data.

On the other hand, the technique disclosed in JP2012-232542 relevant to contents in which the setting of detection sensitivity of ejection inspection is changed according to whether a code image such as a one-dimensional bar code or text data is included in printing data. The technique disclosed in JP2012-232542 targets relatively simple image contents of a code image or text data, and in the same technique, ejection inspection is not able to be implemented with an appropriate detection sensitivity in case of printing data in which a photographic image and various other images are complicatedly combined.

In addition, in a graphic printing field using an ink jet recording apparatus of a single pass system in which development has recently progressed, even slight streaks within an image of printed matter may cause a problem of quality. For this reason, as in JP2012-232542, a technique alone is not enough in which the "defective ejection" of an ink jet head is determined by the number of non-ejecting nozzles within the ink jet head, and measures of cleaning or the like for suppressing streaks are taken.

The present invention is contrived in view of such circumstances, and an object thereof is to provide an ink jet recording apparatus and an abnormality detection method of an ejector which are capable of performing abnormality detection of the degree of accuracy with which it is possible to cope with graphic printing, and capable of suppressing the generation of excessive abnormality detection with respect to a required image quality.

As means for solving the problems, the next inventive aspects are provided.

According to a first aspect of the invention, there is provided an ink jet recording apparatus including: an ink jet head having a plurality of ejectors that eject droplets; a medium transport unit that transports a recording medium; a calculation unit that calculates an index value relevant to a droplet ejection amount for each of the ejectors which is expected during recording of a printed image with respect to each of the plurality of ejectors, on the basis of printing data for specifying contents of the printed image which is recorded on the recording medium by the ink jet head; a threshold determination unit that determines a threshold for ejection abnormality determination for each of the ejectors, in accordance with the index value for each of the ejectors calculated by the calculation unit; a threshold storage unit that stores the threshold determined for each of the ejectors by the threshold determination unit; and an abnormality determination unit that determines presence or absence of an ejection abnormality by comparing a measurement amount of each of the ejectors obtained by inspecting an ejection state of the ejector with the threshold determined for each of the ejectors relating to the measurement amount.

According to the first aspect, it is possible to set an appropriate threshold with respect to each of the ejectors in accordance with the printing data. With image content of the printing data, it is possible to cope with a case where various types of images are combined, and to change the setting of the threshold in accordance with a required image quality. Therefore, it is possible to perform high-accuracy abnormality detection, and to suppress the generation of excessive abnormality detection with respect to a required image quality.

As a second aspect, in the ink jet recording apparatus according to the first aspect, the index value may be a value indicating an average ejection amount per unit pixel for each of the ejectors which is estimated from the printing data, or a value indicating a total ejection amount within a specific pixel region for each of the ejectors which is estimated from the printing data.

As a third aspect, in the ink jet recording apparatus according to the first or second aspect, the calculation unit may calculate a value indicating an average ejection amount per unit pixel in some or all of pixel groups in which each of the ejectors takes charge of recording for each of the ejectors or a value indicating a total ejection amount of some or all of pixel groups in which each of the ejectors takes charge of recording for each of the ejectors on the basis of a half-tone image corresponding to the printing data and a standard droplet amount per dot for each dot type.

As a fourth aspect, in the ink jet recording apparatus according to the second aspect, the printing data may be continuous-tone image data indicating an ink gradation value, and the calculation unit may calculate the average ejection amount for each of the ejectors or the total ejection amount for each of the ejectors, on the basis of a half-tone dot ratio table in which a relationship between an ink gradation value and an appearance ratio of dot types in a half-tone process is specified, a standard droplet amount per dot for each dot type, and an ink gradation value of a pixel in which each of the ejectors takes charge of recording for each of the ejectors.

As a fifth aspect, in the ink jet recording apparatus according to any one of the second to fourth aspects, the calculation unit may calculate a moving average of an ejection amount of the ejector with respect to a medium transport direction in which the recording medium is transported by the medium transport unit, and obtains a representative value of the moving average as a value indicating the average ejection amount of the index value.

As a sixth aspect, in the ink jet recording apparatus according to the first aspect, the calculation unit may calculate a moving average of an ejection amount of the ejector with respect to a medium transport direction in which the recording medium is transported by the medium transport unit, and obtains a representative value of the moving average as a value indicating the average ejection amount of the index value.

As a seventh aspect, in the ink jet recording apparatus according to the sixth aspect, the calculation unit may calculate a moving average of an ejection amount of the ejector with respect to a medium transport direction in which the recording medium is transported by the medium transport unit, and obtains a representative value of the moving average as a value indicating the average ejection amount of the index value.

As an eighth aspect, the ink jet recording apparatus according to any one of the first to seventh aspects may further include a correspondence relation data storage unit in which correspondence relation data having a correspondence relation between the index value and the threshold for ejection abnormality determination specified therein is stored, the threshold determination unit may determine the threshold for each of the ejectors using the correspondence relation data.

As a ninth aspect, the ink jet recording apparatus according to any one of the first to eighth aspects may further include a test pattern recording control unit that performs control for causing the ink jet head to record a test pattern for inspecting the ejection state of the ejector; an image reading unit that reads the test pattern recorded by the ink jet head; and an image analysis unit that analyzes a read image of the test pattern acquired through the image reading unit to acquire a measurement amount for each of the ejectors.

As a tenth aspect, in the ink jet recording apparatus according to the ninth aspect, the recording of the test pattern and the acquisition of the measurement amount may be performed during execution of a print job for recording the printed image on the basis of the printing data, and the determination by the abnormality determination unit is performed during the execution of the print job.

As an eleventh aspect, in the ink jet recording apparatus according to the any one of the first to tenth aspects, a plurality of types of threshold having different degrees of the ejection abnormality may be determined as the threshold with respect to each of the plurality of ejectors.

As a twelfth aspect, the ink jet recording apparatus according to the eleventh aspect may further include an abnormality notification unit that notifies a user of an abnormality in accordance with a determination result by the abnormality determination unit, a first threshold having a relatively high degree of the ejection abnormality and a second threshold having a relatively low degree of the ejection abnormality may be determined as the plurality of types of threshold. In case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, a notification aspect by the abnormality notification unit may be made different.

"The abnormality notification unit that notifies a user of abnormality" is a general term for means for generating an operation or a state of reminding a user of the generation of abnormality. In operations for informing a user of the generation of abnormality, there may be various aspects such as, for example, a stamp process of affixing a mark to printed matter relevant to abnormality, a process of changing an output location to which the printed matter relevant to abnormality is discharged to a specific location, a process of displaying information indicating the generation of abnormality on a display and other display units, and a process of generating a warning sound, a voice message or the like for announcing the generation of abnormality. The "abnormality notification unit" can be configured by combining a plurality of types of notification means. The "notification aspect" is a general term for a notification method, notification contents, the presence or absence of notification, an operation, a process or a state equivalent to notification, and the like.

As a thirteenth aspect, the ink jet recording apparatus according to the twelfth aspect may further include a stamp processing unit that affixes a mark to an end of the recording medium in accordance with the determination result by the abnormality determination unit. In case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, a stamp process by the stamp processing unit as the abnormality notification unit may be made different.

As a fourteenth aspect, the ink jet recording apparatus according to the twelfth or thirteenth aspect may further include an output location change processing unit that changes an output location of the recording medium in accordance with the determination result by the abnormality determination unit. In case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, the output location by the output location change processing unit as the abnormality notification unit may be made different.

As a fifteenth aspect, the ink jet recording apparatus according to any one of the twelfth to fourteenth aspect may further include an abnormality information providing processing unit that provides information for causing a user to perceive abnormality in accordance with a determination result by the abnormality determination unit. In case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, an information providing aspect by the abnormality information providing processing unit as the abnormality notification unit may be made different.

The "abnormality information providing processing unit" provides information by the action on at least a type of sense among five senses of the sense of sight, the sense of hearing, the sense of smell, the sense of taste, and the sense of touch.

As a sixteenth aspect, in the ink jet recording apparatus according to any one of the first to fifteenth aspect, the ink jet head may be a line head in which the plurality of ejectors are arrayed in a medium width direction orthogonal to a medium transport direction in which the recording medium is transported by the medium transport unit, and may perform image recording in a single pass system.

As a seventeenth aspect, in the ink jet recording apparatus according to any one of the first to sixteenth aspects, the measurement amount may be a landing position shift amount.

As an eighteenth aspect, there is provided an abnormality detection method of an ejector in the ink jet recording apparatus that transports a recording medium and records an image on the recording medium using an ink jet head having a plurality of ejectors that ejects droplets, the method including: a calculation step of calculating an index value relevant to a droplet ejection amount for each of the ejectors which is expected during recording of a printed image with respect to each of the plurality of ejectors, on the basis of printing data for specifying contents of the printed image which is recorded on the recording medium by the ink jet head; a threshold determination step of determining a threshold for ejection abnormality determination for each of the ejectors, in accordance with the index value for each of the ejectors calculated in the calculation step; a threshold storage step of storing the threshold determined for each of the ejectors in the threshold determination step; and an abnormality determination step of determining presence or absence of an ejection abnormality by comparing a measurement amount of each of the ejectors obtained by inspecting an ejection state of the ejector with the threshold determined for each of the ejectors relating to the measurement amount.

In the eighteenth aspect, the same particulars as particulars specified in the second to seventeenth aspects can be appropriately combined. In that case, processing units or function units as means for taking charge of processes or functions which are specified in the ink jet recording apparatus can be ascertained as elements of "steps" of processes or operations corresponding thereto.

According to the present invention, it is possible to perform high-accuracy abnormality detection in accordance with printing data, and to suppress the generation of excessive abnormality detection with respect to a required image quality.

DESCRIPTION OF THE PREFERRED EMBODIMENTS

Figure 1:
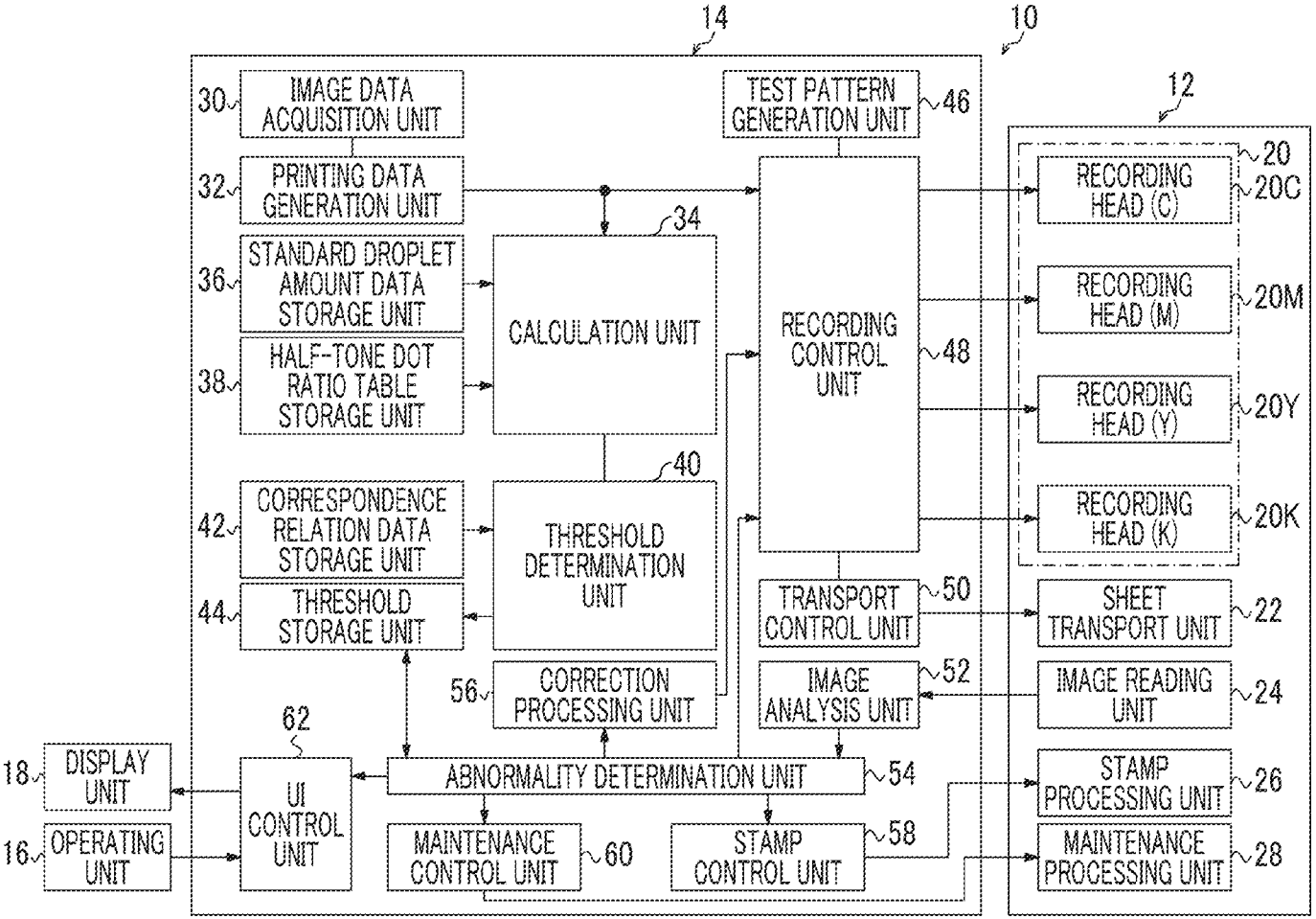
FIG. 1 is a block diagram illustrating a configuration of an ink jet recording apparatus according to a first embodiment of the invention.

Hereinafter, embodiments of the present invention will be described in detail with reference to the accompanying drawings.

[With Respect to Terms]

The term "ink jet recording apparatus" is used as a general term for a device or a system for performing recording of an image using an ink jet head. The term "recording of an image" includes a concept of terms for formation, printing, typing, drawing, and the like of an image. An ink jet recording apparatus includes a concept of terms for an image forming apparatus, a printing system, an image recording apparatus, a drawing apparatus, a printing system, and the like.

The term "ink jet head" is a general term for a liquid ejection head for performing ejection of droplets using an ink jet system. The ink jet head may be a form which is configured by combining a plurality of head modules, and may be a form which is configured by a single head. The term "ink jet head" may be represented by various terms for a recording head, a printing head, a drawing head, a print head, an ejection head, a spray head, a droplet ejection head, and the like. In the present embodiment, from the viewpoint of simple description, an ink jet head used for recording an image is described as a "recording head".

An "ejector" is configured to include nozzles as ejection ports of droplets, a pressure chamber leading to the nozzles, and an ejection energy generation element that gives an ejection force to liquid within the pressure chamber. As the ejection energy generation element, for example, a piezoelectric element or a heater element can be used. The ejector functions as a recording element that takes charge of recording a dot corresponding to a pixel. Dots are recorded by droplets which are ejected from the nozzles. One dot may be formed from one droplet, and may be formed from a set of a plurality of droplets.

The size of a dot can be controlled by the amount of droplets ejected from the nozzles. The size of a dot is called a "dot size". When dots having a plurality of types of dot size can be recorded and controlled by changing the amount of the droplets ejected from the nozzles, the types of dots having different droplet amounts are called "dot types". In addition, the types of droplet amount in which ejection can be controlled corresponding to the dot type are called "droplet types". The size of a droplet for each droplet type is called a "droplet size". The droplet size can be specified from the viewpoint of the volume of a droplet, the diameter or radius of the droplet on which sphericity conversion is performed, the mass of the droplet, and the like.

Since individual ejectors have corresponding nozzles, an abnormality of an ejector can be represented as an "abnormality of a nozzle". In addition, the description "for each ejector" can be represented as "for each nozzle".

The term "printing data" refers to image data for specifying contents of a printed image which is recorded on a recording medium by the ink jet head. The printing data may be a format of data of a continuous-tone image before half-tone processing, and may be a format of data of a half-tone image indicating a dot image after the half-tone processing.

The term "recording medium" refers to a general term for a medium for recording an image by attaching ink. The recording medium includes mediums referred to by various terms such as a sheet, a recording sheet, a printing sheet, a printing medium, a print medium, a printed medium, an image forming medium, an image formation medium, an image-receiving medium, an ejection medium, and the like. The material, shape and the like of the recording medium are not particularly limited, and various sheet bodies can be used regardless of a continuous sheet, a cut sheet (sheet of paper), a seal sheet, a resin sheet, a film, cloth, non-woven cloth, a printed substrate having a wiring pattern formed thereon, a rubber sheet, and other materials or shapes. In the following description, the term "sheet" is used in order to simplify description. The "sheet" is synonymous with a "recording medium".

First Embodiment

FIG. 1 is a block diagram illustrating a configuration of an ink jet recording apparatus according to a first embodiment of the invention. An ink jet recording apparatus 10 according to the present embodiment is configured to include a printing apparatus 12 that performs printing using an ink jet system, and a control device 14 that controls an operation of the printing apparatus 12. The term "printing apparatus" is used as a term including the terms "printer" and "printing machine". The control device 14 includes an operating unit 16 and a display unit 18. The operating unit 16 and the display unit 18 function as a user interface.

The printing apparatus 12 includes a recording head portion 20, a sheet transport unit 22, an image reading unit 24, a stamp processing unit 26, and a maintenance processing unit 28.

The recording head portion 20 includes recording heads 20C, 20M, 20Y, and 20K corresponding to respective colors of cyan, magenta, yellow, and black. The respective colors of cyan, magenta, yellow, and black are denoted by C, M, Y, and K, respectively. The recording head 20C is an ink jet head that ejects cyan (C) ink. The recording head 20M is an ink jet head that ejects magenta (M) ink. The recording head 20Y is an ink jet head that ejects yellow (Y) ink. The recording head 20K is an ink jet head that ejects black (K) ink.

Each of the recording heads 20C, 20M, 20Y, and 20K has a plurality of ejectors. Each of the recording heads 20C, 20M, 20Y, and 20K is constituted by a line head having an ink ejection surface on which a plurality of nozzles are arrayed over a length corresponding to the full width of a drawing region in a sheet width direction orthogonal to a sheet transport direction. The sheet transport direction is a direction in which a sheet (not shown in FIG. 1) is transported by the sheet transport unit 22. The sheet transport direction refers to a term equivalent to a "medium transport direction", and the sheet width direction refers to a term equivalent to a "medium width direction". The sheet transport direction is equivalent to a sub-scanning direction, and the sheet width direction is equivalent to a main scanning direction. In this specification, the sub-scanning direction is set to a Y direction, and the main scanning direction is set to an X direction. The full width of the drawing region in the sheet width direction refers to a maximum width of an image forming region in the sheet width direction on which printing can be performed by the printing apparatus 12. The term "ink ejection surface" may be called a "nozzle surface".

The number of nozzles, a nozzle density, the array form of nozzles, and the like in each of the recording heads 20C, 20M, 20Y, and 20K are not particularly limited, and there may be various forms. The number of nozzles and the array form of nozzles are appropriately designed in accordance with required recording resolution and a recordable width. In the present embodiment, for the purpose of simplifying description, the structures of the recording heads 20C, 20M, 20Y, and 20K of each color are assumed to be the same as each other, and the numbers of nozzles and the nozzle densities of each color are assumed to be equal to each other. However, head designs different from each other between colors may be adopted during the implementation of the invention.

The array form of nozzles in the ink ejection surface may be a one-dimensional nozzle array in which a plurality of nozzles are lined up linearly in a row at regular intervals, and may be a two-dimensional nozzle array in which a plurality of nozzles are arrayed two-dimensionally. A nozzle array capable of realizing required recording resolution in the main scanning direction is adopted.

In case of the recording head having a two-dimensional nozzle array, it can be considered that a projected nozzle array projected (that is, orthogonally projected) so that the respective nozzles in the two-dimensional nozzle array are lined up along the sheet width direction is equivalent to a row of a nozzle array in which nozzles are lined up at approximately equally-spaced intervals with a nozzle density for achieving a specific recording resolution in the main scanning direction. The "equally-spaced intervals" as used herein mean substantially equally-spaced intervals as droplet ejection points on which recording can be performed by the ink jet recording apparatus 10. For example, a case or the like where intervals between nozzles are made slightly different from each other in consideration of the movement of droplets on a sheet due to a manufacturing error or landing interference is also included in a concept of "equally-spaced intervals". The projected nozzle array is also called a "substantial nozzle array". Considering the projected nozzle array, nozzle positions (nozzle numbers) can be associated with the lineup order of projected nozzles which are lined up along the main scanning direction. The terms "nozzle positions" or "nozzle numbers" indicates the positions of nozzles in this substantial nozzle array, or the numbers of nozzles. In addition, as in "adjacent nozzles" or the like, a case where a positional relationship between nozzles is represented also represents a positional relationship in the above substantial nozzle array. The nozzle position can be represented as an X-axis coordinate along the main scanning direction, and thus the nozzle position can be associated with the position in the X direction (X-coordinate). The nozzle number can be treated as being equal to an ejector number.

As an example, assuming a design in which the recording resolution in the main scanning direction is 1,200 dpi (dots per inch), and the recordable width in the main scanning direction is 720 millimeters [mm], the interval between nozzles in the main scanning direction in the substantial nozzle array in each of the recording heads 20C, 20M, 20Y, and 20K is approximately 21.1 micrometers [μm], and the number of nozzles (that is, the number of ejectors) is approximately 34,000.

The recording heads 20C, 20M, 20Y, and 20K of the respective colors eject ink in an on-demand manner in accordance with a driving signal and an ejection control signal which are provided from the control device 14.

The sheet transport unit 22 is one form of a "medium transport unit". The sheet transport unit 22 is means for transporting a sheet (not shown in FIG. 1) as a recording medium. Transport mechanisms of various types of transport systems such as a drum transport system, a belt transport system, a nip transport system, a chain transport system, and a flat transport system can be adopted in the sheet transport unit 22, and a configuration in which these systems are appropriately combined can be used. The sheet transport unit 22 includes a transport mechanism (not shown) and a motor as a motive power source. The sheet transport unit 22 can transport a sheet at a constant rate. Ink is ejected from at least one recording head of the recording heads 20C, 20M, 20Y, and 20K in the process of a sheet being transported by the sheet transport unit 22, and thus an image is recorded on the sheet.

In order to synchronize recording timings of the recording heads 20C, 20M, 20Y, and 20K with respect to the sheet which is transported by the sheet transport unit 22, the sheet transport unit 22 is provided with a sensor (not shown in FIG. 1) that detects the position of the sheet. An encoder, for example, can be used in the sensor that detects the position of the sheet. The sheet transport unit 22 is equivalent to relative movement means that relatively moves a sheet with respect to the recording heads 20C, 20M, 20Y, and 20K.

The image reading unit 24 is means for reading an image recorded on a sheet by droplets which are ejected from at least one recording head of the recording heads 20C, 20M, 20Y, and 20K, and generating electronic image data indicating the read image. The electronic image data indicating the read image is referred to as read image data. The "image" recorded on a sheet also includes various types of test patterns, in addition to a user image as a printed image based on printing data which is a print target specified in a print job. That is, the image reading unit 24 can read the user image or the test patterns recorded on a sheet.

The test patterns may include various forms such as a density measuring pattern or a density patch for inspecting printing density and a colorimetric pattern or a color patch for inspecting a reproduced color, in addition to a line pattern in units of ejectors used for inspecting the ejection state of the ejector.

The image reading unit 24 can be configured to include an imaging element that captures an image recorded on a sheet to convert the image information into an electrical signal, and a signal processing circuit that processes the signal obtained from the imaging element to generate digital image data.

The image reading unit 24 in this example is installed on the downstream side of the recording head portion 20 in the sheet transport direction of a sheet transport path in the printing apparatus 12. That is, the image reading unit is configured such that an imaging unit as a sensor for the image reading unit is installed on the downstream side of the recording head portion 20 in the sheet transport direction, and that the image on a sheet is read by the imaging unit while transporting the sheet after image recording. A CCD (charge-coupled device) line sensor, for example, can be used in the imaging unit of the image reading unit 24. In this manner, the image reading sensor which is installed in the middle of the sheet transport path may be referred to by the term "in-line scanner" or "in-line sensor". The in-line sensor can read an image after recording of the image performed by the recording head portion 20 and during sheet transport before sheet discharge, and can check recording results of the image while continuous printing continues.

The stamp processing unit 26 is means for affixing a mark serving as a sign to the edge of a sheet on which a defective image is generated. For example, ink is applied as the mark serving as a sign. The color of ink is not particularly limited, and a color having a tendency to be visually recognized when sheets are overlapped may be selected. The stamp processing unit 26 is installed on the downstream side of the image reading unit 24 in the sheet transport direction of the sheet transport path. The stamp processing unit 26 is equivalent to one form of an "abnormality notification unit" that notifies a user of abnormality.

The maintenance processing unit 28 is means for implementing cleaning of the recording heads 20C, 20M, 20Y, and 20K. The operation of cleaning includes at least one of wiping of an ink ejection surface, preliminary ejection, pressure purging, and nozzle suction. The maintenance processing unit 28 is also used as a moisturizing mechanism that retains the moisture of the ink ejection surface during printing standby.

The control device 14 includes an image data acquisition unit 30, a printing data generation unit 32, a calculation unit 34, a standard droplet amount data storage unit 36, a half-tone dot ratio table storage unit 38, a threshold determination unit 40, a correspondence relation data storage unit 42, a threshold storage unit 44, a test pattern generation unit 46, a recording control unit 48, a transport control unit 50, an image analysis unit 52, an abnormality determination unit 54, a correction processing unit 56, a stamp control unit 58, a maintenance control unit 60, and a user interface (UI) control unit 62.

The control device 14 is realized by a combination of hardware and software of a computer. The term "software" is synonymous with a program. The function of the control device 14 can be realized by a function of a DTP (Desk Top Publishing) device or a function of an RIP (Raster Image Processor) device. The DTP device is a device that generates manuscript image data indicating image contents which are to be printed. The DTP device is used for editing various types of image components such as a character, a figure, a picture, an illustration, and a photographic image, and performing a work for a layout on the printing surface. The manuscript image data can be formed as, for example, electronic manuscript data based on a page description language (PDL). The RIP device functions as means for rasterizing the manuscript image data to convert the resultant into data of a bitmap image for printing.

The image data acquisition unit 30 is an interface unit that fetches image data indicating image contents of a print object which is to be printed by the ink jet recording 10. The image data acquisition unit 30 can be constituted by a data input terminal that fetches the image data from the outside or another signal processing unit within a device. In addition, as the image data acquisition unit 30, a wired or wireless communication interface unit may be adopted, a media interface unit that performs reading and writing of an external recording medium such as a memory card or a removable disk may be adopted, or an appropriate combination thereof may be used.

There may be various formats of image data indicating image contents of a print object. For example, manuscript image data based on a page description language can be fetched from the image data acquisition unit 30.

The printing data generation unit 32 performs signal processing of generating printing data for the printing apparatus 12 to perform a printing output from the manuscript image data which is fetched from the image data acquisition unit 30. The printing data is data for specifying contents of a printed image which is recorded on a sheet by the recording heads 20C, 20M, 20Y, and 20K. The printing data generation unit 32 has a color conversion processing function for performing conversion from the manuscript image data which is a continuous-tone image to dot pattern data by colors appropriate to an output performed by the printing apparatus 12, a gradation correction processing function, and a half-tone processing function.

When image data is printed which is specified by the format of resolution or a combination of colors different from the resolution or type of ink colors used in the ink jet recording apparatus 10, a process such as color conversion or resolution conversion is performed in the printing data generation unit 32, or by a pre-processing unit (not shown) at a stage before image data is fetched from the image data acquisition unit 30, and the image data is converted into image data of ink colors and resolution used in the printing apparatus 12.

The half-tone process is a process of converting a multi-gradation image signal, in units of pixels, a binary signal indicating that ink is ejected/not ejected, or a multi-valued signal indicating that a droplet type corresponding to what droplet size is ejected when a plurality of droplet sizes of ink can be selected. That is, generally, in case of an integer $M_A$ equal to or greater 3 and an integer N equal to or greater than 2 and equal to or less than $M_A$, the half-tone process is a process of quantizing continuous-tone image data which is $M_A$-valued multi-gradation data in units of pixels to convert the quantized data into N-valued data. The half-tone process is also called a quantization process and an N-valued process. Various types of method such as a dither method, an error diffusion method, and a density pattern method can be applied to the half-tone process.

Data of an N-valued dot image capable of being recorded by the recording heads 20C, 20M, 20Y, and 20K of the printing apparatus 12 is obtained by the half-tone process. The dot image which is generated through the half-tone process may be represented by the term "half-tone image". The data of a dot image may be represented by the term "dot data" or "half-tone image data".

As an example, when the continuous-tone image data before the half-tone processing is assumed to be image data of each of 8-bit CMYK colors, that is, 256 gradations, and three kinds of droplet sizes of a large droplet, a medium droplet, and a small droplet are assumed to be capable of being selectively typed in the recording heads 20C, 20M, 20Y, and 20K of the printing apparatus 12, in the half-tone process, image data of each color represented by 256 gradations ($M_A$=256) is converted into data of 4 gradations (N=4) of "ejection of large droplet ink", "ejection of medium droplet ink", "ejection of small droplet ink", and "non-ejection", that is, data of a four-value dot image.

The data of the half-tone image (in this example, data of the four-value dot image) generated through the half-tone process is sent to the recording control unit 48, and is used in driving control of an ejection energy generation element of a corresponding ejector. That is, ink ejection of the respective nozzles in the recording heads 20C, 20M, 20Y, and 20K is controlled in accordance with this four-value signal. A large dot is recorded on a sheet by large droplet ink, a medium dot is recorded on the sheet by medium droplet ink, and a small dot is recorded on the sheet by small droplet ink. A multi-gradation image is reproduced by area gradation based on the arrangement of the ink dots recorded on the sheet in this manner.

In order to realize an appropriate half-tone process in accordance with various types of print conditions such as a combination of ink and the type of sheets used in printing, and required image quality, a plurality of types of half-tone process are prepared within a device. The type of half-tone process applied is determined on the basis of a user's selection operation, or by automatic selection based on the print conditions.

The calculation unit 34 calculates an index value relevant to the droplet ejection amount for each ejector which is expected during recording of the printed image with respect each of the plurality of ejectors in the respective recording heads 20C, 20M, 20Y, and 20K, on the basis of the printing data. As a first example of the index value relevant to the droplet ejection amount, there is a value indicating an average ejection amount per unit pixel. The ejection amount is an amount of droplets to be ejected, and can be denoted by a volume. Picoliters [pL] can be used as the unit of the volume. 1 picoliter is $10^{-12}$ liters, and 1 liter is $10^{-3}$ cubic meters [$m^3$]. The "unit pixel" can be set to 1 pixel. Meanwhile, the size of 1 pixel is determined from each recording resolution in the main scanning direction and the sub-scanning direction.

As a second example of the index value relevant to the droplet ejection amount, there is a value indicating the total ejection amount within a specific pixel region. The "specific pixel region" can be set to a region of a plurality of pixels continuous in a row of pixels in which an ejector of interest takes charge of recording. The number of pixels specifying the region of the plurality of pixels can be set in advance. The specific pixel region is equivalent to one form of "some or all of the pixel groups in which the ejector takes charge of recording". When the total ejection amount within the specific pixel region is divided by the number of pixels of the specific pixel region, it is possible to obtain a value indicating the average ejection amount per pixel. As the index value relevant to the droplet ejection amount, it is the option of a calculation method that a value indicating the average ejection amount per unit pixel is obtained, or the total ejection amount within the specific pixel region is obtained. An object of the present invention can be achieved using any index value.

The calculation unit 34 can calculate the index value using the data of the half-tone image which is a dot image after the half-tone process. That is, the calculation unit 34 can calculate a value indicating the average ejection amount per unit pixel in some or all of the pixel groups in which each ejector takes charge of recording for each ejector, or a value indicating the total ejection amount in some or all of the pixel groups in which each ejector takes charge of recording for each ejector, on the basis of the half-tone image corresponding to the printing data, and a standard droplet amount per dot for each dot type.

The standard droplet amount data storage unit 36 is means for storing standard droplet amount data indicating the standard droplet amount of each dot size of each color. For example, when three kinds of droplet sizes (that is, dot sizes) of a large droplet, a medium droplet, and a small droplet can be selectively typed, the droplet amount for each dot type is determined as information in units of picoliters in the standard droplet amount data. The standard droplet amount of each droplet size may be obtained experimentally in advance, and may be determined from a design value. The calculation unit 34 acquires information of the standard droplet amount from the standard droplet amount data storage unit 36, and calculates the index value.

In addition, the calculation unit 34 can calculate the index value relevant to the droplet ejection amount for each ejector using the continuous-tone image data before the half-tone process. That is, the calculation unit 34 can fetch the continuous-tone image data indicating an ink gradation value before the half-tone process as the printing data, and calculate a value indicating the average ejection amount per unit pixel for each ejector or a value indicating the total ejection amount within the specific pixel region for each ejector, on the basis of a half-tone dot ratio table, the standard droplet amount per dot for each dot type, and the ink gradation value of a pixel in which each ejector takes charge of recording.

The half-tone dot ratio table is a table in which a correspondence relation between a signal value of the image data indicating the ink gradation value and an appearance ratio by dot sizes per unit area in the dot arrangement of the half-tone image obtained by performing the half-tone process on an image of the signal value is described. A plurality of half-tone dot ratio tables are prepared for each type of the half-tone process, and a corresponding half-tone dot ratio table is referred to in accordance with the type of half-tone process applied to an image process.

The half-tone dot ratio table storage unit 38 is means for storing the half-tone dot ratio table.

The calculation unit 34 can calculate the index value by referring to the half-tone dot ratio table which is stored in the half-tone dot ratio table storage unit 38, and acquiring the information of the standard droplet amount from the standard droplet amount data storage unit 36.

The threshold determination unit 40 performs a process of determining a threshold for ejection abnormality determination for each ejector, in accordance with the index value for each ejector which is calculated by the calculation unit 34. The threshold determination unit 40 determines a threshold for each ejector, using correspondence relation data which is stored in the correspondence relation data storage unit 42. The correspondence relation data is data in which a correspondence relation between the index value and the threshold for ejection abnormality determination is specified. The correspondence relation data storage unit 42 is means for storing the correspondence relation data.

The threshold storage unit 44 is means for storing information of a threshold for each ejector which is determined by the threshold determination unit 40. In the present embodiment, the threshold for ejection abnormality determination is called a "defective jet threshold".

The test pattern generation unit 46 generates data of various test patterns. The test pattern generation unit 46 can generate data of various types of test pattern such as data of a test pattern for defective ejector detection for detecting the ejection state of each ejector, data of a test pattern for non-ejection correction parameter acquisition for calculating a non-ejection correction parameter, and data of a test pattern for density measurement for obtaining density measurement data required for calculating a density unevenness correction parameter. The test pattern data is provided, as necessary, from the test pattern generation unit 46 to the recording control unit 48.

As the test pattern for defective ejector detection, for example, a so-called "1-on n-off" type test pattern can be used. The "1-on n-off" type test pattern is a pattern in which, in one line head, when the lineup of nozzles constituting a nozzle array lined up in a row substantially in the X direction is given an ejector number (that is, nozzle number) in order from an end in the main scanning direction, nozzle groups which are simultaneously ejected by a residue number "q" (q=0, 1, . . . , p−1) when the ejector number is divided by an integer "p" equal to or greater than 2 are divided by groups, a droplet ejection timing is changed for each group of the ejector numbers of pN+0, pN+1, . . . , pN+q, and a line group based on continuous droplet ejection from each nozzle is formed. Herein "N" indicates an integer equal to or greater than 0.

Line patterns of adjacent nozzles adjacent to each other do not overlap each other due to using such a test pattern for defective ejector detection, and line patterns independent of each other for each nozzle (that is, for each ejector) are formed.

The presence or absence of ejection in each ejector can be ascertained from output results of the test pattern for defective ejector detection. In addition, a landing position shift amount of each ejector is measured, and thus a case where the landing position shift amount increases to above a threshold can be determined to be ejection abnormality.

In the present embodiment, the test patterns for defective ejector detection are recorded in the margin portion of a sheet one at a time during the execution of a print job. The pattern for defective ejector detection recorded in each sheet is read by the image reading unit 24, and the generation of a defective ejector is detected early, to thereby apply a correction process.

The recording control unit 48 controls recording operations of the recording heads 20C, 20M, 20Y, and 20K, on the basis of the printing data. The recording control unit 48 can include a driving waveform generation unit and a head driver. A combination of the test pattern generation unit 46 and the recording control unit 48 is equivalent to one form of a "test pattern recording control unit".

The transport control unit 50 controls driving of the sheet transport unit 22. The transport control unit 50 includes a motor driver for driving a motor (not shown) which is a motive power source of the sheet transport unit 22.

The image analysis unit 52 analyzes the data of the read image which is read from the image reading unit 24. The image analysis unit 52 can measure the landing position shift amount of each ejector, a line width of a recording line of each ejector, or the like from the data of the read image. Since the line width is related to the amount of droplets to be ejected, information of the line width can be converted into information of the amount of ejected droplets by using a table in which a correspondence relation between the line width and the amount of ejected droplets is set. The landing position shift amount and the line width which are obtained by the image analysis unit 52, and information of the measurement amount such as the amount of ejected droplets are sent to the abnormality determination unit 54.

The abnormality determination unit 54 determines the presence or absence of ejection abnormality by comparing a measurement amount for each ejector which is obtained by inspecting the ejection state of the ejector with a threshold which is set in an ejector related to the measurement amount. The abnormality determination unit 54 is stored in the threshold storage unit 44.

The correction processing unit 56 performs image correction for correcting a defective image due to an ejector in which defective ejection is detected. The correction processing unit 56 performs a correction process on the basis of determination results of the abnormality determination unit 54. A method of performing correction in the correction processing unit 56 may include various forms.

Here, an outline of the correction process will be given. In the ink jet head, ejection disabled non-ejecting nozzles may be generated due to the clogging of a nozzle, the failure of an ejection energy generation element, or the like. In addition, even in an ejection enabled nozzle, a defective jet in which the landing position shift amount increases by exceeding an allowable value may be generated. A non-ejection process is forcibly performed on the nozzle (that is, ejector) in which such a defective jet is generated so that the nozzle is not used in recording, and the nozzle is treated as a non-ejecting nozzle.

Since the non-ejecting nozzle is not able to record a dot, particularly, in an ink jet printing system of a single pass type, a white streak-shaped defective image along a sheet feed direction occurs at an image position of the printed image corresponding to the non-ejecting nozzle, and thus a print quality problem occurs. As a correction technique for improving a defective image caused by such a non-ejecting nozzle, a technique of "non-ejection correction" is known. The term "non-ejection correction" is synonymous with "ejection disabling correction", and is denoted by "non-ejection correction" in this specification.

The non-ejection correction is realized by changing a dot ejected from another ejection enabled nozzle adjacent to the non-ejecting nozzle. Non-ejection correction methods can be classified into three general methods.

A first correction method is a method of correcting a continuous-tone image before the half-tone process. That is, the method is a method in which, on the continuous-tone image serving as an input image for the half-tone process, a signal value of a pixel in the vicinity of a non-ejection portion is changed to a value larger than that before correction, to thereby increase the amount of ink which is ejected from nozzles in the vicinity of the non-ejection portion during the half-tone process. Meanwhile, the term "non-ejection portion" refers to an image position at which recording is not possible by the non-ejecting nozzle.

A second correction method is a method of correcting a half-tone image after the half-tone process. That is, the method is a method in which the half-tone process is temporarily performed on the data of the continuous-tone image, and dot data conversion of changing the dot arrangement is performed on a correction region in the vicinity of the non-ejection portion of the obtained half-tone image.

A third correction method is a method in which a process of special image correction is not performed during the generation of the half-tone image, and an ejection driving waveform of an ejector in the vicinity of the non-ejection portion is changed during droplet ejection driving, to thereby bury a white streak portion of the non-ejection portion by increasing dots which are ejected.

The correction processing unit 56 of the present embodiment is assumed to perform a process of image correction based on the first correction method. However, the correction process based on the second correction method or the third correction method may be applied during the implementation of the invention.

The function of the correction processing unit 56 can be incorporated in the printing data generation unit 32.

The stamp control unit 58 controls an operation of the stamp processing unit 26 on the basis of the determination results of the abnormality determination unit 54.

The maintenance control unit 60 controls an operation of the maintenance processing unit 28 on the basis of the determination results of the abnormality determination unit 54.

The user interface (UI) control unit 62 controls an input process from the operating unit 16 and an output process to the display unit 18. A display device such as a liquid crystal display or an organic EL (Organic Electro-Luminescence) display can be used in the display unit 18. The operating unit 16 can adopt various types of input device such as a keyboard, a mouse, a touch panel, and a trackball, and may be an appropriate combination thereof.

A user can input various information using the operating unit 16, and can operate the ink jet recording apparatus 10. In addition, a user can ascertain the state or the like of the ink jet recording apparatus 10 through contents which are displayed on a screen of the display unit 18, or can confirm setting contents. The display unit 18 is equivalent to one form of an abnormality notification unit that notifies a user of abnormality. In addition, the display unit 18 is means for providing information to a user through a display on a screen, and the display unit 18 is equivalent to one form of an "abnormality information providing processing unit" that provides information for causing a user to perceive abnormality.

[With Respect to Variation of System Configuration]

The ink jet recording apparatus 10 can be realized as a printing system having the printing apparatus 12 and the control device 14 connected to each other. "Connection" between devices capable of delivering signals may be wired connection and may be wireless connection. The printing apparatus 12 and the control device 14 can be configured to be connected to each other through a telecommunication channel. The telecommunication channel may be a local area network (LAN), may be a wide area network (WAN), and may be a combination thereof. The telecommunication channel is not limited to a cable communication channel, and some or the entirety of the channel can be set to a radio communication channel.

The function of the control device 14 can be realized by one computer, and can also be realized by a plurality of computers. When the function of the control device 14 is realized by a plurality of computers, the sharing of a role or a function for each computer may include various forms.

In addition, instead of a configuration in which the printing apparatus 12 and the control device 14 are connected to each other, the ink jet recording apparatus 10 can be configured as an integral apparatus in which the control device 14 is incorporated in the printing apparatus 12.

[Specific Example of Printing Job in Ink Jet Recording Apparatus]

FIGS. 2 to 7 are flow diagrams illustrating an example of a procedure of a printing job in the ink jet recording apparatus 10. A process and an operation of each step shown in FIGS. 2 to 7 are executed as the process in the control device 14 described in FIG. 1 and the operation of the printing apparatus 12. The flow diagrams shown in FIGS. 2 to 7 include contents of an abnormality detection method of an ejector according to an embodiment.

Figure 2:
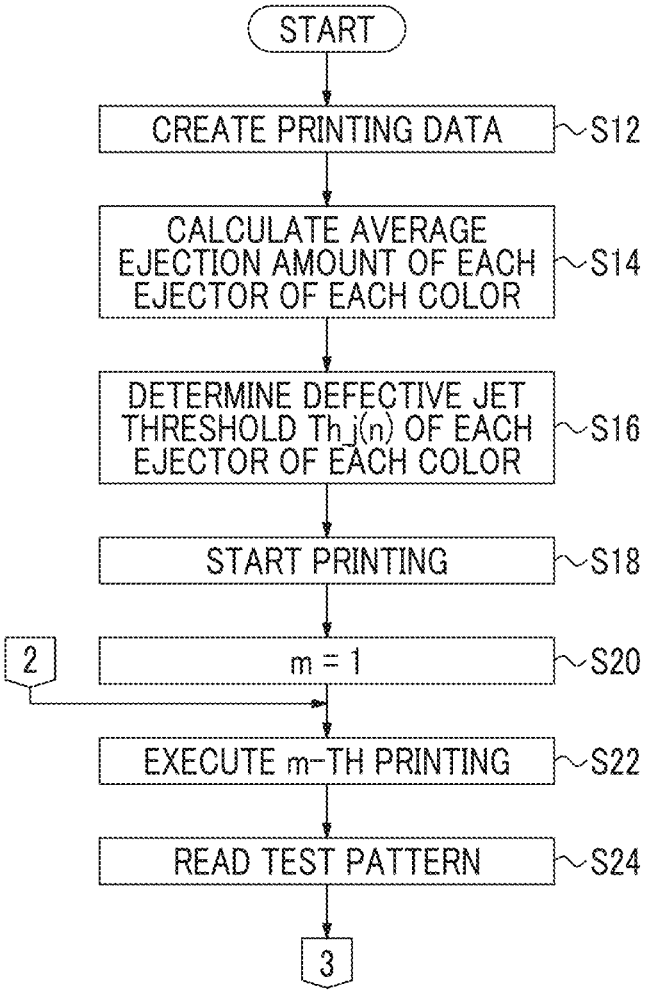
FIG. 2 is a flow diagram illustrating an example of a procedure of a printing job in the ink jet recording apparatus.

As shown in FIG. 2, when the printing job is started, the control device 14 (see FIG. 1) first creates printing data (step S12 of FIG. 2). The format of the printing data may include various types of forms. Here, the format is assumed to be data of a half-tone image by colors appropriate to an image output performed by the printing apparatus 12 (see FIG. 1), and a dot image having resolution consistent with the recording resolution which is realized by the nozzle array of the recording heads 20C, 20M, 20Y, and 20K is created.

When the printing job is started, a user image which is a print target of the print job is determined by a user's operation. When the user image is determined, through a process in the inside of the control device 14, it is established from the user image what size droplets are ejected at which timing by each ejector of the recording heads 20C, 20M, 20Y, and 20K corresponding to each color.

The printing data generation unit 32 in the control device 14 described in FIG. 1 generates printing data indicating contents for specifying what size droplets are ejected at which timing from the user image by each ejector of the recording heads 20C, 20M, 20Y, and 20K of each color. The printing data generation unit 32 generates the printing data performing image processing such as a color conversion process, a gradation conversion process, and a half-tone process. The printing data includes color components of CMYK corresponding to the respective recording heads 20C, 20M, 20Y, and 20K. The printing data may be represented by a CMYK signal including each component of a C signal, an M signal, a Y signal, and a K signal for each pixel, and may be image data by colors resolved for each color of a C image based on the C signal, an M image based on the M signal, a Y image based on the Y signal, and a K image based on the K signal.

The calculation unit 34 (see FIG. 1) calculates an average ejection amount of each ejector of each color on the basis of the printing data (step S14 of FIG. 2). Step S14 is equivalent to one form of a "calculation step". As one form of the index value relevant to the droplet ejection amount for each ejector, a specific example of a method of calculating the average ejection amount of each ejector will be described with reference to FIG. 8.

Figure 8:
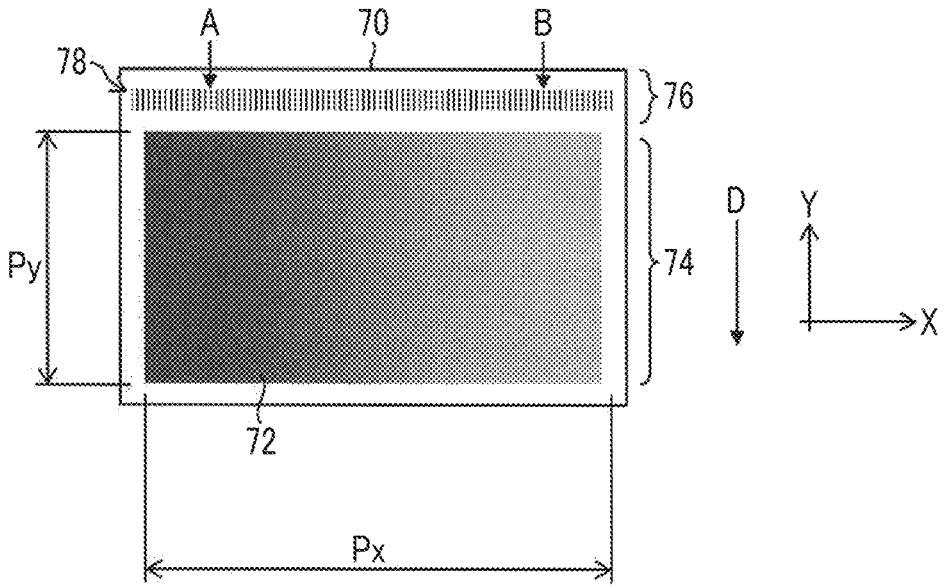
FIG. 8 is a schematic diagram illustrating an example of a printed image.

FIG. 8 is a schematic diagram illustrating an example of a printed image. Here, for the purpose of simplifying description, a case will be described in which a gradation image as shown in FIG. 8 is printed as the user image. In FIG. 8, the Y direction which is a longitudinal direction of the drawing is a sheet transport direction. The Y direction is equivalent to the "sub-scanning direction". In FIG. 8, the X direction orthogonal to the Y direction is a sheet width direction. The X direction is equivalent to the "main scanning direction". The X direction is equivalent to a nozzle lineup direction in the substantial nozzle array in the recording heads 20C, 20M, 20Y, and 20K (see FIG. 1). The arrow D of FIG. 8 represents a "printing direction" in which recording of an image on a sheet 70 progresses with the transport of the sheet 70 in the Y direction. In FIG. 8, recording of the image progresses from the top to the bottom of the sheet 70.

A recording region of a user image 72 in the recording surface of the sheet 70 is called a "user image recording region", and is denoted by sign 74 in FIG. 8. The user image recording region 74 is assumed to be a rectangular region of Py×Px pixels composed of Py pixels in the Y direction along the short side of the rectangular sheet 70 and Px pixels in the X direction along the long side thereof. For the purpose of simplifying description, as an example, a description will be given in which the relations of Py=20,000 and Px=34,000 are established.

The user image 72 illustrated in FIG. 8 is formed as a gradation image in which ink density smoothly changes from a leftmost location having a highest ink density to a rightmost location having a lowest ink density in FIG. 8. It is assumed that the location having a highest ink density in the user image 72 has an average ejection amount per unit pixel of 4.0 picoliters [pL], and that the location having a lowest ink density has an average ejection amount per unit pixel of 0.0 picoliters [pL].

An upper portion in the Y direction located further upward than the user image recording region 74 in the recording surface of the sheet 70, that is, a margin region 76 of the sheet 70 on the leading side in the sheet transport direction is utilized as a recording region of a test pattern 78. Here, a description will be given in which the test pattern 78 based on ink of any one color of CMYK is recorded on one sheet 70. However, a test pattern based on ink of a plurality of colors can also be recorded on one sheet 70. As the test pattern 78, a so-called 1-on n-off type line pattern can be used.

When printing data is created in step S12 of FIG. 2, the calculation unit 34 (see FIG. 1) subsequently calculates the average ejection amount of each ejector of each color (step S14 of FIG. 2). The average ejection amount of each ejector of each color is denoted by Vav_j(n). The suffix "j" is a color identification sign for discriminating ink colors. In this example, since four-color ink of CMYK is used, a relation of j={C, M, Y, K} is established.

In the ink jet recording apparatus 10 (see FIG. 1) of this example, each ejector of the recording heads 20C, 20M, 20Y, and 20K of each color is assumed to be able to control the ejection amount in four stage of a large droplet, a medium droplet, a small droplet, and non-ejection (ejection pause).

When the standard droplet amounts of a large droplet, a medium droplet, and a small droplet in the ink jet recording apparatus 10 are set to $V_L$, $V_M$, and $V_S$, respectively, and with respect to a row of pixels in which an ejector n having an ejector number "n" in the printing data takes charge of recording, and the ejector n ejects a large droplet at a rate of a %, ejects a medium droplet at a rate of b %, ejects a small droplet at a rate of c %, and ejects an ejection pause at a rate of d %, the average ejection amount of the ejector n can be calculated as $V_L \times (a/100) + V_M \times (b/100) + V_S \times (c/100)$. Herein, the relations of $0 \leq a \leq 100$, $0 \leq b \leq 100$, $0 \leq c \leq 100$, $0 \leq d \leq 100$, and $a+b+c+d=100$ are satisfied.

As a specific example, in the ink jet recording apparatus 10 of this example, it is assumed that the standard droplet amount of a medium droplet is 6.0 pL (picoliters), and that the standard droplet amount of a small droplet is 2.0 pL (picoliters). In this case, when an "ejector A" of FIG. 8 ejects a medium droplet at a rate of 40%, ejects a small droplet at a rate of 50%, and ejects an ejection pause at a rate of 10% over a range of 20,000 pixels in the sheet transport direction, the average ejection amount of the ejector A becomes equal to 3.4 pL (picoliters).

On the other hand, when an "ejector B" ejects a medium droplet at a rate of 0%, ejects a small droplet at a rate of 10%, and ejects an ejection pause at a rate of 90% over a range of 20,000 pixels in the sheet transport direction, the average ejection amount of the ejector B becomes equal to 0.2 pL (picoliters). In this manner, it is possible to calculate each average ejection amount for each ejector used in printing.

In FIG. 8, a gradation image of a simple rectangular region is illustrated as the user image 72. The user image 72 of FIG. 8 is an image having no locality in the sheet transport direction. The "locality" as used herein means the location dependency or localization of the distribution of ink in a row of pixels lined up in the sheet transport direction.

On the other hand, generally, the user image which is a print object has locality in the sheet transport direction. When the user image has locality in the sheet transport direction, that is, in a normal case, attention is required during the calculation of the average ejection amount of each ejector.

Figure 9:
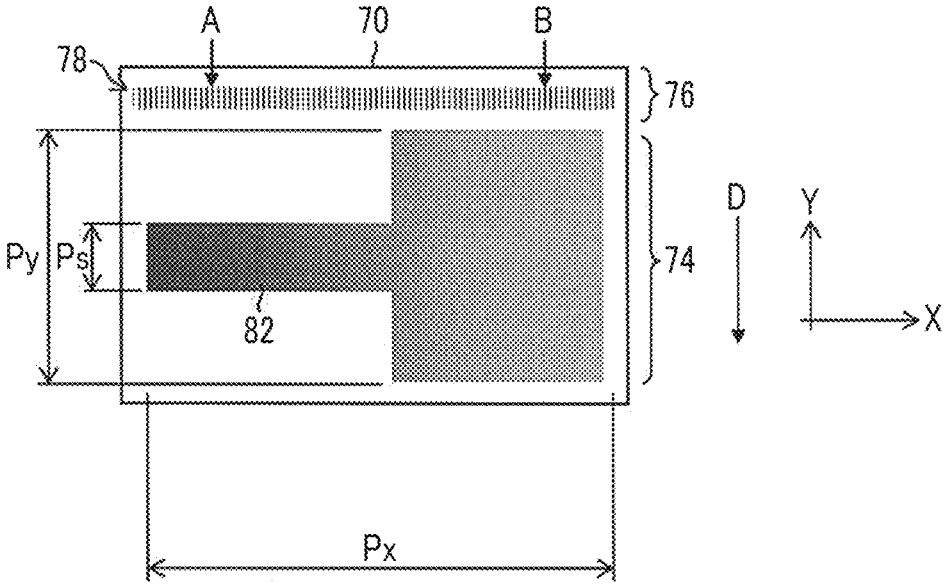
FIG. 9 is a schematic diagram illustrating another example of the printed image.

FIG. 9 is an example when the user image has locality in the sheet transport direction. A user image 82 shown in FIG. 9 is a portion in which only Ps=4,000 pixels which are a pixel range having a restricted width in Py=20,000 pixels are printed in a printing direction shown by an arrow D.

In this manner, when only a pixel range having a restricted width is printed in the printing direction, the calculation of the average ejection amount in the method described in FIG. 8 has the possibility of the value of the average ejection amount being calculated lower than in reality.

Consequently, it may be a preferred form that, instead of the calculation of the average ejection amount based on simple averaging described in FIG. 8, the moving average of the ejection amount is calculated for each specified length with respect to a width in the sheet transport direction, and that the maximum value of the moving average is defined as the "average ejection amount". The maximum value of the moving average is equivalent to one form of a "representative value of the moving average". Meanwhile, a representative value determined in another statistical method may be defined as the "average ejection amount" without being limited to the maximum value of the moving average.

It is preferable that the "specified length" at the time of obtaining the moving average is set to a length capable of being visually recognized as a streak-shaped defective image when the printing results are visually observed. Normally, when there is a print length of approximately 1 millimeter [mm] in the sheet transport direction, it is considered that a streak can be visually recognized. Therefore, the moving average of the ejection amount is calculated for each millimeter [mm], for example, with respect to the full width in the sheet transport direction in the image recording region of a sheet. When the recording resolution in the sub-scanning direction in the printing apparatus 12 is assumed to be 1,200 dpi which is the same as the recording resolution in the main scanning direction, a length of 1 mm in the sub-scanning direction on a sheet is equivalent to the amount of approximately 50 pixels. Therefore, the moving average of the ejection amount is calculated for every 50 pixels.

Next, the flow proceeds to step S16 of FIG. 2, and a defective jet threshold Th_j(n) of each ejector of each color is determined. Step S16 is equivalent to one form of a "threshold determination step". Here, "n" represents an ejector number. It is assumed that in each of the recording heads 20C, 20M, 20Y, and 20K, the number of ejectors is 34,000, and n is an integer of 1 to 34,000.

Table 1 is an example of correspondence relation data in which a correspondence relation between the average ejection amount and the defective jet threshold is specified. In Table 1, the average ejection amount is denoted by "Vav", and the defective jet threshold "Th" is shown without specifying the color of ink.

TABLE 1

| Average Ejection Amount (pL) | Defective Jet Threshold Th |
|---|---|
| 0.00 pL ≤ Vav < 0.01 pL | None |
| 0.01 pL ≤ Vav < 0.5 pL | 25 μm |
| 0.5 pL ≤ Vav < 1.0 pL | 18 μm |
| 1.0 pL ≤ Vav < 2.0 pL | 14 μm |
| 2.0 pL ≤ Vav < 3.0 pL | 12 μm |
| 3.0 pL ≤ Vav < 4.0 pL | 11 μm |
| 4.0 pL ≤ Vav | 10 μm |

In order to determine the defective jet threshold from the average ejection amount, the correspondence relation data as shown in Table 1 is used. The meaning of the defective jet threshold Th refers to a determination criterion in which the ejector is determined to be normal when the landing position shift amount D(n) for each ejector satisfies the inequality of $|D(n)|<Th(n)$, and the ejector is determined to be "abnormal" when the amount does not satisfy the inequality of $|D(n)|<Th(n)$.

Figure 10:
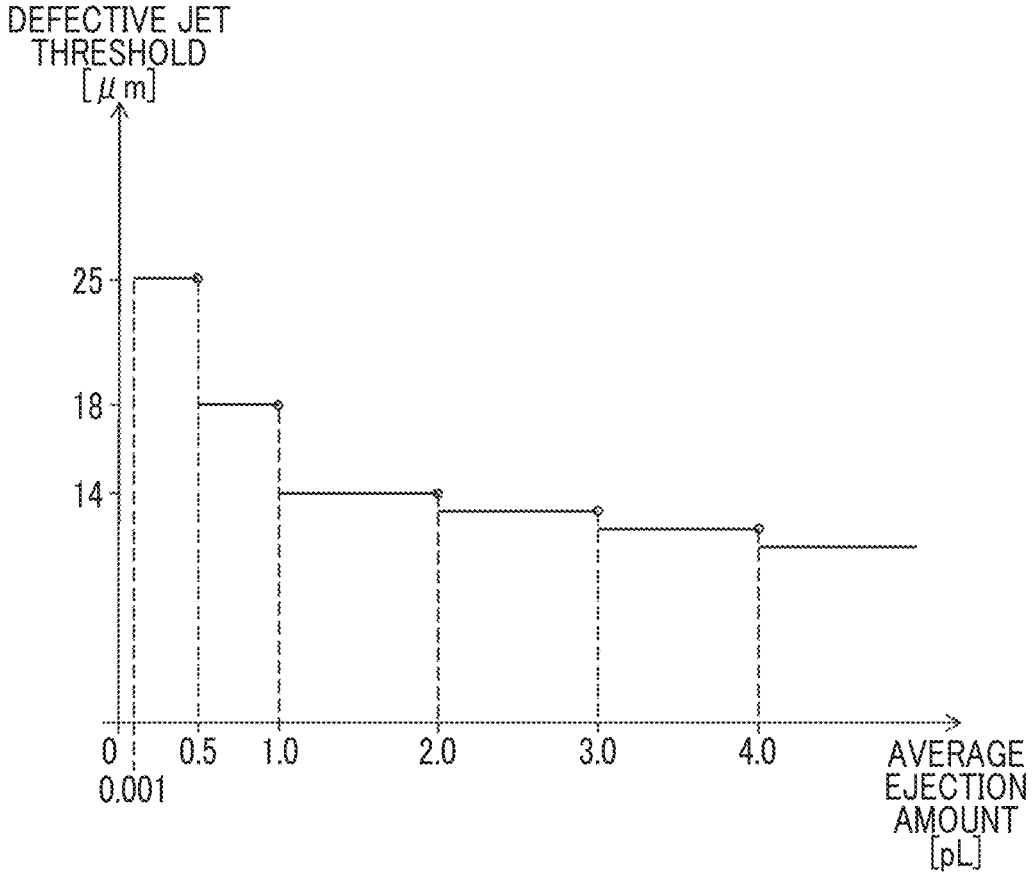
FIG. 10 is a graph illustrating an example of data of a correspondence relation between an average ejection amount and a defective jet threshold.

FIG. 10 is a diagram in which the table of the correspondence relation data shown in Table 1 is illustrated as a graph. The horizontal axis of FIG. 10 represents an average ejection amount, and the vertical axis represents a defective jet threshold. The unit of the horizontal axis is picoliter [pL], and the unit of the vertical axis is micrometer [μm]. As shown in Table 1 and FIG. 10, there is a tendency for the value of the defective jet threshold to become smaller as the average ejection amount becomes larger. That is, as the average ejection amount becomes larger, the determination criterion becomes more restrictive.

The user image 72 described in FIG. 8 becomes a gradation image in which the average ejection amount smoothly changes from 4.0 picoliters [pL] to 0.0 picoliters [pL]. In this case, when the defective jet threshold is obtained from Table 1, the defective jet threshold of a location having a highest ink density becomes equal to "10 μm", and the defective jet threshold of a location having a lowest ink density has "no value", that is, is not required to be detected.

In addition, in the location of the ejector A shown in FIG. 8, since the average ejection amount per pixel is 3.4 picoliters, the defective jet threshold of the ejector A is set to "11 μm" from Table 1.

In Table 1, the defective jet threshold is established as discrete values with respect to the range section of the average ejection amount, but correspondence relation data that smoothly (continuously) changes with a change in the average ejection amount can also be established instead of a configuration in which the thresholds are established as such discrete (stepwise) values.

Figure 11:
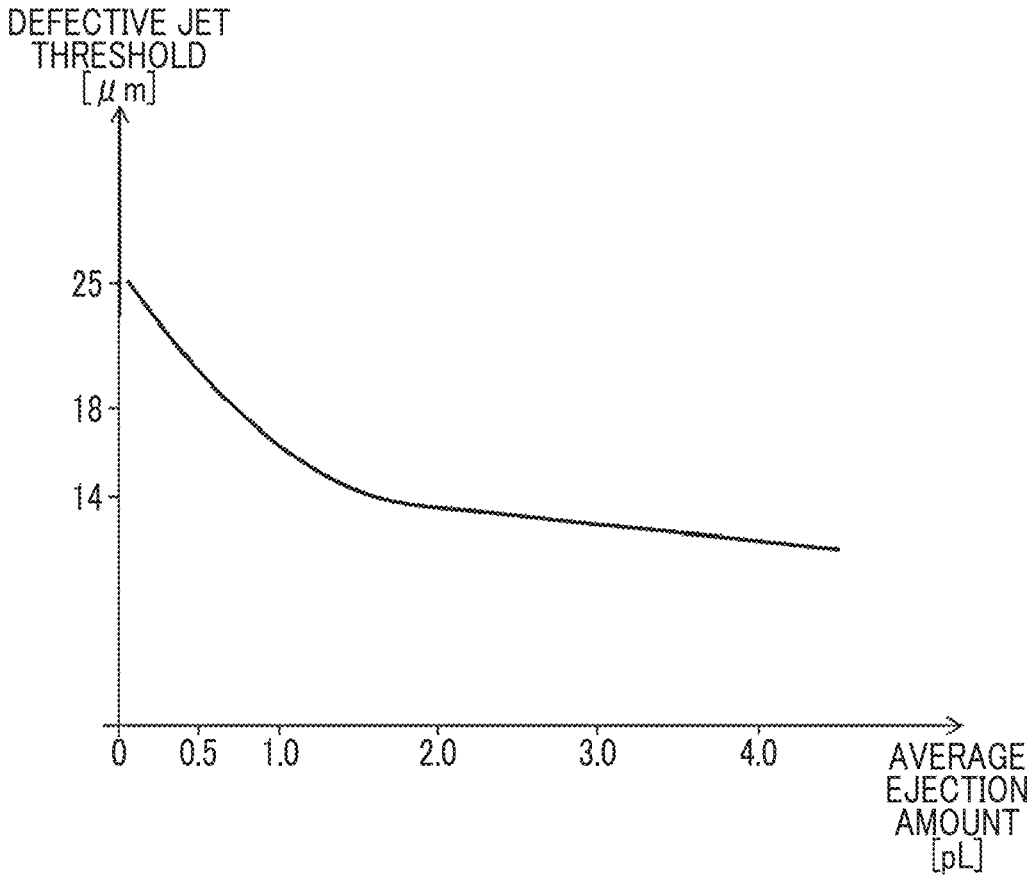
FIG. 11 is a graph illustrating another example of the data of a correspondence relation between the average ejection amount and the defective jet threshold.

FIG. 11 is a diagram in which the table of FIG. 10 having the correspondence relation data, smoothly (continuously) changing with a change in the average ejection amount, capable of being established therein is illustrated by a graph.

Meanwhile, regarding the landing position shift amount D(n) which is measured for each ejector, a non-ejection ejector is not able to measure the measurement value of the landing position shift amount. However, when the non-ejection ejector is assumed to treat the landing position shift amount as a value equal to or greater than a measurement limit value, the values can be collectively treated during a process of abnormality detection using the defective jet threshold.

The value equal to or greater than the measurement limit value refers to a value for performing treatment in which the landing position shift amount of the non-ejection ejector is set to "999 μm", for example, when the measurement limit value is 100 micrometer [μm].

The defective jet threshold established for each ejector by step S16 of FIG. 2 is stored in the threshold storage unit 44 described in FIG. 1. A step of storing the defective jet threshold in the threshold storage unit 44 is equivalent to one form of a "threshold storage step".

In step S16 of FIG. 2, after each defective jet threshold is determined with respect to each ejector of each color, the flow proceeds to step S18 of FIG. 2, and printing is started. The count of the number of sheets printed is started in accordance with the start of printing. In step S20, a value m of a counter that counts the number of sheets printed is set to "1" which is an initial value. Thereafter, m-th printing is executed (step S22), and a test pattern is read (step S24). The test pattern is read by the image reading unit 24 described in FIG. 1.

In the present embodiment, as described in FIGS. 8 and 9, the test pattern 78 is printed on the margin region of each sheet 70 on the leading side. However, the test pattern can also be printed on the margin region of the sheet on the rear-end side during the implementation of the invention. In addition, in the present embodiment, a configuration in which the test pattern of one color is printed on one sheet 70 is described, but a configuration in which a test pattern having four colors in one sheet is printed can also be used.

Figure 3:
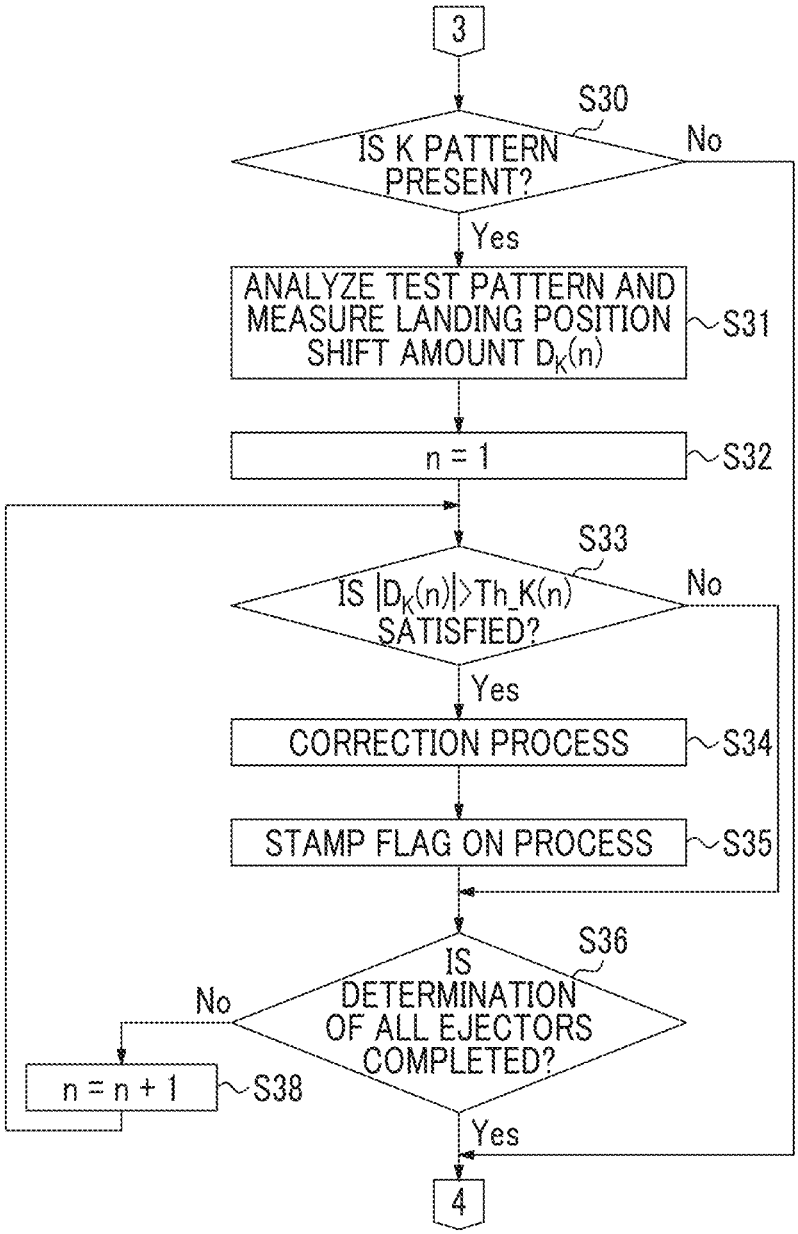
FIG. 3 is a flow diagram illustrating an example of a procedure of the printing job in the ink jet recording apparatus.

After step S24 of FIG. 2, the flow proceeds to step S30 of FIG. 3, and read image data is analyzed. The image analysis unit 52 (see FIG. 1) first determines whether a K pattern is present in the read image data (step S30 of FIG. 3). The term "K pattern" refers to a test pattern which is printed by K ink. Color information of the test pattern is acquired from the read image data during the determination of step S30, and the color of the pattern can be determined. In addition, when the order of the colors by which the test pattern is printed is set in advance, the color of the pattern can be determined from a relationship between the count value m of the number of sheets printed and the order of the colors. Alternatively, the information of the color in which the test pattern is output is also acquired from the record control unit 48, and thus the color of the pattern can be determined.

When the K pattern is present in the read image data, the determination result in step S30 is Yes, and the flow proceeds to step S31. In step S31, the analysis of the test pattern based on the K ink is performed in the image analysis unit 52, to thereby measure a landing position shift amount $D_K(n)$ of each ejector in the K recording head 20K. When the number of ejectors in the recording head 20K is 34,000, the landing position shift amount is obtained with respect to each of the 34,000 ejectors.

Subsequently, the determination of the presence or absence of abnormality is performed for each ejector. In step S32, the ejector number n which is a target of determination is set to "n=1". Next, a defective jet threshold Th_K(n) determined with respect to each ejector and the absolute value of the landing position shift amount $D_K(n)$ of each ejector are compared with each other (step S33). In step S33, the determination of whether the inequality of $|D_K(n)|>Th_K(n)$ is satisfied is performed. When the absolute value of the landing position shift amount $D_K(n)$ exceeds Th_K(n), the ejection of the ejector is determined to be abnormal. The ejection of the ejector that satisfies the inequality of $|D_K(n)|>Th_K(n)$ is determined to be a "defective jet" in which the landing position shift amount exceeds an allowable range.

On the other hand, when the inequality of $|D_K(n)|>Th_K(n)$ is not satisfied, that is, when the absolute value of the landing position shift amount $D_K(n)$ is equal to or less than the defective jet threshold Th_K(n), the value is within a normal range, and thus the ejector is determined to be "no problem", that is, "normal". In this manner, the defective jet threshold Th_K(n) determined with respect to each ejector and the absolute value of the landing position shift amount $D_K(n)$ of each ejector are compared with each other, thereby allowing the defective jet determination of each ejector to be performed. The defective jet determination is one form of "abnormality detection". Step S33 is equivalent to one form of an "abnormality determination step".

There are a plurality of measures taken when the ejector determined to be a defective jet is generated. The examples are as follows.

Example 1

A correction process of reducing the visibility of a streak is performed by stopping recording performed by the ejector determined to be a defective jet, and increasing the ink ejection amount from ejectors corresponding to pixels on both sides of a pixel in which the ejector determined to be a defective jet takes charge of recording. Such a correction process is known as a correction technique called "non-ejection correction" or "ejection disabling correction".

Example 2

Printing is stopped. When printing is performed using the ejector determined to be a defective jet in which the landing position shift amount exceeds the allowable range, it is expected that a streak is visually recognized in the printed image. Therefore, when the ejector determined to be a defective jet is generated, printing is stopped, and a process of recovering ejection performance of the ejector through maintenance measures other than cleaning is performed.

Example 3

A warning is presented to a user of the ink jet recording apparatus 10. For example, a warning announcing the possibility of streaks being generated is displayed on the screen of the display unit 18 of the control device 14 described in FIG. 1. In addition, the control device 14 receives an input of an instruction for printing stop or an instruction for printing continuation from a user, in addition to the presentation of such a warning. A user can determine to stop printing, or to continue printing, and input an instruction from the operating unit 16. When a user inputs the instruction for printing stop, the control device 14 stops printing. In addition, when the instruction for printing stop is not input from the operating unit 16, or when the instruction for printing continuation is input from the operating unit 16, the control device 14 continues printing.

Example 4

A stamp process of affixing a color which is a mark to the edge of a sheet having the high possibility of streaks being generated in printed matter is performed.

In the present embodiment, a combination of the correction process of [Example 1] and the stamp process of [Example 4] is assumed to be used. In the stamp process in this case, a stamp is pressed on a sheet on which the defective jet determination is performed, and a sheet printed until correction is performed after that and streaks disappear. In this manner, a user can be clearly shown a printed sheet having the high possibility of streaks being generated. A user can confirm the sheet having the stamp pressed thereon after the termination of a print job, and perform a process such as sorting of printed matter on which streaks are generated.

That is, when the determination result in step S33 of FIG. 3 is Yes, the flow proceeds to step S34, and the correction process is performed. In addition, in step S35, a "stamp flag ON process" of setting a stamp flag for controlling the implementation of the stamp process to be in an ON-state is performed.

Next, in step S36, it is determined whether the determination for all the ejectors of the K recording head 20K is completed. When the determination for all the ejectors is not completed, the ejector number is increased (step S38), and the process returns to step S33.

When the determination result in step S33 is No, the processes of steps S34 and S35 are skipped, and the flow proceeds to step S36.

Figure 4:
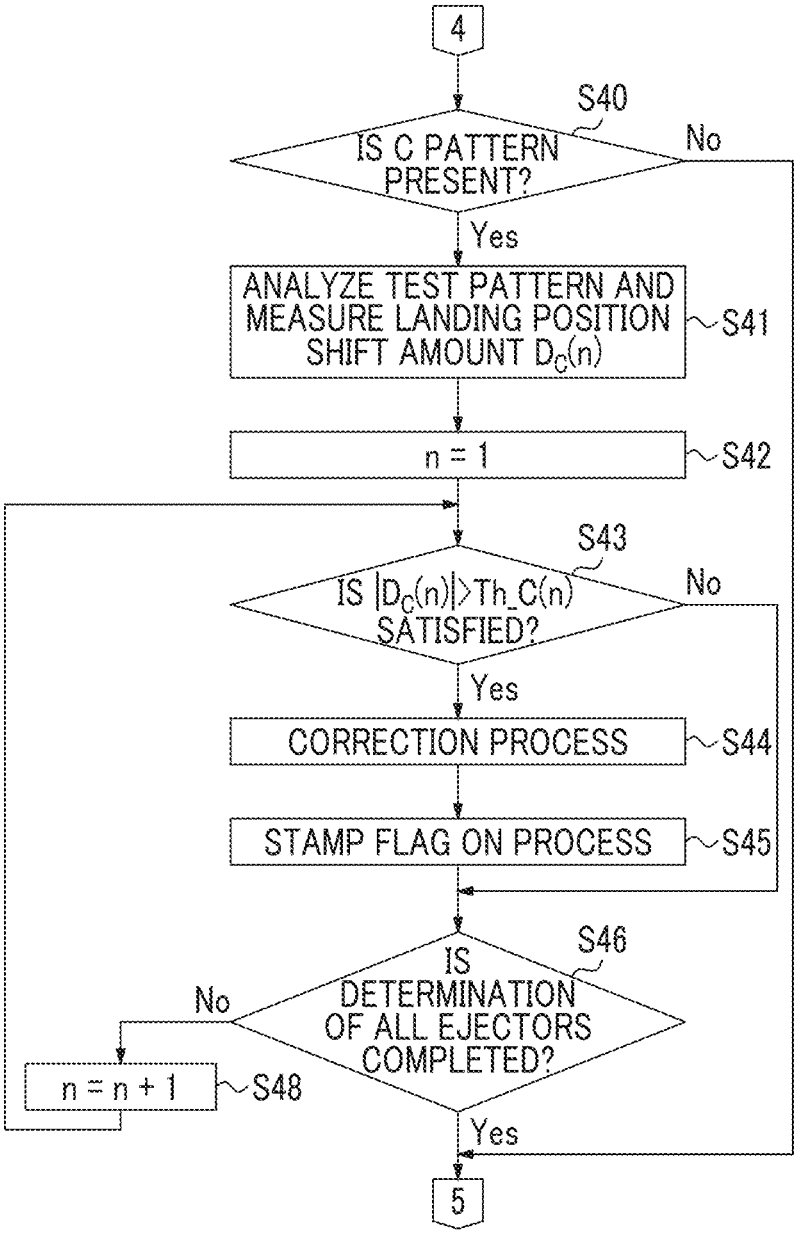
FIG. 4 is a flow diagram illustrating an example of a procedure of the printing job in the ink jet recording apparatus.

When the determination for all the ejectors of the K recording head 20K is completed, the determination result in step S36 is Yes, and the flow proceeds to step S40 of FIG. 4. In addition, when the determination result in step S30 of FIG. 3 is No, the flow proceeds to step S40 of FIG. 4.

Steps S40 to S48 of FIG. 4 are processes relating to the analysis of the pattern of cyan (C) and the ejector determination. The contents of the respective processes of steps S40 to S48 correspond to the contents of the respective processes of steps S30 to S38 described in FIG. 3, and are changed to the contents targeting cyan (C) in FIG. 4 instead of the contents targeting black (K) described in FIG. 3. Since the process contents of FIG. 4 can be ascertained by replacing "K" of the process contents of FIG. 3 with "C", the description of steps S40 to S48 of FIG. 4 will not be given. In FIG. 4, the landing position shift amount of the ejector of cyan (C) is indicated as $D_c(n)$, and the defective jet threshold thereof is indicated as Th_C. When the determination result in step S40 is No, or when the determination result in step S46 is Yes, the flow proceeds to step S50 of FIG. 5.

Figure 5:
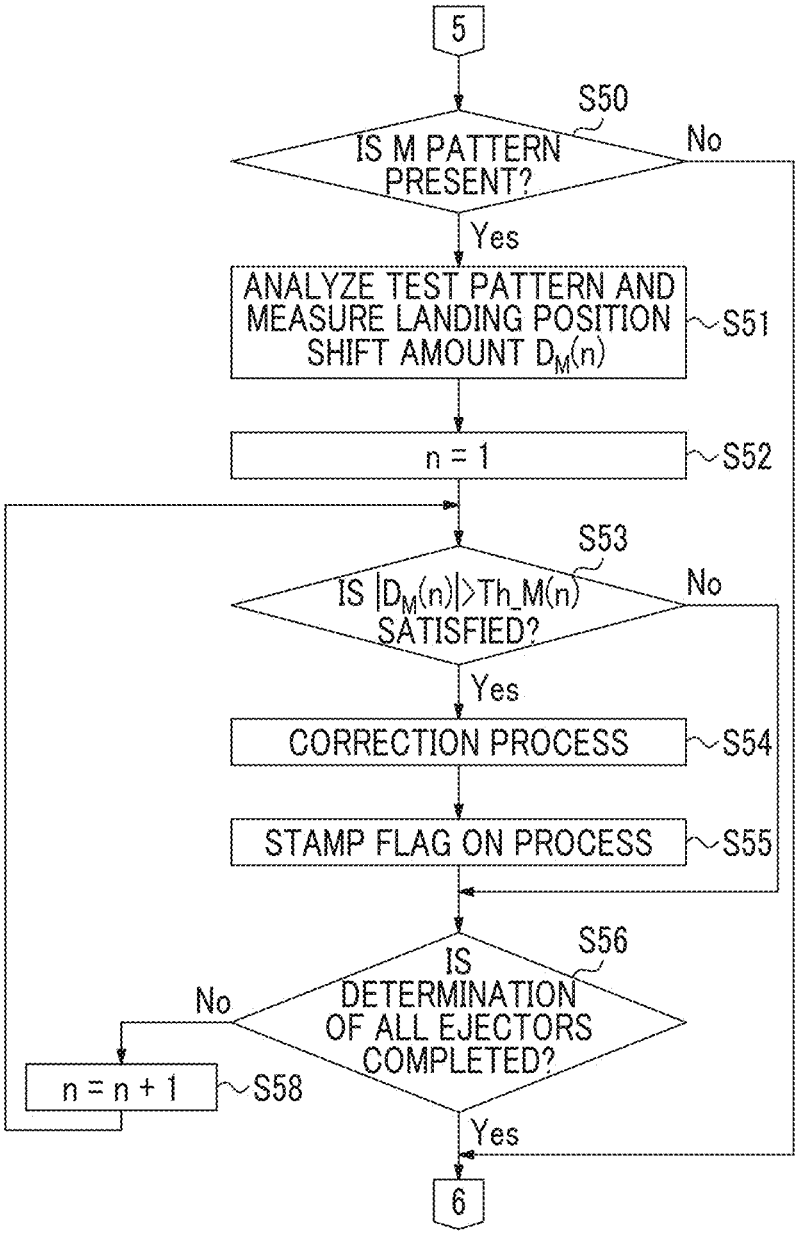
FIG. 5 is a flow diagram illustrating an example of a procedure of the printing job in the ink jet recording apparatus.

Steps S50 to S58 of FIG. 5 are processes relating to the analysis of the pattern of magenta (M) and the ejector determination. The contents of the respective processes of steps S50 to S58 correspond to the contents of the respective processes of steps S30 to S38 described in FIG. 3, and are changed to the contents targeting magenta (M) in FIG. 5 instead of the contents targeting black (K) described in FIG. 3. Since the process contents of FIG. 5 can be ascertained by replacing "K" in the process contents of FIG. 3 with "M", the description of steps S50 to S58 of FIG. 5 will not be given. In FIG. 5, the landing position shift amount of the ejector of magenta (M) is indicated as $D_M(n)$, and the defective jet threshold thereof is indicated as Th_M(n). When the determination result in step S50 is No, or when the determination result in step S56 is Yes, the flow proceeds to step S60 of FIG. 6.

Figure 6:
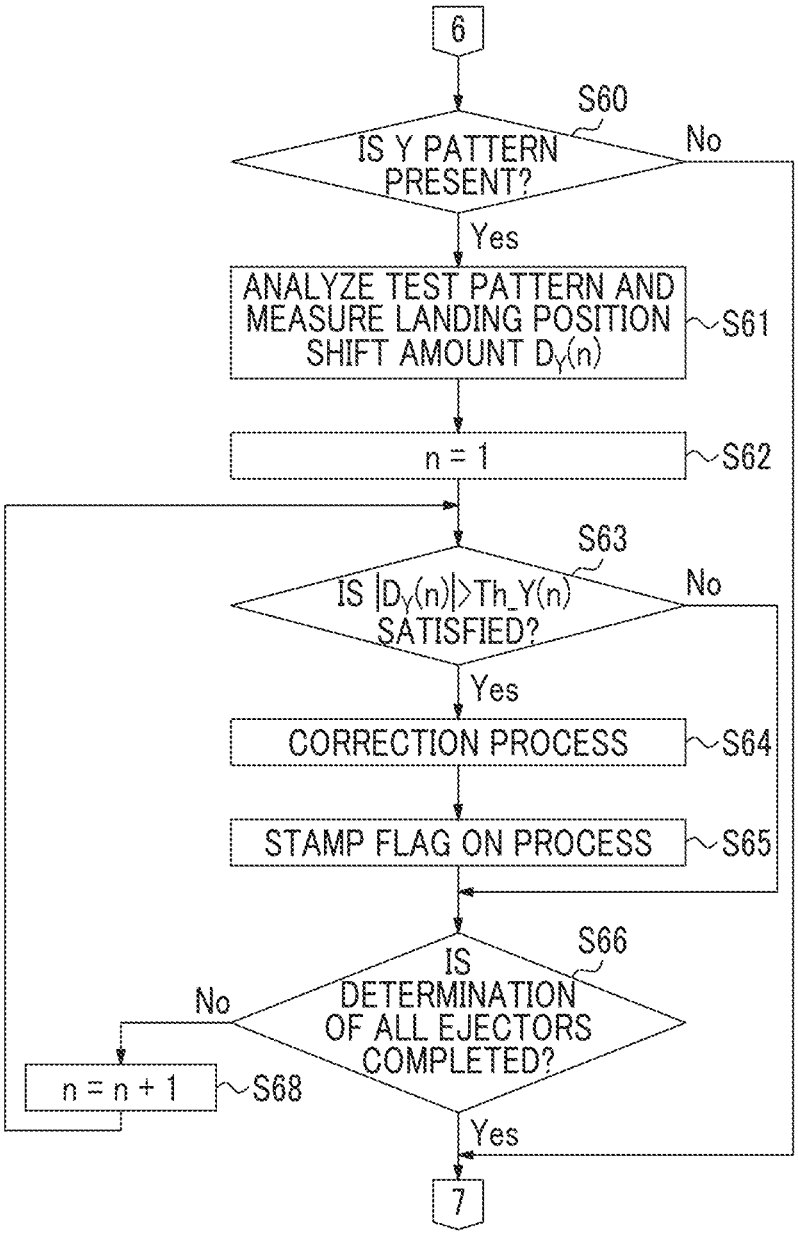
FIG. 6 is a flow diagram illustrating an example of a procedure of the printing job in the ink jet recording apparatus.

Steps S60 to S68 of FIG. 6 are processes relating to the analysis of a Y pattern and the ejector determination. The contents of the respective processes of steps S60 to S68 correspond to the contents of the respective processes of steps S30 to S38 described in FIG. 3, and are changed to the contents targeting yellow (Y) in FIG. 6 instead of the contents targeting black (K) described in FIG. 3. Since the process contents of FIG. 6 can be ascertained by replacing "K" in the process contents of FIG. 3 with "Y", the description of steps S60 to S68 of FIG. 6 will not be given. In FIG. 5, the landing position shift amount of the ejector of yellow (Y) is indicated as $D_Y(n)$, and the defective jet threshold thereof is indicated as Th_Y(n). When the determination result in step S60 is No, or when the determination result in step S66 is Yes, the flow proceeds to step S70 of FIG. 7.

Figure 7:
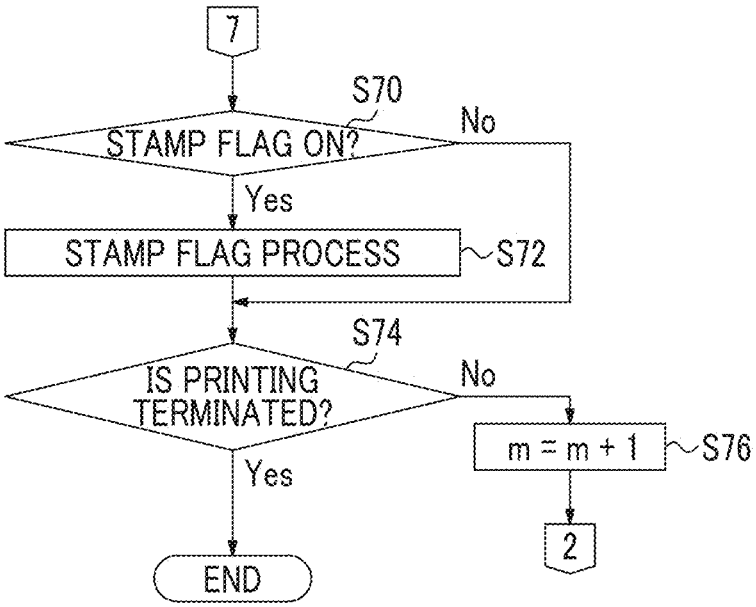
FIG. 7 is a flow diagram illustrating an example of a procedure of the printing job in the ink jet recording apparatus.

In step S70 of FIG. 7, the determination of whether the stamp flag is set to an ON-state is performed. When the stamp flag is set to an ON-state in any of step S35 of FIG. 3, step S45 of FIG. 4, step S55 of FIG. 5, and step S65 of FIG. 6, the determination result in step S70 of FIG. 7 is Yes, and the stamp process of affixing a color as a mark serving as a sign to the edge of a sheet is executed by the stamp processing unit 26 (step S72).

When the stamp flag is set to an OFF-state in step S70, the process of step S72 is skipped, and the flow proceeds to step S74. In step S74, the determination of whether printing is terminated is performed. When printing of the number of sheets printed which is specified in the print job is not completed, the determination result in step S74 is No. When the determination result in step S74 is No, the counter of the number of sheets printed is increased (step S76), and the flow returns to step S22 of FIG. 2.

When the processes of a flow of steps S22 to S76 are completed with respect to the entire number of sheets printed which is specified in the print job, the determination result in step S74 of FIG. 7 is Yes, and the print job is completed.

Meanwhile, the flow diagrams illustrated in FIGS. 2 to 7 can also correspond to a form in which a multi-color test pattern is recorded on one sheet.

[With Respect to Method of Creating Correspondence Relation Data]

A method of creating the data of a correspondence relation between the average ejection amount and the defective jet threshold described in Table 1 will be described. It is preferable that the correspondence relation data described in Table 1 is created in the printing job before in advance. An example of the creation method will be described.

The presence or absence of streaks in a printing sample and the allowable range of the streaks are determined by various parameters. An example of the parameters will be given.

<1> The streak allowable level of a user who is a requester of printing. Among users who attach importance to image quality with respect to the finish of printed matter, particularly, strict users who demand high image quality are present, whereas users who do not demand so much high image quality are also present. Therefore, it is preferable to set the streak allowable level to conform to the image quality demanded by users.

<2> The type of ink. Ink varies in physical properties according to its type, and tendencies for ink to bleed, densities of ink, and the like are different from each other. Generally, when the spreading rate of ink on a sheet is high, streaks are not likely to be visually recognized.

<3> The color of ink. For example, when comparison is performed in four colors of CMYK, the streaks of Y ink are not likely to be visually recognized, and thus the defective jet threshold for the Y ink can be set to a value larger than the defective jet threshold of the K ink. The setting of the threshold to a larger value is equivalent to relaxation of a criterion of the defective jet determination.

<4> The type of sheet. There are a sheet having a tendency to bleed, a sheet which is not likely to bleed, and the like depending on the type of sheet. A tendency for ink to spread changes depending on the type of sheet. Generally, a tendency for ink to spread on a sheet causes streaks not to be likely to be visually recognized.

<5> The type of image processing sequences. An image processing sequence including the half-tone process is applied to manuscript image data for printing and the image data is converted into data of droplets which are ejected by each ejector. An image processing sequence having robustness with respect to streaks can also be used.

<6> A process liquid application state. A process liquid reacting with ink may be used during ink jet recording. A tendency for ink to spread changes depending on whether a process liquid is applied to a sheet beforehand before providing ink, the physical properties of the process liquid, or a process liquid application state. That is, the visibility of the streak is also dependent on the presence or absence of process liquid application, or the density, type, application amount of the process liquid.

As illustrated in <1> to <6>, the visibility of streaks is determined from various parameters, and the defective jet threshold is not able to be determined simply. Here, from a viewpoint illustrated in <1>, an example in which a user sets the streak allowable level will be described.

[Specific Example of Method of Creating Correspondence Relation Data]

First, in order to ascertain a print quality required by a user, information such as a sheet to be used, ink, and an image processing method is provided from the user. The "image processing method" as used herein includes a method of the half-tone process.

Under conditions provided by a user, a printing sample for evaluating the visibility of streaks is created. This printing sample is a sample into which an "ejection direction bending portion" obtained by simulating the landing position shift amount due to ejection direction bending is intentionally put, and refers to a "defective jet threshold determining sample".

Figure 12:
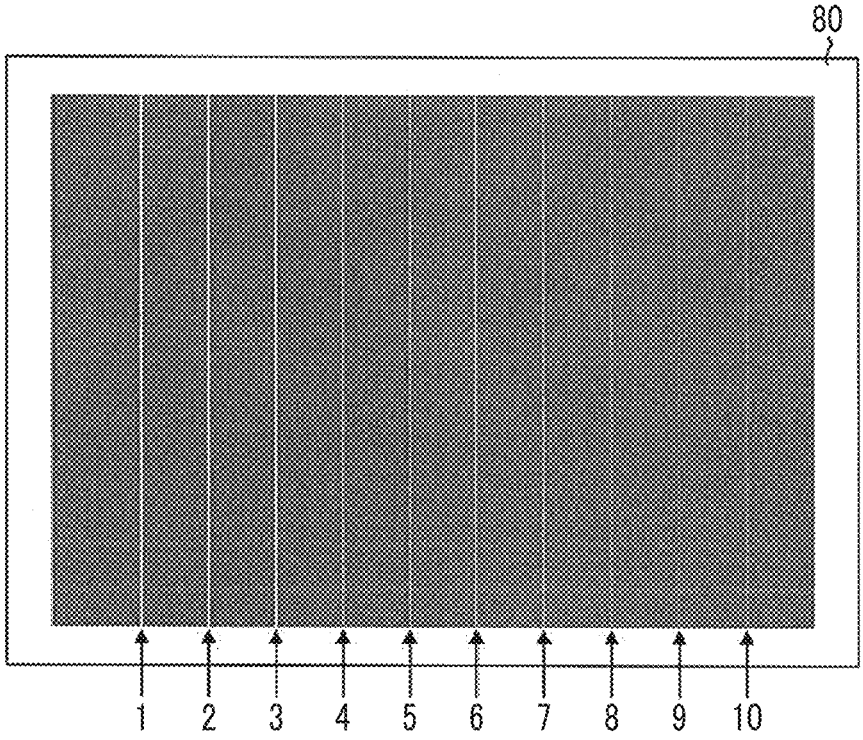
FIG. 12 is an example illustrating a defective jet threshold determining sample.
Figure 13:
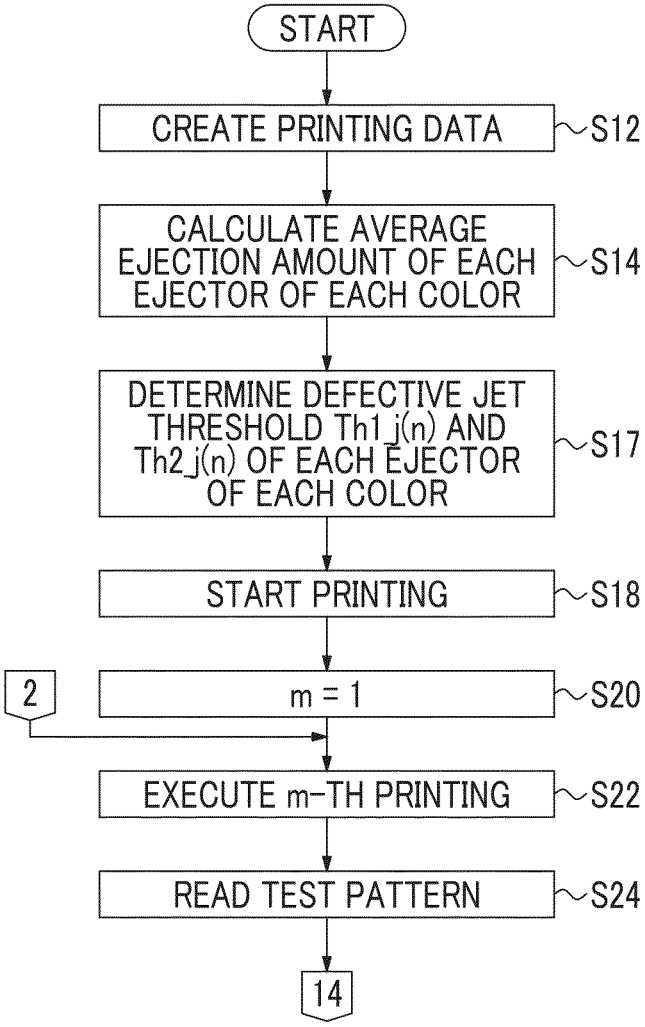
FIG. 13 is a flow diagram illustrating an example of a procedure of a printing job in a second embodiment.

FIG. 12 is an example of a defective jet threshold determining sample. In FIG. 12, an image having an average ejection amount of 2.5 picoliter [pL] is printed on the entire surface of the recording region of a sheet 80, and the "ejection direction bending portion" obtained by simulating streaks which are generated by an ejector having a landing position shift is intentionally included therein. The sheet 80 is a sheet which is specified under conditions provided by a user. In FIG. 12, a longitudinal streak appearing at each position indicated by a number from "1" to "10" is an ejection direction bending portion which is intentionally put in. The "defective jet threshold determining sample" as illustrated in FIG. 12 can be created by accurately adjusting a relative position between a sheet and an ink jet head using a precise driving stage (not shown). When the defective jet threshold determining sample is created, the same apparatus as the ink jet recording apparatus 10 described in FIG. 1 is not required to be used, and the defective jet threshold determining sample can be created using a separate ink jet recording apparatus from the ink jet recording apparatus 10, for example, an experimental apparatus.

In FIG. 12, landing position shift amounts different from each other are given to positions of the respective numbers, from a first position to a tenth position. In the landing position shift amounts, among the respective first to tenth positions in the driving stage, the landing position shift amount given to the first position is largest, and the landing position shift amount given to the tenth position is smallest. For example, the landing position shift amount of the first position is 30 micrometers [μm], and the landing position shift amount of the tenth position is 3 micrometers [μm]. The landing position shift amounts from the first position to the tenth position are reduced in a stepwise manner. Meanwhile, the cut amounts of ten stages of landing position shift amounts are not necessarily constant.

The level of an allowable streak by which such a printing sample is evaluated by a user, that is, the allowable landing position shift amount is determined. For example, when a user is not able to allow a fourth (landing position shift amount is 12 μm) streak but is able to allow a fifth (landing position shift amount is 10 μm) streak, as shown in Table 1, the defective jet threshold is set to 12 micrometers [μm] between the average ejection amount equal to or greater than 2.0 picoliters [pL] and less than 3.0 picoliters [pL].

In such a method, the conditions of the average ejection amount is changed, a defective jet threshold determining sample having a plurality of average ejection amounts in different conditions is created, and the defective jet threshold for a streak allowed by a user is determined for each section of the average ejection amount.

In addition, as shown in FIG. 12, without being limited to a method of actually outputting a printing sample and evaluating the printing results, image quality equivalent to the printing results of the printing sample may be evaluated by simulation. The correspondence relation data as shown in Table 1 can also be created from image quality simulation of an image to which the landing position shift is intentionally given.

Modification Example 1

The defective jet threshold for specifying the allowable limit of the landing position shift amount may be different in absolute value depending on the sign of the landing position shift. For example, the landing position shift amount when an actual landing position shifts in a "plus direction" of an x-axis along the main scanning direction with respect to an ideal landing position can be represented by a plus value (positive value), and the landing position shift amount when the actual landing position shifts in a "negative direction" of the x-axis with respect to the ideal landing position can be represented by a minus value (negative value). A way to determine the plus direction and the negative direction of the X-axis along the main scanning direction is arbitrary, but, for example, a direction in which the nozzle number increases can be set to the "plus direction".

The absolute value of the defective jet threshold for the landing position shift amount represented by the minus value can be defined as ThL(n), and the absolute value of the defective jet threshold for the landing position shift amount represented by the plus value can be defined as ThR(n). In this case, ThL(n) and ThR(n) can be set to different values. When a high printing duty is formed from the influence of landing interference, depending on a nozzle array form, a difference may occur in ThL(n) and ThR(n).

Table 2 is an example of correspondence relation data of the average ejection amount and the defective jet thresholds ThL(n) and ThR(n). In Table 2, the average ejection amount is indicated by "Vav", and the defective jet thresholds are indicated by "ThL" and "ThR" without specifying the color of ink.

TABLE 2

| Average Ejection Amount (pL) | Defective Jet Threshold ThL | Defective Jet Threshold Th |
|---|---|---|
| 0.00 pL ≤ Vav < 0.01 pL | None | None |
| 0.01 pL ≤ Vav < 0.5 pL | 24 μm | 26 μm |
| 0.5 pL ≤ Vav < 1.0 pL | 17 μm | 19 μm |
| 1.0 pL ≤ Vav < 2.0 pL | 13 μm | 15 μm |
| 2.0 pL ≤ Vav < 3.0 pL | 11 μm | 13 μm |
| 3.0 pL ≤ Vav < 4.0 pL | 10 μm | 12 μm |
| 4.0 pL ≤ Vav | 9 μm | 11 μm |

A correspondence relation table as shown in Table 2 can also be used instead of the correspondence relation data described in Table 1.

Modification Example 2

In the first embodiment, a case where the same user image is printed for each sheet has been described, but the present invention can be applied even when images which are printed for each sheet are different from each other. That is, the defective jet threshold Th_j(n) is determined by calculating an average ejection amount Vav_j(n) for each printed image, and it may be determined whether the absolute value of a landing position shift amount $D_j(n)$ which is measured from the read image of the test pattern exceeds the defective jet threshold Th_j(n). The suffix "j" represents the distinction of {C, M, Y, K}.

When an image having a relatively high density as a whole is printed as the printed image, the visibility of the streak is high. Therefore, it is preferable to make the sensitivity of abnormality detection relatively high, and the value of the defective jet threshold is set to a relatively small value.

On the contrary, when an image having a relatively low density as a whole is printed as the printed image, the visibility of the streak is low. Therefore, it is preferable to make the sensitivity of abnormality detection relatively low, and the value of the defective jet threshold is set to a relatively large value.

Modification Example 3

In FIGS. 3 to 6, processes are performed in order of K, C, M, and Y, but the order of processes of each color is not limited to this example, and the replacement of the order can be made.

Second Embodiment

Next, a second embodiment will be described. FIGS. 13 to 17 are flow diagrams illustrating an example of a procedure of a printing job in the second embodiment. The flow diagram of FIG. 17 further goes to the flow diagram of FIG. 7 described in the first embodiment. That is, the procedure of the printing job in the second embodiment is shown by FIGS. 13 to 17 and FIG. 7. The flow diagrams of FIGS. 13 to 17 can be applied instead of FIGS. 2 to 6 described in the first embodiment. In FIGS. 13 to 17, the same steps as those of the flow diagrams described in FIGS. 2 to 6 are denoted by the same step signs, and the description thereof will not be given. Processes and operations of respective steps shown in FIGS. 13 to 17 and FIG. 7 are executed as the processes in the control device 14 described in FIG. 1 and the operations of the printing apparatus 12.

Hereinafter, regarding the second embodiment, differences from the first embodiment will be described. In the first embodiment, only one type of defective jet threshold is set for each ejector with respect to each color. On the other hand, in the second embodiment, two types of defective jet threshold are set for each ejector. In step S17 subsequent to step S14 of FIG. 13, two types of threshold of Th1_$j(n)$ and Th2_$j(n)$ are set as the defective jet threshold of each ejector of each color. The suffix "j" represents the distinction of {C, M, Y, K}. Here, "n" represents an ejector number. Th1_$j(n)$ and Th2_$j(n)$ are equivalent to one form of "a plurality of types of threshold".

Figure 18:
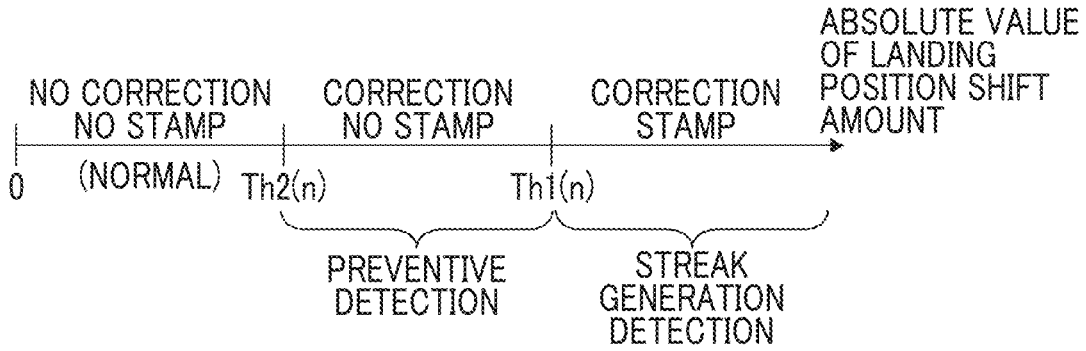
FIG. 18 is a diagram illustrating a difference between two types of defective jet threshold which are determined in the second embodiment.

FIG. 18 is a diagram illustrating a difference between two types of defective jet threshold which are set in the second embodiment. The horizontal axis of FIG. 18 represents the absolute value of the landing position shift amount. In FIG. 18, the color of ink is not specified, and the two types of defective jet threshold are indicated as Th1($n$) and Th2($n$). The first threshold Th1($n$) of the two types of defective jet threshold is used in the same meaning as the defective jet threshold Th(n) described in the first embodiment. That is, the first threshold Th1($n$) means the landing position shift amount having the high possibility of streaks being generated in the printed image. The second threshold Th2($n$) is set to a value smaller than the first threshold Th1($n$). In case of the absolute value of the landing position shift amount is larger than the second threshold Th2($n$), and is smaller than the first threshold Th1($n$), a pixel in which, that is, the relation of Th2($n$)<|landing position shift amount|<Th1($n$) is satisfied has the low possibility of streaks visually recognized being present, but is determined to be a pixel for which there is a concern of the possibility of streaks being generated when printing is continued. The second threshold Th2($n$) is a preventive threshold for detecting a pixel having the possibility of streaks being generated when printing is continued. Meanwhile, the representation of |landing position shift amount| shows the absolute value of the landing position shift amount.

The landing position shift amount represented by the first threshold Th1($n$) is relatively higher in the degree of ejection abnormality than the landing position shift amount represented by the second threshold Th2($n$). The landing position shift amount represented by the second threshold Th2($n$) is relatively lower in the degree of ejection abnormality than the landing position shift amount represented by the first threshold Th1($n$).

In any case of the first threshold Th1($n$) and the second threshold Th2($n$), in case of a defective jet exceeding the threshold is detected, countermeasures of [Example 1] to [Example 4] described in the first embodiment are possible. However, in the second embodiment, a description will be given of a method of further improving a user's work efficiency by performing different measures in case of Th1($n$)<|landing position shift amount| and a case of Th2($n$)<|landing position shift amount|≤Th1($n$).

In the first embodiment, a description has been given of the flow diagrams regarding the contents in which, in case of defective jet determination is made, the correction process is applied, and a stamp is pressed on the printed matter until correction functions (FIGS. 2 to 7).

On the other hand, in the second embodiment, in case of the relation of Th1($n$)<|landing position shift amount| is satisfied as shown in FIG. 18, similarly to the first embodiment, the correction process is performed, and a stamp is pressed on a printing sheet having the possibility of streaks being generated.

In addition, in a pixel in which the relation of Th2($n$)<|landing position shift amount|≤Th1($n$) is satisfied, only the correction process is performed, and a stamp is not pressed. In this manner, as compared to the first embodiment, it is possible to save the time and effort for a user to confirm a sheet having a stamp pressed thereon after the termination of the print job. For example, in order to give priority to work efficiency, a sheet having a stamp pressed thereon after the printing termination may be disposed of depending on users as it is. Therefore, according to the second embodiment, there is an advantage of reducing the number of disposal sheets which are sheets to be disposed of Meanwhile, the disposal sheet may be called "yaregami" in the printing industry. In addition, according to the second embodiment, even when a defective jet is detected, printing is continued, and a case does not occur in which the printing process is stopped. Therefore, there is an advantage that productivity can be maintained by a user.

The presence or absence of a stamp described in the second embodiment is equivalent to one form of "the stamp process is made different". In addition, the presence or absence of a stamp is equivalent to one form of "a notification aspect is made different".

Meanwhile, in case of the relation of |landing position shift amount|≤Th2($n$) is satisfied, it is determined to be in a normal range, and it is assumed that the correction process is not implemented (no correction), and that the stamp process is also not implemented (no stamp).

Figure 14:
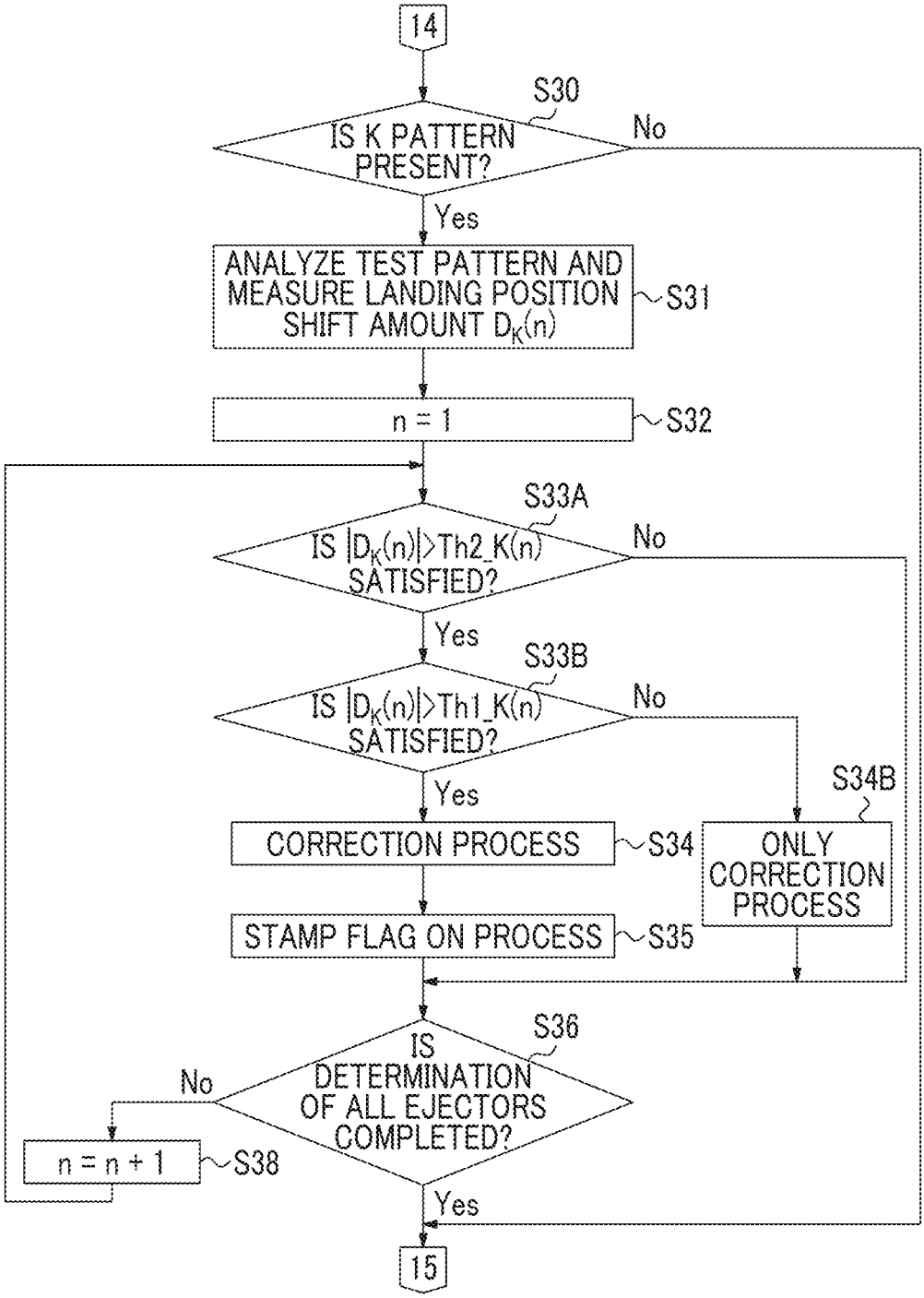
FIG. 14 is a flow diagram illustrating an example of a procedure of the printing job in the second embodiment.

When process contents are described through the flow diagram of FIG. 14, the flow proceeds to step S33A subsequently to step S32, and a defective jet threshold Th2_K(n) determined with respect to each ejector and the absolute value of the landing position shift amount $D_K$(n) of each ejector are compared with each other. In step S33A, the determination of whether the inequality of $|D_K(n)|$>Th2_K(n) is satisfied is performed. In case of the absolute value of the landing position shift amount $D_K$(n) exceeds Th2_K(n), the determination result in step S33A is Yes, and the flow proceeds to step S33B. In step S33B, a defective jet threshold Th1_K(n) and the absolute value of the landing position shift amount $D_K$(n) are compared with each other, and the determination of whether the inequality of $|D_K(n)|$>Th1_K(n) is satisfied is performed. In case of the absolute value of the landing position shift amount $D_K$(n) exceeds Th1_K(n), the ejection of the ejector is determined to be at an abnormal level at which streaks are generated. That is, the ejection of the ejector in which the inequality of $|D_K(n)|$>Th1_K(n) is satisfied is determined to be a "defective jet" in which the landing position shift amount exceeds an allowable range.

When the determination result in step S33B is Yes, the correction process is performed (step S34) and a process of setting a stamp flag to be in an ON-state is performed (step S35), and the flow proceeds to step S36.

On the other hand, in step S33B, in case of the inequality of $|D_K(n)|$>Th1_K(n) is not satisfied, that is, in case of the absolute value of the landing position shift amount $D_K$(n) is equal to or less than Th1_K(n) and is greater than Th2_K(n), the determination result in step S33B is No, and the flow proceeds to step S34B.

In step S34B, only the correction process is performed, and the flow proceeds to step S36 without executing a stamp flag ON process. The correction process of step S34B is the same process as the correction process of step S34.

In addition, in case of the determination result in step S33A is No, that is, in case of the absolute value of the landing position shift amount $D_K$(n) is equal to or less than Th2_K(n), the value is within a normal range, and thus the ejector is determined to be "no problem", that is, "normal", and the flow proceeds to step S36.

Figure 15:
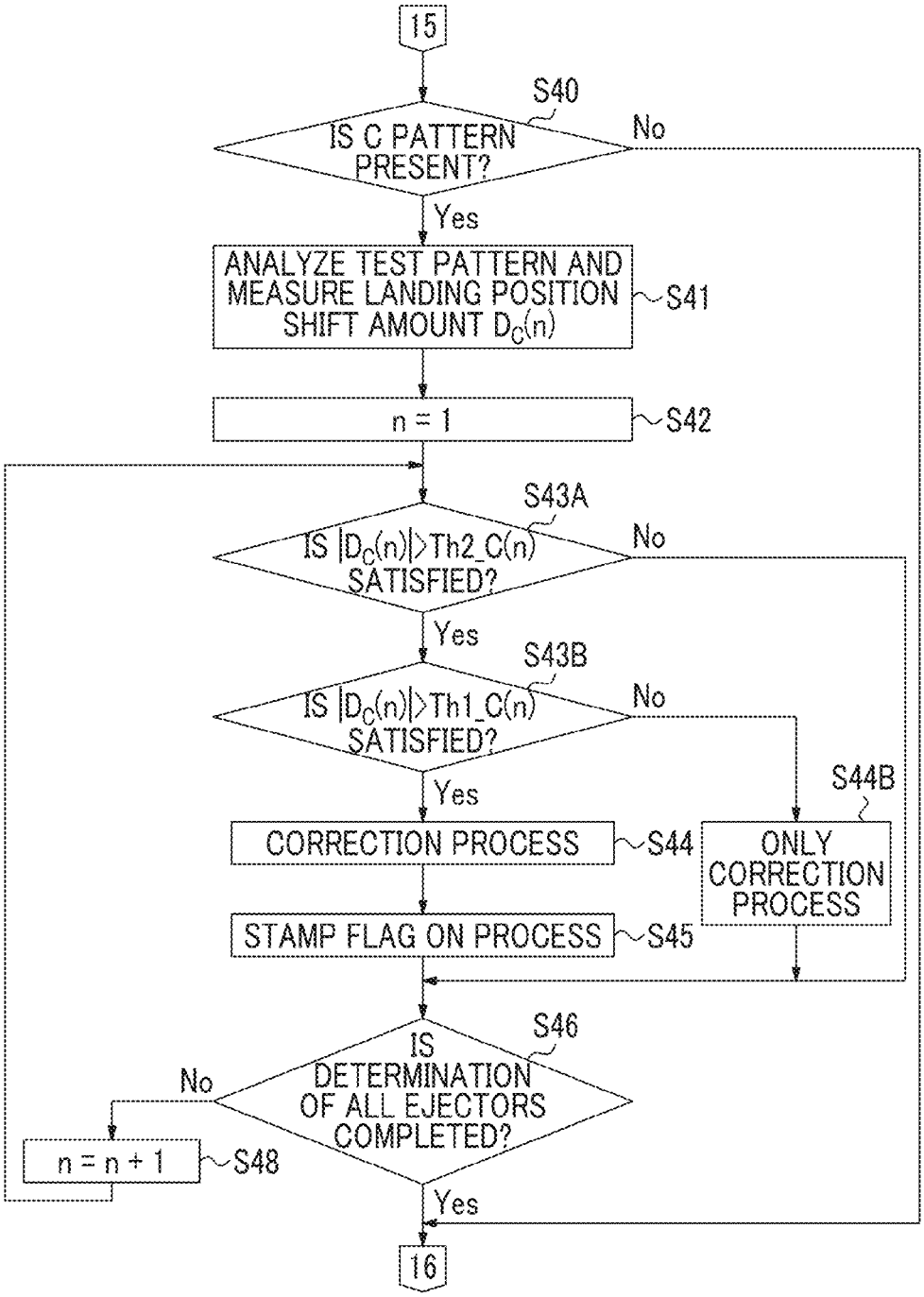
FIG. 15 is a flow diagram illustrating an example of a procedure of the printing job in the second embodiment.

When the determination for all the ejectors of the K recording head 20K is completed, the determination result in step S36 is Yes, and the flow proceeds to step S40 of FIG. 15. In addition, when the determination result in step S30 of FIG. 14 is No, the flow proceeds to step S40 of FIG. 15.

Steps S40 to S48 of FIG. 15 are processes relating to the analysis of the pattern of cyan (C) and the ejector determination. The contents of the respective processes of steps S40 to S48 correspond to the contents of the respective processes of steps S30 to S38 described in FIG. 14, and are changed to the contents targeting cyan (C) in FIG. 15, instead of the contents targeting black (K) described in FIG. 14. Since the process contents of FIG. 15 can be ascertained by replacing "K" in the process contents of FIG. 14 with "C", the description of steps S40 to S48 of FIG. 15 will not be given. In FIG. 15, a first threshold which is set for each ejector of cyan (C) is indicated as Th1_C(n), and a second threshold is indicated as Th2_C(n) When the determination result in step S40 is No, or when the determination result in step S46 is Yes, the flow proceeds to step S50 of FIG. 16.

Figure 16:
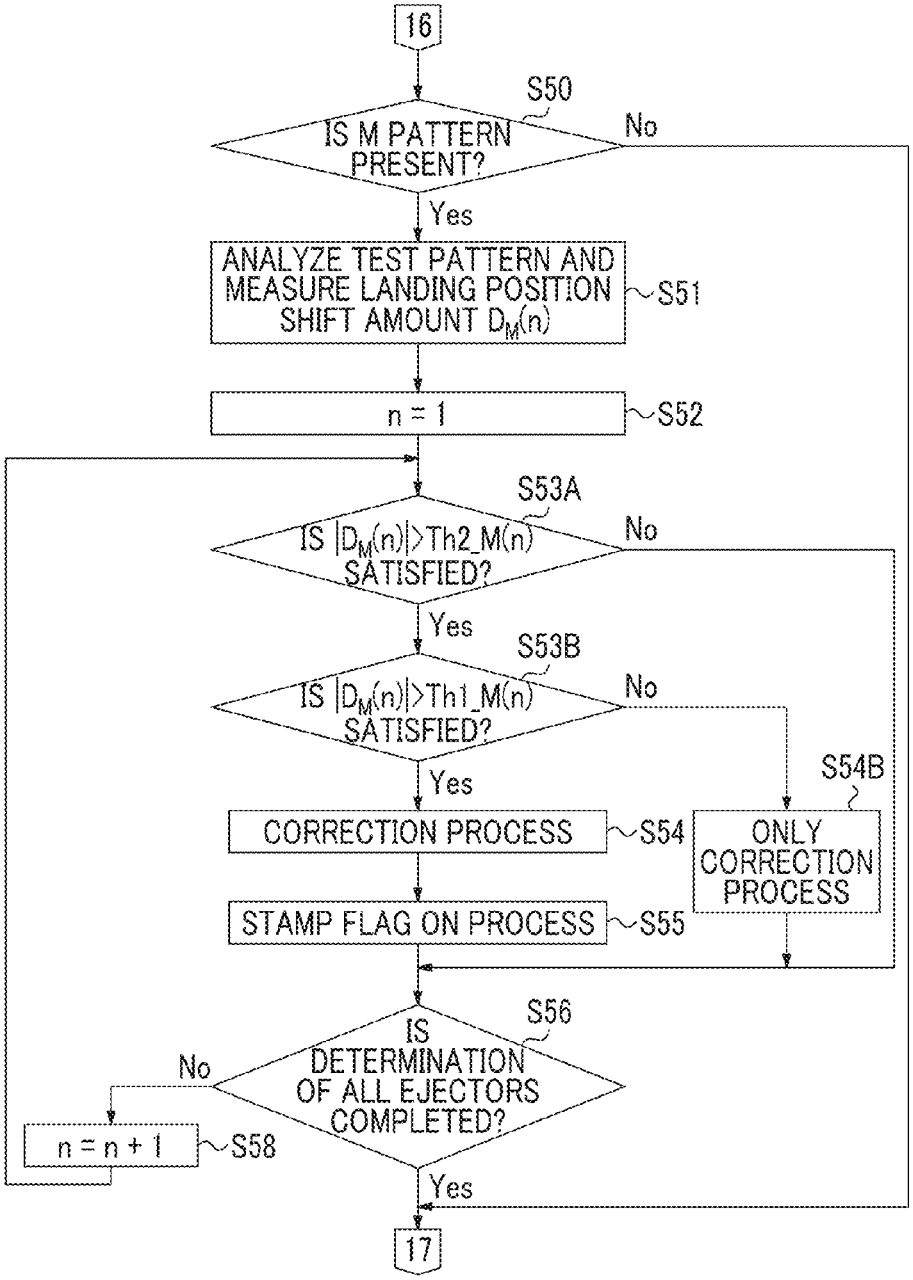
FIG. 16 is a flow diagram illustrating an example of a procedure of the printing job in the second embodiment.

Steps S50 to S58 of FIG. 16 are processes relating to the analysis of the pattern of magenta (M) and the ejector determination. The contents of the respective processes of steps S50 to S58 correspond to the contents of the respective processes of steps S30 to S38 described in FIG. 14, and are changed to the contents targeting magenta (M) in FIG. 16, instead of the contents targeting black (K) described in FIG. 14. Since the process contents of FIG. 16 can be ascertained by replacing "K" in the process contents of FIG. 14 with "M", the description of steps S50 to S58 of FIG. 16 will not be given. In FIG. 16, a first threshold which is set for each ejector of magenta (M) is indicated as Th1_M(n), and a second threshold is indicated as Th2_M(n). When the determination result in step S50 is No, or when the determination result in step S56 is Yes, the flow proceeds to step S60 of FIG. 17.

Figure 17:
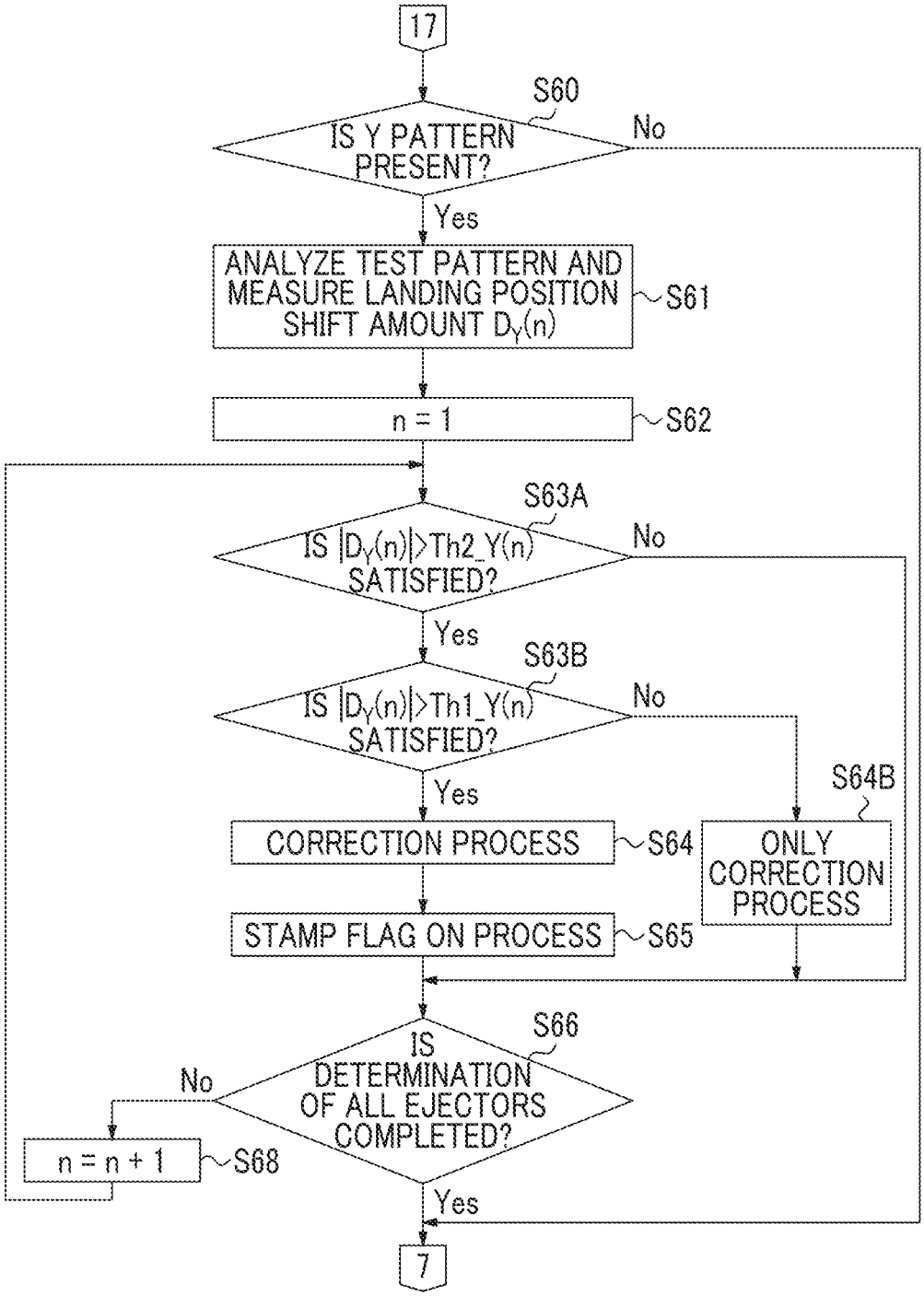
FIG. 17 is a flow diagram illustrating an example of a procedure of the printing job in the second embodiment.

Steps S60 to S68 of FIG. 17 are processes relating to the analysis of a Y pattern and the ejector determination. The contents of the respective processes of steps S60 to S68 correspond to the contents of the respective processes of steps S30 to S38 described in FIG. 14, and are changed to the contents targeting yellow (Y) in FIG. 17, instead of the contents targeting black (K) described in FIG. 14. Since the process contents of FIG. 17 can be ascertained by replacing "K" in the process contents of FIG. 14 with "Y", the description of steps S60 to S68 of FIG. 17 will not be given. In FIG. 17, a first threshold which is set for each ejector of yellow (Y) is indicated as Th1_Y(n), and a second threshold is indicated as Th2_Y(n). When the determination result in step S60 is No, or when the determination result in step S66 is Yes, the flow proceeds to step S70 of FIG. 7. The processes of steps S70 to S76 of FIG. 7 are as described in the first embodiment, and thus the description thereof will not be given.

[Relationship Between First Threshold and Second Threshold]

According to experimental knowledge of inventors, it is appropriate that, regarding Th2($n$) which is a preventive detection threshold, approximately 80% of the value of Th1($n$) which is a streak generation detection threshold is set to the value of Th2($n$). As a specific example, in case of Th1($n$)=15 micrometers [m], the relation of Th2($n$)=12 micrometers [m] is established. The wording "approximately 80% of the value of Th1($n$)" refers to, for example, a value of a range of 0.75×Th1($n$) to 0.85×Th1($n$) when a range of 80%±5% of the value of Th1($n$) is allowed.

In order to increase preventive detection, Th2($n$) can also be set to a smaller value, but there is the possibility of excessive detection being caused, and there is also an undeniable possibility of correction based on the correction process not appropriately functioning. Therefore, in order to avoid unnecessary detection, it is preferable not to make Th2($n$) excessively small.

Modification Example 4

In the second embodiment, as shown in FIG. 18, "no stamp" is set in case of Th2($n$)<|landing position shift amount|≤Th1($n$), but a design can also be made in which the type of stamp is changed in case of Th2($n$)<|landing position shift amount|≤Th1($n$). For example, it is also possible to make a form in which a red stamp is pressed in case of Th1($n$)<|landing position shift amount|, and a blue stamp is pressed in case of Th2($n$)<|landing position shift amount|≤Th1($n$).

A configuration described in Modification Example 4 in which the color of the stamp is made different is equivalent to one form of "the stamp process is made different". In addition, the configuration in which the color of the stamp is made different is equivalent to one form of "the notification aspect is made different".

Third Embodiment

A technical idea of the stamp process described in the second embodiment and Modification Example 4 being made different can be widely applied to means for giving notice of abnormality other than the stamp process. Hereinafter, a third embodiment will be described.

Figure 19:
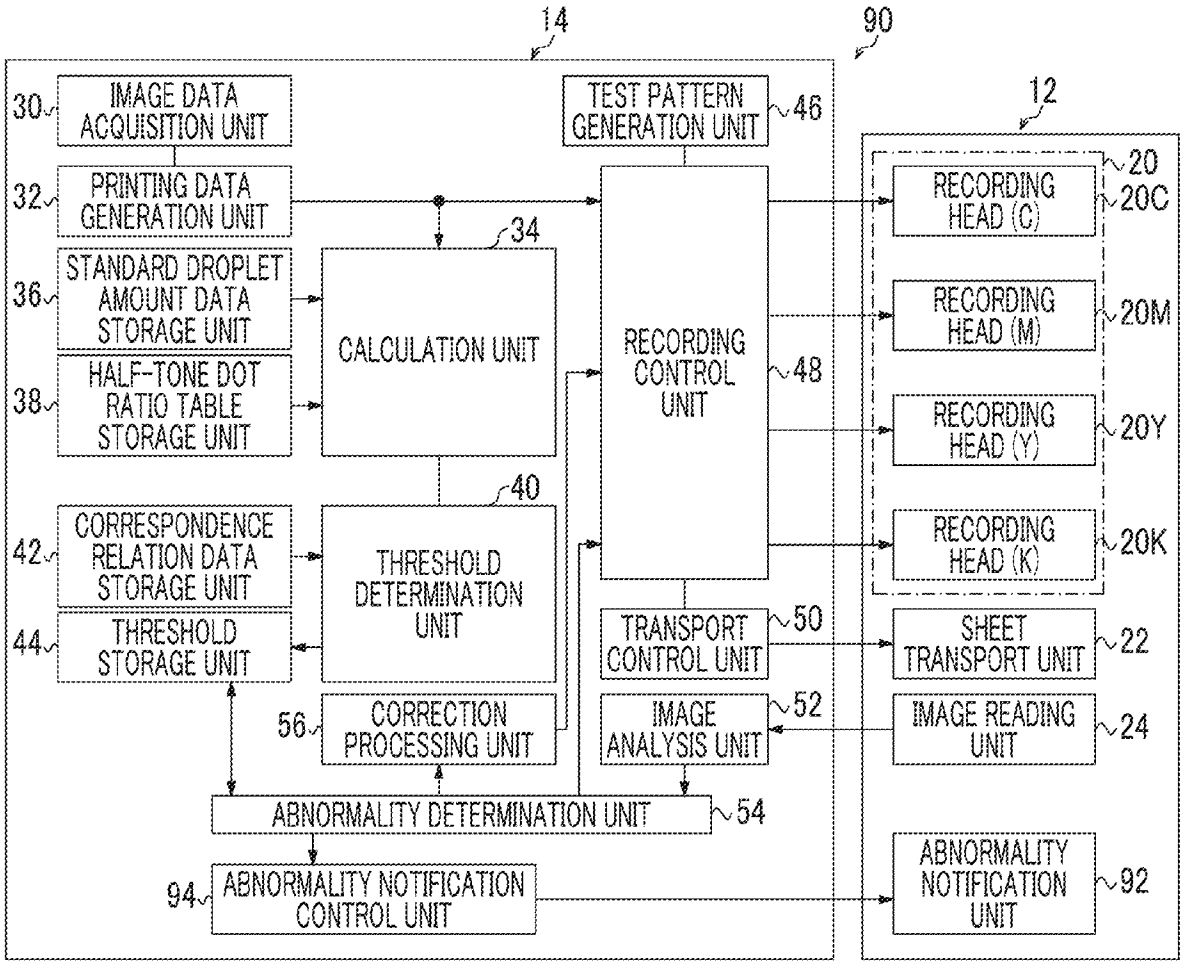
FIG. 19 is a block diagram illustrating a configuration of an ink jet recording apparatus according to a third embodiment.

FIG. 19 is a block diagram illustrating a configuration of an ink jet recording apparatus according to the third embodiment. In FIG. 19, components which are the same as or similar to the components described in FIG. 1 are denoted by the same reference numerals and signs, and thus the description thereof will not be given. Meanwhile, in FIG. 19, for the purpose of simplifying the illustration, the description of the maintenance control unit 60, the maintenance processing unit 28, the UI control unit 62, the operating unit 16, and the display unit 18 shown in FIG. 1 is not given, but these components are also included in the third embodiment.

An ink jet recording apparatus 90 of the third embodiment shown in FIG. 19 includes an abnormality notification unit 92 and an abnormality notification control unit 94. The abnormality notification unit 92 is abnormality notification means for notifying a user of abnormality in accordance with the determination result of the abnormality determination unit 54. The stamp processing unit 26 described in FIG. 1 is one specific form of the abnormality notification unit 92 shown in FIG. 19.

The abnormality notification control unit 94 controls an operation of the abnormality notification unit 92 on the basis of the determination result of the abnormality determination unit 54. The stamp control unit 58 described in FIG. 1 is one specific form of the abnormality notification control unit 94 shown in FIG. 19.

Meanwhile, in FIG. 19, a configuration is shown in which the abnormality notification unit 92 is included in the printing apparatus 12, but a form can also be used in which means equivalent to the abnormality notification unit is included in the control device 14 instead of such a configuration, or a combination thereof.

In the ink jet recording apparatus 90 shown in FIG. 19, similarly to the example described in FIG. 18, a process of making a notification aspect different in the abnormality notification unit 92 is performed in case of Th2($n$)<|landing position shift amount|≤Th1($n$), and a case of Th1($n$)<|landing position shift amount|.

Fourth Embodiment

Figure 20:
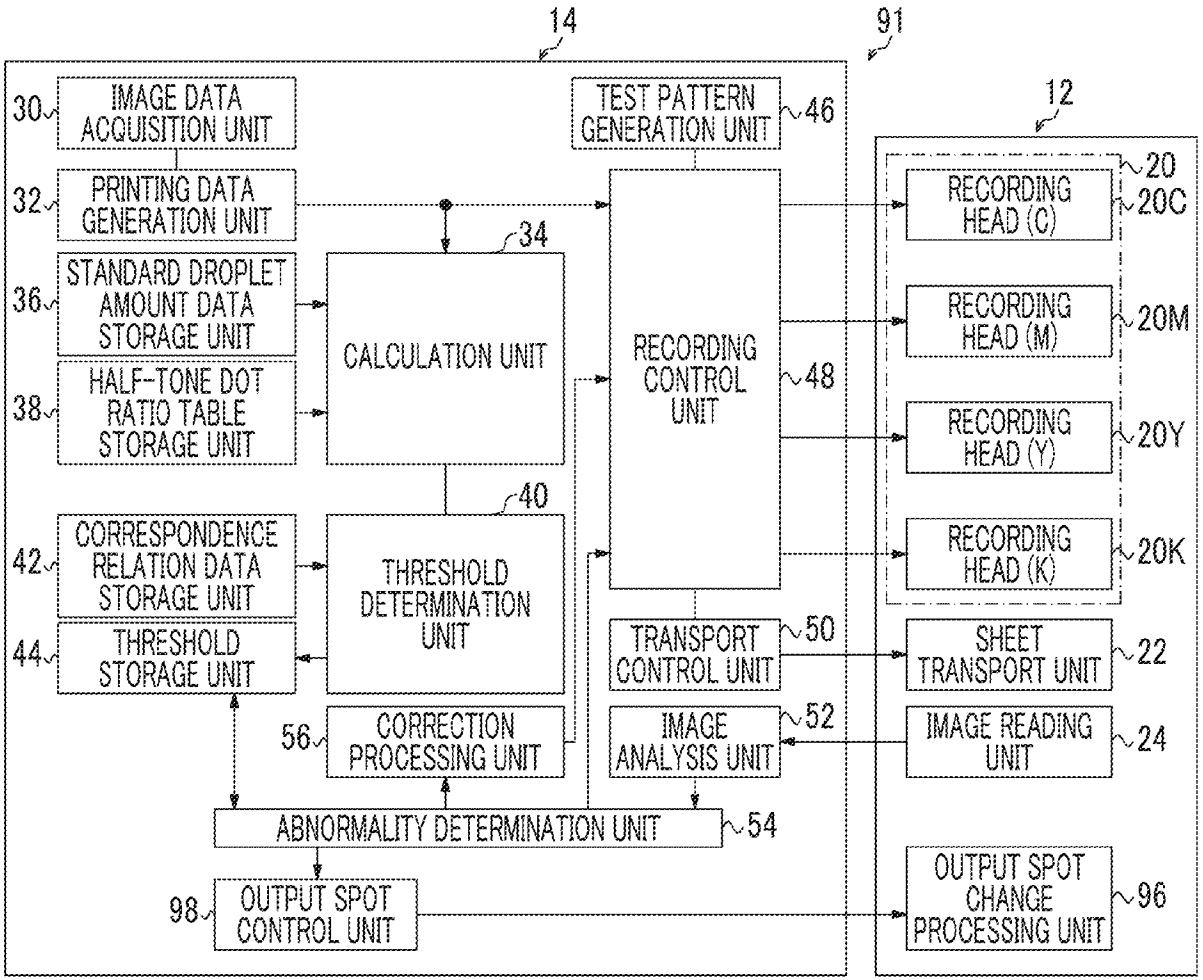
FIG. 20 is a block diagram illustrating a configuration of an ink jet recording apparatus according to a fourth embodiment.

FIG. 20 is a block diagram illustrating a configuration of an ink jet recording apparatus according to a fourth embodiment. In FIG. 20, components which are the same as or similar to the components described in FIGS. 1 and 19 are denoted by the same reference numerals and signs, and thus the description thereof will not be given. Meanwhile, in FIG. 20, for the purpose of simplifying the illustration, the description of the maintenance control unit 60, the maintenance processing unit 28, the UI control unit 62, the operating unit 16, and the display unit 18 shown in FIG. 1 is not given, but these components are also included in the fourth embodiment.

An ink jet recording apparatus 91 of the fourth embodiment shown in FIG. 20 has a function of being capable of changing an output location which is a discharge destination of a printing sheet. That is, the ink jet recording apparatus 91 includes an output location change processing unit 96 and an output location control unit 98.

The output location change processing unit 96 is means for classifying printed sheets and automatically changing the output locations. The output location change processing unit 96 may be incorporated into the printing apparatus 12, and may be configured as an auxiliary device of the printing apparatus 12. As the output location change processing unit 96, a sorter or a collator can be used.

For example, when a plurality of jobs are executed, the output location change processing unit 96 can discharge sheets to a separate output destination (that is, output location) for each job. In addition, the output location change processing unit 96 changes the output location of the sheet in accordance with the determination result of the abnormality determination unit 54.

The output location control unit 98 controls an operation of the output location change processing unit 96 on the basis of the determination result of the abnormality determination unit 54. The output location control unit 98 performs control of causing the output location of a sheet of an allowable image quality level and the output location of a sheet for which there is a concern of an unallowable defective image being generated to be different from each other.

In the ink jet recording apparatus 91 shown in FIG. 20, similarly to the example described in FIG. 18, a process of using different output locations of sheets in the output location change processing unit 96 is performed in case of $Th2(n)<|\text{landing position shift amount}|<Th1(n)$, and a case of $Th1(n)<\text{landing position shift amount}$).

For example, in case of a pixel in which the relation of $Th1(n)<|\text{landing position shift amount}|$ is satisfied, as is the case with the first embodiment, the correction process is performed, and a printing sheet having the possibility of streaks being generated is output to a defective sheet output destination. The term "defective sheet output destination" refers to a specific output location which is determined as the discharge destination of a defective sheet.

In addition, in case of a pixel in which the relation of $Th2(n)<|\text{landing position shift amount}|\leq Th1(n)$ is satisfied, a case does not occur in which an output to the defective sheet output destination is performed just by performing the correction process. That is, in case of a pixel in which the relation of $Th2(n)<|\text{landing position shift amount}|\leq Th1(n)$ is satisfied is present, the correction process is implemented, but the output location of a sheet after printing is treated equally with that of a normal printed matter, and the printed matter is output to the output destination of a normal sheet.

In this manner, compared with the first embodiment, it is possible to reduce the number of sheets of the defective sheet output destination to be disposed of by a user after the termination of a print job.

A user can ascertain the presence or absence of the generation of abnormality by confirming a location to which a sheet is output. That is, the output destination of a sheet is to be an opportunity for a user to perceive abnormality. The output location change processing unit 96 is one of the specific forms of the abnormality notification unit 92 described in FIG. 19. In addition, the output location control unit 98 (see FIG. 20) is one of the specific forms of the abnormality notification control unit 94 described in FIG. 19. A configuration in which different output locations of sheets are used is equivalent to one form of "the notification aspect is made different".

Fifth Embodiment

Figure 21:
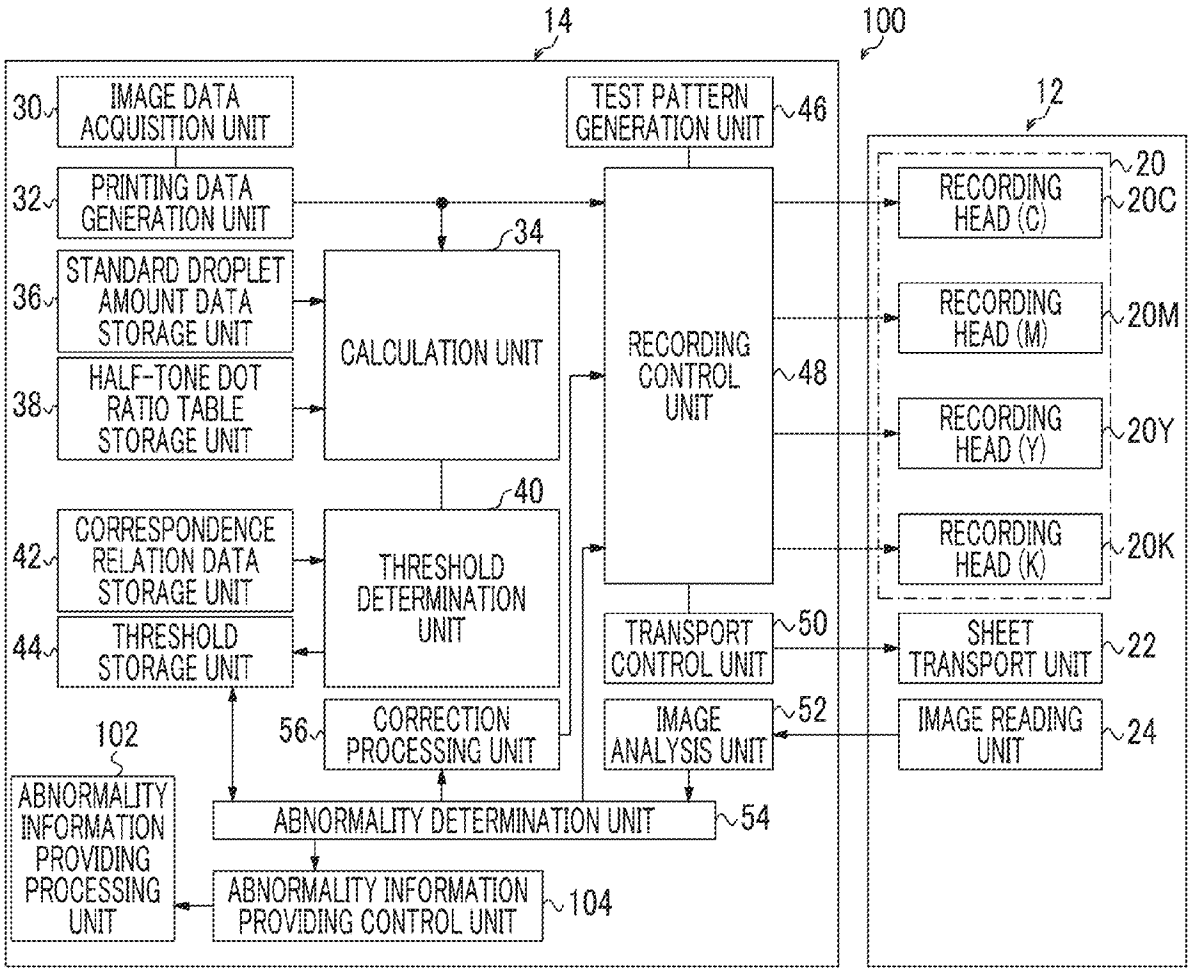
FIG. 21 is a block diagram illustrating a configuration of an ink jet recording apparatus according to a fifth embodiment.

FIG. 21 is a block diagram illustrating a configuration of an ink jet recording apparatus according to a fifth embodiment. In FIG. 21, components which are the same as or similar to the components described in FIGS. 1, 19 and 20 are denoted by the same reference numerals and signs, and thus the description thereof will not be given. Meanwhile, in FIG. 21, for the purpose of simplifying the illustration, the description of the maintenance control unit 60, the maintenance processing unit 28, the UI control unit 62, the operating unit 16, and the display unit 18 shown in FIG. 1 is not given, but these components are also included in the fifth embodiment.

An ink jet recording apparatus 100 of the fifth embodiment shown in FIG. 21 has a function of providing information of abnormality to a user when abnormality is generated in a printing sheet. The ink jet recording apparatus 100 includes an abnormality information providing processing unit 102 and an abnormality information providing control unit 104.

The abnormality information providing processing unit 102 is means for providing information for causing a user to perceive the generation of abnormality on the basis of the determination result of the abnormality determination unit 54. The abnormality information providing processing unit 102 may provide information by the action on at least a type of sense among human five senses. For example, visual means acting on the sense of sight includes a configuration in which information is displayed on the screen of the display unit 18 (see FIG. 1), or a configuration in which a display lamp (not shown), an indicator and other display devices are used. Auditory means acting on the sense of hearing includes sound output means for emitting a sound such as a warning sound, music, or a voice message. Tactile means acting on the sense of touch includes vibration generating means for generating a vibration, means for changing temperature, or the like. Olfactory means acting on the sense of smell or gustatory means acting on the sense of taste can also bed assumed. The abnormality information providing processing unit 102 may adopt a configuration in which a plurality of types of means acting on different senses are combined, and may adopt a configuration in which a plurality of types of means acting on the same sense are combined.

The abnormality information providing control unit 104 controls an operation of the abnormality information providing processing unit 102 on the basis of the determination result of the abnormality determination unit 54.

Here, for the purpose of simplifying description, a case will be described in which the display unit 18 described in FIG. 1 is used as the abnormality information providing processing unit 102, and information that signifies the generation of abnormality is displayed on the screen of the display unit 18. The display unit 18 and the UI control unit 62 described in FIG. 1 can function as one form of the abnormality information providing processing unit 102 and the abnormality information providing control unit 104 shown in FIG. 21.

In the ink jet recording apparatus 100 shown in FIG. 21, similarly to the example described in FIG. 18, a process of using a different information providing aspect in the abnormality information providing processing unit 102 is performed in case of Th2($n$)<|landing position shift amount|≤Th1($n$), and a case of Th1($n$)<|landing position shift amount|.

For example, in a configuration in which information of abnormality is displayed on the screen of the display unit 18 (FIG. 1) as the abnormality information providing processing unit 102, in case of a pixel in which the relation of Th1($n$)|landing position shift amount| is satisfied, as is the case with the first embodiment, the correction process is performed, and information that signifies the possibility of streaks being generated is displayed on the screen of the display unit 18.

In addition, in case of a pixel in which the relation of Th2($n$)<|landing position shift amount|≤Th1($n$) is satisfied, a case does not occur in which the information that signifies the possibility of streaks being generated is displayed on the screen of the display unit 18, just by performing the correction process. That is, in case of the pixel is present in which the relation of Th2($n$)<|landing position shift amount|≤Th1($n$) is satisfied, the correction process is implemented, but whether or not to provide the information that signifies the possibility of streaks being generated is treated equally with a case of a normal printed matter, and the information that signifies the possibility of streaks being generated is not displayed on the screen of the display unit 18.

In this manner, compared with the first embodiment, it is possible to reduce the number of sheets to be confirmed by a user after the termination of a print job.

Sixth Embodiment

In the first to fifth embodiments, the amount of shift from an ideal landing position is used as the landing position shift amount. The ideal landing position can be determined from a design value. The landing position shift amount is an "absolute position shift amount" which is measured on the basis of the ideal landing position. In the first embodiment and second embodiment, the defective jet threshold is defined with respect to the absolute position shift amount.

In a sixth embodiment, an initial landing position shift amount when a print job is started is set to "Ini(n)". In the sixth embodiment, a case will be also described in which the defective jet threshold is defined with respect to the amount of change of landing position shift. Ini(n) is measured as the absolute position shift amount. The amount of change of landing position shift is a "relative position shift amount".

Figure 22:
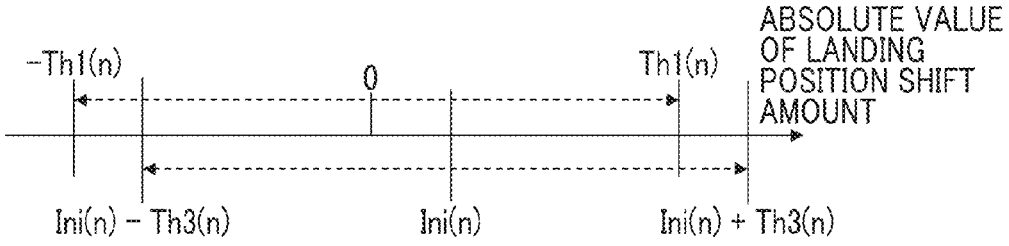
FIG. 22 is a diagram illustrating a threshold of a relative position shift amount which is determined in a sixth embodiment.

A threshold of the relative position shift amount will be described with reference to FIG. 22. The horizontal axis of FIG. 22 represents the absolute value of the landing position shift amount. In FIG. 22, without specifying the color of ink, the initial landing position shift amount is indicated as Ini(n), and the detection threshold of the relative position shift amount is indicated as Th3($n$). The position of "0" represents the ideal landing position, and the absolute position shift amount is the position of "0". Th1($n$) is equivalent to Th(n) described in the first embodiment and Th1($n$) described in the second embodiment.

Similarly to Th1($n$), Th3($n$) can be determined from an average ejection amount Vav(n) for each pixel corresponding to the ejector number "n". According to the examination of the inventors, it can be understood that Th3($n$) may be set to substantially the same value as Th1($n$). The wording "Th3($n$) is substantially the same as Th1($n$)" refers to a case where a difference between the both falls within a range of allowable errors without being limited to a case where Th3($n$) and Th1($n$) are equal to each other. A way to determine the allowable error may be specified by an absolute value, and may be specified by a ratio to the value of Th1($n$). For example, the allowable error can be set to a value of |Th3($n$)−Th1($n$)| being within 15% of Th1($n$).

When a defective jet is determined, it is determined whether the following two inequalities are satisfied.

$$-Th1(n)<D(n)<Th1(n) \quad \text{[Expression 1]}$$

$$Ini(n)-Th3(n)<D(n)<Ini(n)+Th3(n) \quad \text{[Expression 2]}$$

A case where both Expression 1 and Expression 2 are simultaneously satisfies is determined to be normal.

At least one inequality of Expression 1 and Expression 2 is not satisfied is determined to be a defective jet.

Other process contents are the same as the contents described in the first embodiment or the second embodiment.

In the sixth embodiment, a defective jet is detected by combining the determination regarding the absolute position shift amount as described in the first to fifth embodiments and the determination regarding the relative position shift amount.

The configurations described in the first to sixth embodiments can be appropriately combined. For example, a configuration can be used in which the stamp processing unit 26 described in the first embodiment and the second embodiment and the output location change processing unit 96 described in the fourth embodiment are combined. In addition, a configuration can be used in which the stamp processing unit 26 describe in the first embodiment and the second embodiment and the abnormality information providing processing unit 102 described in the fifth embodiment are combined. A configuration can be used in which the output location change processing unit 96 described in the fourth embodiment and the abnormality information providing processing unit 102 described in the fifth embodiment are combined. Further, a configuration or the like can be used in which the configurations described in the first to sixth embodiments are all combined.

Modification Example 5

As a third example of the index value relevant to the droplet ejection amount, it is possible to use a value indicating an average ink gradation value in some or all of the pixel groups in which each ejector takes charge of recording for each ejector. Since the ejection of droplets of each ejector is controlled on the basis of the ink gradation value represented by a signal value of a pixel in printing data, the ink gradation value is related to a value of the droplet ejection amount. Particularly, when the half-tone process is performed by a dither method, the ink gradation value and the droplet ejection amount are associated with each other on a one-to-one basis. Therefore, the droplet ejection amount can be estimated from the ink gradation value, and the ink gradation value can be used as the index value relevant to the droplet ejection amount.

The average ink gradation value in some or all of the pixel groups in which each ejector takes charge of recording for each ejector can be used instead of the "average ejection amount" described in Table 1. The average ink gradation value can be calculated as the average ink gradation value per unit pixel. In addition, it may be a preferred form that the moving average of the ink gradation value is calculated for each specified length with respect to a width in the sheet transport direction, and that the maximum value of the moving average is define as the "average ink gradation value". The maximum value of the moving average is equivalent to one form of a "representative value of the moving average". Meanwhile, a representative value determined in another statistical method may be defined as the "average ink gradation value" without being limited to the maximum value of the moving average.

When the signal value indicating the average ink gradation value is set to s, and s is represented by digital value of 0 to 255, correspondence relation data, for example, as shown in Table 3 can be used instead of Table 1.

TABLE 3

| Ink Gradation Value | Defective Jet Threshold Th |
|---|---|
| $0 \leq s < 3$ | None |
| $3 \leq s < 30$ | 25 μm |
| $30 \leq s < 60$ | 18 μm |
| $60 \leq s < 120$ | 14 μm |
| $120 \leq s < 180$ | 12 μm |
| $180 \leq s < 240$ | 11 μm |
| $240 < s$ | 10 μm |

Figure 23:
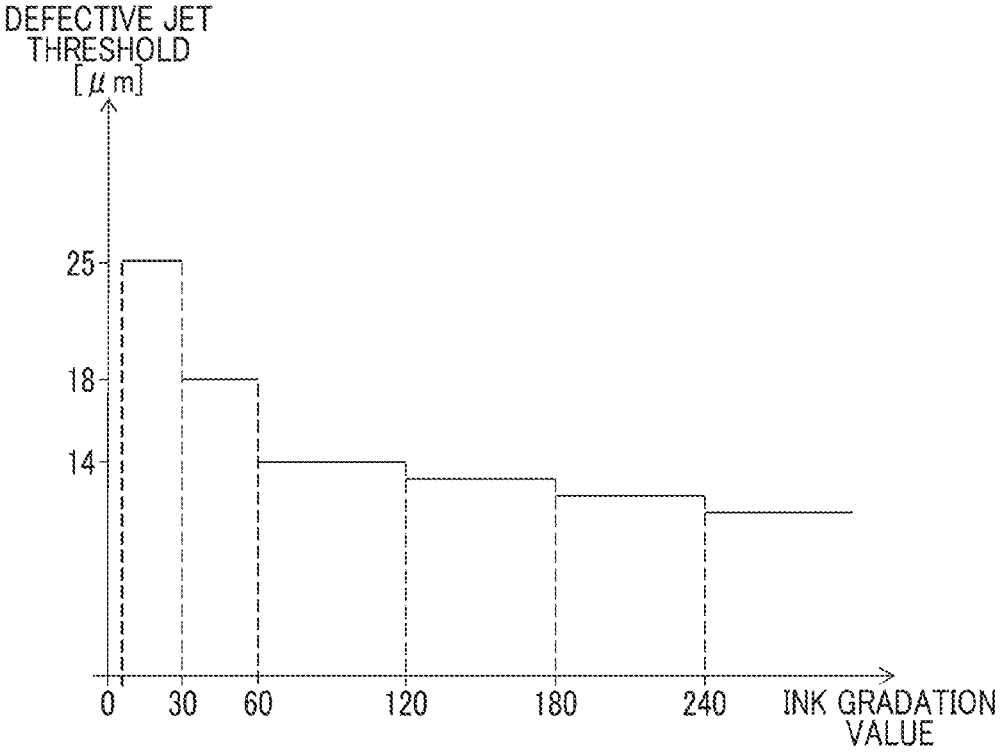
FIG. 23 is a graph illustrating an example of data of a correspondence relation between an average ink gradation value and a defective jet threshold.

FIG. 23 graphically illustrates Table 3. The horizontal axis of FIG. 23 represents an ink gradation value, and the vertical axis represents a defective jet threshold. As shown in Table 3 and FIG. 23, the defective jet threshold can be determined with respect to the average ink gradation value.

In this case, the average ink gradation value corresponding to each ejector of each color is calculated instead of the calculation of the average ejection amount of each ejector of each color described in step S14 of FIG. 2. The defective jet threshold for each ejector is determined with reference to Table 3.

Modification Example 6

As a fourth example of the index value relevant to the droplet ejection amount, it is possible to use a value indicating a total ink gradation value of a specific pixel region which is some or all of the pixel groups in which each ejector takes charge of recording for each ejector. When the total ink gradation value within the specific pixel region is divided by the number of pixels of the specific pixel region, it is possible to obtain a value indicating the average ink gradation value per pixel. As the index value relevant to the droplet ejection amount, it is the option of a calculation method that a value indicating the average ink gradation value per unit pixel is obtained, or the total ink gradation value within the specific pixel region is obtained. An object of the present invention can be achieved using any index value.

Modification Example 7

As a fifth example the index value relevant to the droplet ejection amount, it is also possible to use a printing duty for each ejector. The printing duty indicates a recording ratio of dots to a row of pixels for each ejector in the sheet transport direction. The printing duty indicates a usage rate of the ejector, and can be calculated from the printing data.

[Configuration Example of Printing Apparatus]

Hereinafter, a specific configuration example of the printing apparatus 12 will be described. Meanwhile, in the present embodiment, an example will be described in which an agglutination process liquid is used, and aqueous ink is used, but can also be applied to a case where the agglutination process liquid is not used or a case where oily ink is used.

Figure 24:
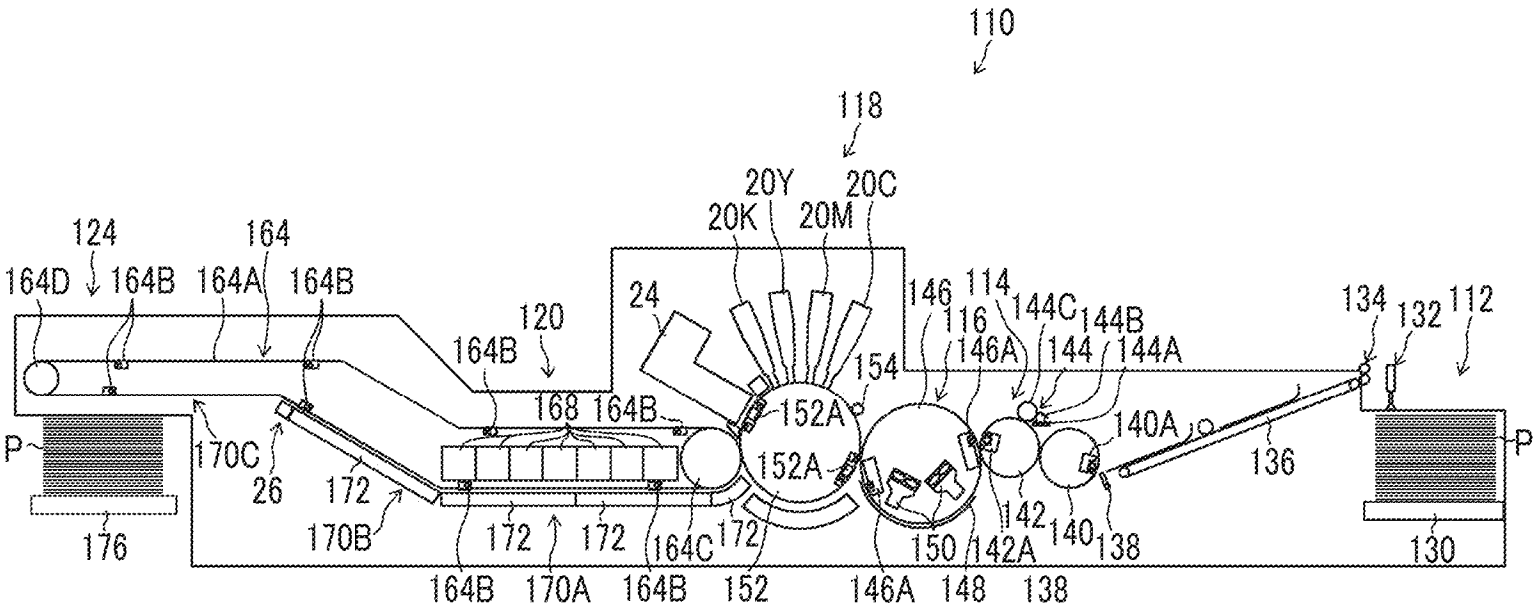
FIG. 24 is an entire configuration diagram of an ink jet printing machine which is a specific example of a printing apparatus.

FIG. 24 is an entire configuration diagram of an ink jet printing machine 110 indicating a specific example of the printing apparatus 12. The ink jet printing machine 110 is a printing apparatus that records an image in an ink jet system using aqueous ink in paper sheet P. The ink jet printing machine 110 includes a sheet feed unit 112, a process liquid providing unit 114, a process liquid drying unit 116, a drawing unit 118, an ink drying unit 120, and a sheet discharge unit 124.

<Sheet Feed Unit>

The sheet feed unit 112 is configured to include a sheet feed stand 130, a sheet feeder 132, a sheet feed roller pair 134, a feeder board 136, a front stop 138, and a sheet feed drum 140. The sheet feed stand 130 is a stand for placing the sheet P. A large number of sheets P laminated in the state of a bundle (sheet bundle) are placed on the sheet feed stand 130. The type of the sheet P is not particularly limited, and a general-purpose printing sheet (cellulose-based sheet such as so-called high-quality paper, coated paper, or art paper) used for general offset printing or the like can be used. In this example, coated paper is used. The coated paper is paper which is provided with a coat layer by applying a coating material to the surface of high-quality paper, neutralized paper or the like on which surface treatment is not performed generally. Specifically, art paper, coated paper, lightweight coated paper, fine coated paper or the like is suitably used.

The sheet feeder 132 adsorptively holds and takes up the sheets P, loaded on the sheet feed stand 130, one by one in order from above, and feeds the sheets to the sheet feed roller pair 134. The feeder board 136 receives the sheets P which are sent out from the sheet feed roller pair 134, and transports the sheets toward the sheet feed drum 140. The front stop 138 is provided at the terminal position of the feeder board 136, and corrects the posture of the sheets P transported by the feeder board 136.

The sheet feed drum 140 receives the sheets P of which the posture is corrected by the front stop 138 from the feeder board 136, and transports the sheets to the process liquid providing unit 114. The sheet feed drum 140 includes a gripper 140A, and grasps and rotates the tip portion of the sheet P using this gripper 140A, to thereby transport the sheet P to the process liquid providing unit 114.

<Process Liquid Providing Unit>

The process liquid providing unit 114 applies a process liquid to the sheet P. The process liquid of this example is a liquid having a function of agglutinating color material components in ink. The process liquid includes a agglutinating agent for agglutinating components in an ink composition which is provided in the drawing unit 118. The process liquid and the ink come into contact with each other to thereby cause agglutination reaction with the ink, the ink has color materials and a solvent promoted to be separated therebetween, and bleeding, landing interference or color mixing after ink landing is suppressed, which leads to the capability of the formation of a high-quality image. The process liquid may be called the term "agglutination process liquid", "preprocessing solution", or "pre-coating liquid". The process liquid is used together with the ink composition, and thus it is possible to speed up ink jet recording, and to obtain an image excellent in a drawing property (for example, reproducibility of a fine line or a micro portion) having high density and resolution even in high-speed recording.

The process liquid providing unit 114 includes a process liquid providing drum 142 and a process liquid application device 144. The process liquid providing drum 142 receives the sheet P from the sheet feed drum 140, and transports the sheet P. The process liquid providing drum 142 includes a gripper 142A, and grasps and rotates the tip portion of the sheet P using this gripper 142A. The sheet P is wound around the circumferential surface of the process liquid providing drum 142 in a state where the tip portion is grasped by the gripper 142A, and is transported by the rotation of the process liquid providing drum 142.

The process liquid application device 144 is means for applying a process liquid to the sheet P which is transported by the process liquid providing drum 142. The process liquid application device 144 of this example is an application device based on a roller application system, and is configured such that a portion of a supply roller 144B is immersed in a process liquid stored within a container 144A, and that a process liquid measured in the supply roller 144B is transferred to the sheet P on the process liquid providing drum 142 by a coating roller 144C such as a rubber roller.

Means for providing a process liquid to the sheet P is not limited to the roller application system, and various systems such as a spray system and an ink jet system can be applied thereto. The sheet P to which a process liquid is provided by the process liquid providing unit 114 is delivered from the process liquid providing drum 142 to a process liquid drying drum 146.

<Process Liquid Drying Unit>

The process liquid drying unit 116 includes the process liquid drying drum 146 as sheet transport means, a guide member 148 that guides the sheet P during transport, and a drying unit 150.

The process liquid drying drum 146 includes a gripper 146A, and grasps and rotates the tip portion of the sheet P using this gripper 146A, to thereby transport the sheet P.

The guide member 148 functions as a sheet transport guide for assisting sheet transport in the process liquid drying drum 146.

The drying unit 150 is a device, installed inside the process liquid drying drum 146, which is capable of suctioning out hot air which is heated air toward the guide member 148. In the course of the sheet P being transported by the process liquid drying drum 146, the hot air which is suctioned out from the drying unit 150 comes into contact with the recording surface of the sheet P, and a process of drying a process liquid is performed. An ink agglutination layer having an ink agglutination action is formed on the recording surface of the sheet P by this drying process.

<Drawing Unit>

The drawing unit 118 includes a drawing drum 152, a sheet pressing roller 154, recording heads 20C, 20M, 20Y, and 20K, and the image reading unit 24. The drawing drum 152 receives the sheet P from the process liquid drying drum 146, and transports the sheet P. The drawing drum 152 includes a gripper 152A, and grasps and rotates the tip portion of the sheet P using this gripper 152A, to thereby wind the sheet P around its circumferential surface and transport the sheet P. The drawing drum 152 has a plurality of adsorption holes (not shown) on its circumferential surface, and adsorptively holds the sheet P on the circumferential surface by suctioning the sheet P from the adsorption holes.

The respective recording heads 20C, 20M, 20Y, and 20K are arranged at regular intervals along the transport path of the sheet P, and are arranged at right angles to the transport direction of the sheet P.

The sheet P has ink ejected from the recording heads 20C, 20M, 20Y, and 20K in the course of the sheet being transported by the drawing drum 152, and an image is recorded on the sheet P. The sheet P is transported at a constant rate by the rotation of the drawing drum 152, and an operation for relatively moving the sheet P and the respective recording heads 20C, 20M, 20Y, and 20K in this transport direction is performed only one time, that is, one-time sub-scanning is performed, thereby allowing an image to be recorded on an image forming region of the sheet P. A recording system in which an image is completed by such one-time sub-scanning is called a single pass system.

The image reading unit 24 reads the image recorded on the sheet P by the recording heads 20C, 20M, 20Y, and 20K. The "image recorded on the sheet P" also includes a test chart for density measurement, a test chart for defective nozzle detection, a test chart for non-ejection correction, various types of other test charts, and the like, in addition to a printed image which is specified in a print job.

<Ink Drying Unit>

The ink drying unit 120 performs an ink drying process of the sheet P on which an image is recorded. The ink drying unit 120 includes a chain gripper 164 for transporting the sheet P, and ink drying units 168.

The chain gripper 164 includes an endless chain 164A and a gripper 164B, and receives the sheet P from the drawing unit 118, and then transports the sheet P to the sheet discharge unit 124 along a predetermined transport path. The chain 164A is wound around a first sprocket 164C and a second sprocket 164D. A plurality of chain guides (not shown) that guide the traveling of the chain 164A are provided between the first sprocket 164C and the second sprocket 164D.

The chain 164A, the first sprocket 164C, the second sprocket 164D, and the chain guide (not shown) form a pair each, and are arranged at both sides of the sheet P on the transport path, that is, both sides of the sheet P in a sheet width direction orthogonal to the sheet transport direction.

The gripper 164B s installed on bars (not shown) which are hung over between a pair of chains 164A. The bars provided with the gripper 164B are installed on a plurality of locations of the chains 164A at regular intervals in the feed direction of the chains 164A.

The gripper 164B grasps the tip portion of the sheet P at a position to which the sheet P is delivered from the gripper 152A of the drawing drum 152. The chains 164A travel by driving a motor (not shown) which is coupled to the first sprocket 164C, and the sheet P grasped by the gripper 164B is transported.

The transport path of the sheet P in the chain gripper 164 includes a first interval 170A which is flatten, a second interval 170B having an ascending slope, and a third interval 170C which is flatten, in order from the upstream side in the sheet transport direction toward the sheet discharge unit 124 from the drawing drum 152.

Guide plates 172 that guide the transport of the sheet P are arranged in the first interval 170A and the second interval 170B. Each of the guide plates 172 has a large number of adsorption holes (not shown) in its guide surface which comes into contact with the rear surface of the sheet P, and suctions the sheet P from the adsorption holes. Thereby, tensile force (back tension) is given to the sheet P which is transported along the upper portion of the guide plate 172 by the chain gripper 164.

The ink drying units 168 are installed in the first interval 170A of the chain gripper 164. The detailed configuration of the ink drying unit 168 is not shown, but each of the ink drying units 168 can be configured by combining a heater and a fan. The ink drying unit 168 heats and dries the sheet P after image formation in the drawing unit 118, and removes liquid components remaining on the surface of the sheet P. Meanwhile, a configuration can also be used in which an ink drying unit (not shown) is installed in the second interval 170B, in addition to the ink drying unit 168 of the first interval 170A. In addition, in a device configuration in which ultraviolet curing type ink is used, a configuration can also be used in which an ultraviolet irradiation unit is provided instead of the drying-by-heating type drying unit or by a combination with this unit.

<Stamp Process Unit>

The stamp processing unit 26 is installed on the transport path of the sheet P in the chain gripper 164. In FIG. 21, the stamp processing unit 26 is installed on a position backward of the second interval 170B and forward of the third interval 170C.

The stamp processing unit 26 attaches ink to a tip edge P1 (see FIG. 2) of the sheet P where a defective image is generated, or the tip edge P1 of the sheet P corresponding to the number of copies to be sorted. Thereby, defective sheets P are specified from sheets P which are loaded in the sheet discharge unit 124, or sorting segments for managing the number of copies to be sorted are specified therefrom.

Meanwhile, the installation location of the stamp processing unit 26 may be the downstream side of the drawing unit 118, and the arrangement thereof can be made in case of a structure of the transport unit in which the stamp processing unit 26 can be arranged.

<Sheet Discharge Unit>

The sheet discharge unit 124 recovers sheets P on which an image is formed. The sheet discharge unit 124 includes a sheet discharge stand 176 that stacks and recovers sheets P. The gripper 164B releases the grasp of the sheet P on the sheet discharge stand 176, and stacks the sheet P on the sheet discharge stand 176.

<With Respect to Detailed Structure of Stamp Process Unit>

Figure 25:
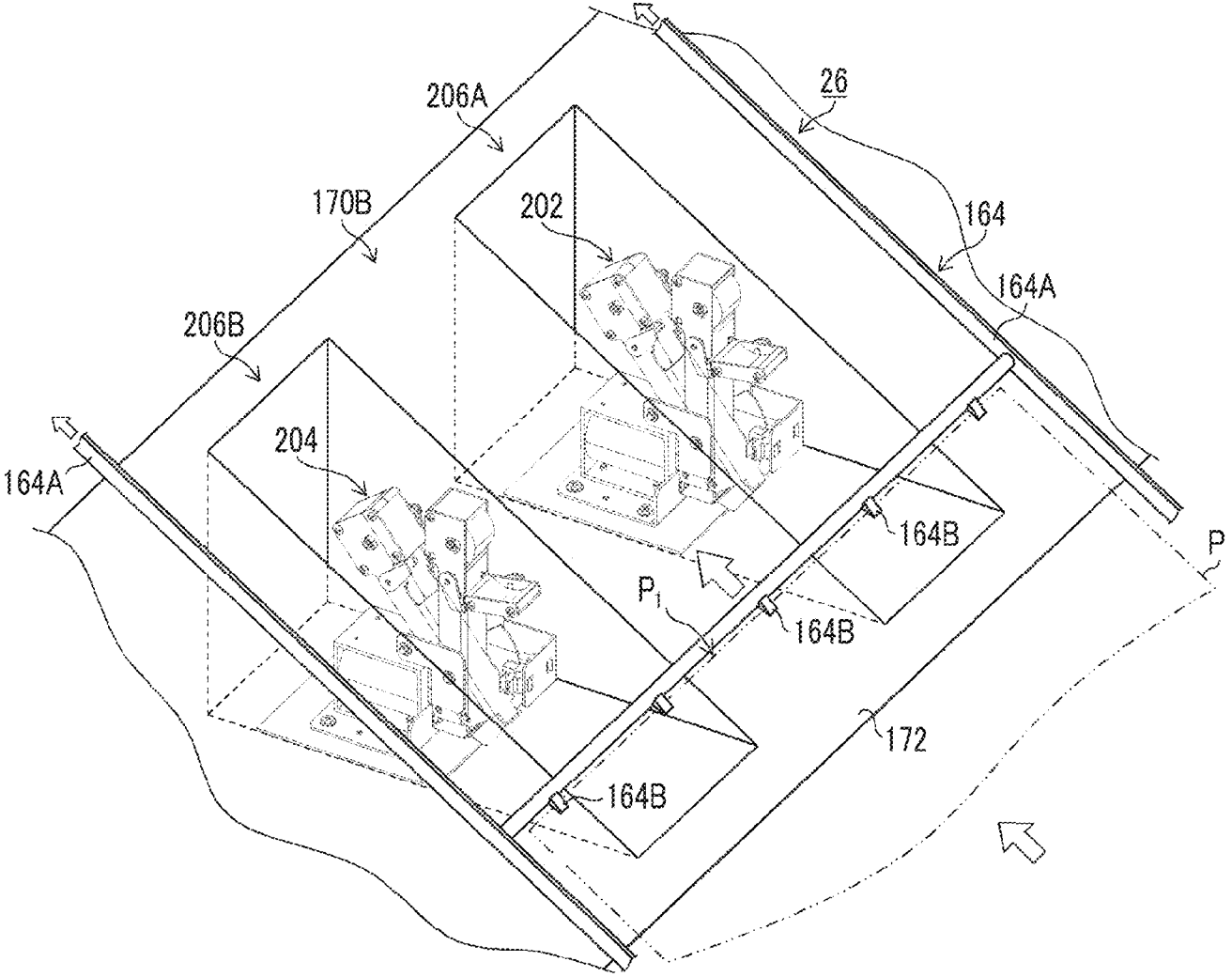
FIG. 25 is a perspective view illustrating a structure example of a stamp processing unit.

FIG. 25 is a perspective view illustrating a structure example of the stamp processing unit 26. As shown in FIG. 25, the stamp processing unit 26 is configured to include a first stamper 202 and a second stamper 204. The first stamper 202 and the second stamper 204 are received in casings 206A and 206B (shown by broken lines) of which the upper surfaces are obliquely opened along an inclined transport path of the second interval 170B of the chain gripper 164, and the casings 206A and 206B are arranged at a position downward of the inclined transport path.

The first stamper 202 and the second stamper 204 are arranged between a pair of chains 164A. In addition, the first stamper 202 and the second stamper 204 are arranged between the grippers in the width direction of the sheet P.

The first stamper 202 and the second stamper 204 are arranged at different positions in the width direction of the sheet P orthogonal to the transport direction of the sheet P, and thus ink attachment positions in the width direction of the sheet P do not overlap each other. Meanwhile, the term "orthogonal" includes an intersection in a range considered to be substantially orthogonal, among intersections at angles less than 90 degrees or exceeding 90 degrees.

The first stamper 202 attaches ink to the tip edge P1 of the sheet P in which a defective image is determined to be generated on the basis of the reading result of the image reading unit 24. The tip edge P1 is equivalent to one form of the "end of a recording medium". The second stamper 204 attaches ink to the tip edge P1 of the sheet P corresponding to a sorting segment, on the basis of the number of copies to be sorted which is set in advance. It is preferable that the color of ink of the first stamper 202 and the color of ink of the second stamper 204 are set to different colors (types). Thereby, it can be determined at first sight that the ink attached to the sheet P is due to a defective sheet or is due to the number of copies to be sorted. Alternatively, as described in the second embodiment, a configuration can also be used in which a red stamp is pressed by the first stamper 202, and a blue stamp is pressed by the second stamper 204.

Figure 26:
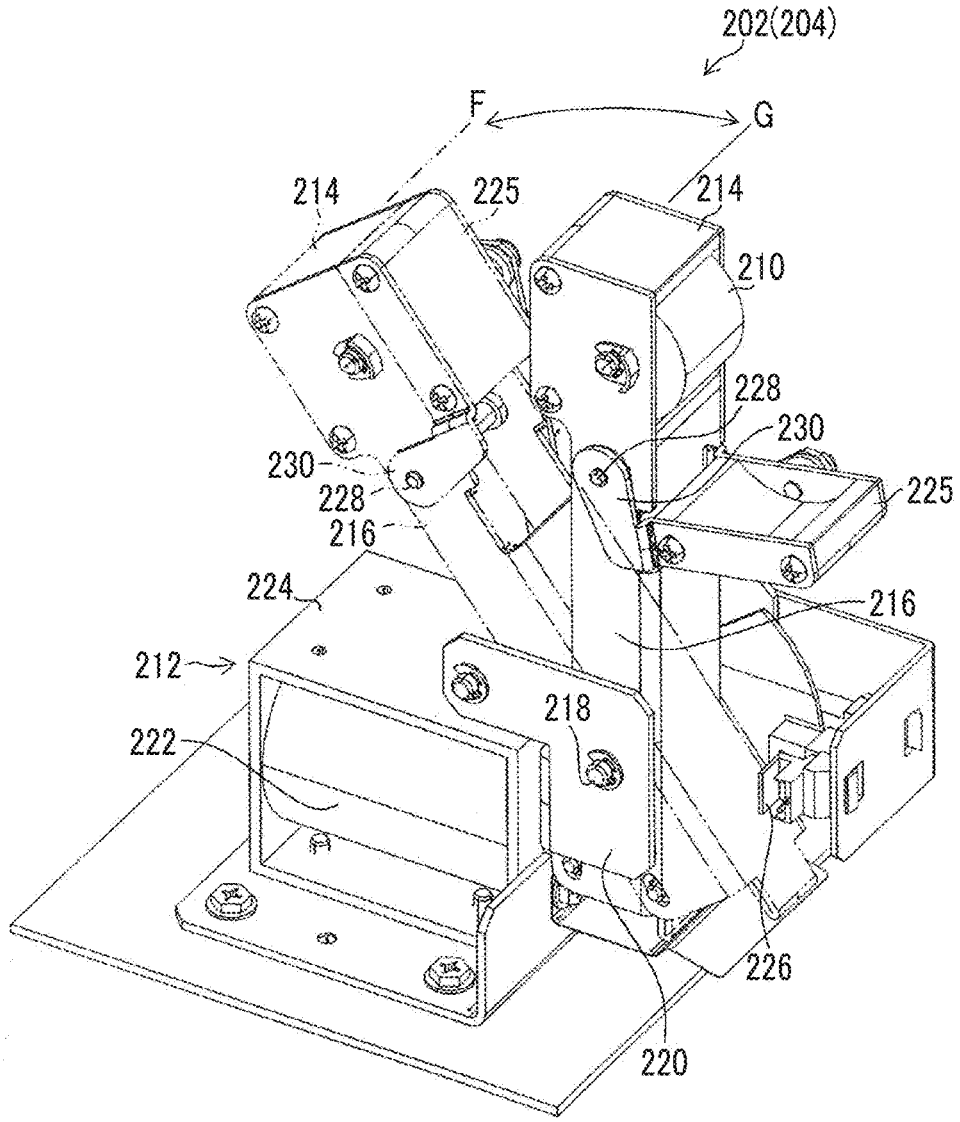
FIG. 26 is a perspective view illustrating a structure of a stamper.

FIG. 26 is a perspective view illustrating a structure of the first stamper 202. Meanwhile, the same configuration can be applied to the first stamper 202 and the second stamper 204. In the following description, the first stamper 202 will be described on behalf of the first stamper 202 and the second stamper 204.

Meanwhile, "the same configuration" as used herein is different from some configurations, but includes "substantially the same" which is capable of obtaining the same operational effect.

As shown in FIG. 26, the first stamper 202 is configured to include a stamp roller 210 into ink is impregnated, and a retracting mechanism 212 that retracts the stamp roller 210 with respect to the chain gripper 164 (see FIG. 24).

The stamp roller 210 is rotatably supported within a stamp container 214, and the stamp container 214 is supported by the retracting mechanism 212.

The retracting mechanism 212 is configured to include an arm 216 that supports the stamp container 214 at the tip portion, a support plate 220 that rotatably supports the arm 216 through a revolving shaft 218, and a solenoid actuator 222 that rotates the arm 216 around the revolving shaft 218 to move the stamp container 214 between a standby position F and a stamp position G.

In FIG. 26, the stamp container 214 and the like located at the standby position F are shown by dashed-two dotted lines, and the stamp container 214 and the like located at the stamp position G are shown by solid lines. The stamp container 214 located at the standby position F is set to be in a "retracted state" where the stamp container 214 does not protrude from openings of the casings 206A and 206B described in FIG. 25. In addition, the stamp container 214 located at the stamp position G of FIG. 26 is set to be in a "projected state" where the stamp container 214 protrudes from the openings of the casings 206A and 206B described in FIG. 25.

The arm 216 is rotatably supported by the support plate 220. The support plate 220 is supported by an outer frame portion 224 of the solenoid actuator 222. The outer frame portion 224 is fixed to the bottoms of the casings 206A and 206B.

The solenoid actuator 222 is controlled to be turned ON/OFF on the basis of a command signal which is sent out from the stamp control unit 58 (see FIG. 1). When the solenoid actuator 222 is turned ON, the base end of the arm 216 is attracted to the solenoid actuator 222. The arm 216 standing by in an inclined state is erected by this movement, and the stamp container 214 located on the tip portion of the arm 216 moves from the standby position F to the stamp position G. The first stamper 202 is provided with a latching mechanism that holds the state of the arm 216 erected once, and thus the erect state of the arm 216 is held even after an excitation current flowing to a coil of the solenoid actuator 222 is turned off and a magnetic field is caused to disappear.

The stamp container 214 is opened and closed in conjunction with the retracting mechanism 212, and is provided with an opening and closing lid 225 that exposes the stamp surface of the stamp roller 210 from the stamp container 214, or air-tightly seals the stamp roller 210. An opening and closing mechanism of the opening and closing lid 225 is constituted by an optical sensor 226 that detects a base end position which is a home position of the arm 216, and an opening and closing actuator (not shown) that opens and closes the opening and closing lid 225 on the basis of the detection result of the optical sensor 226.

That is, when the arm 216 moves to the stamp position G; and the base end of the arm 216 is not detected by the optical sensor 226 (OFF state), the opening and closing actuator is driven and the opening and closing lid 225 is opened.

In addition, when the arm 216 moves to the standby position F, and the base end of the arm 216 is detected by the optical sensor 226 (ON state), the opening and closing actuator is driven and the opening and closing lid 225 is closed. The opening and closing lid 225 is opened and closed in conjunction with the retraction of the stamp container 214 associated with the revolution of the arm 216.

An example of the opening and closing mechanism of the opening and closing lid 225 to be adopted may include a system in which the opening and closing lid 225 is supported by a support arm 230 through a rotary pin 228 with respect to the stamp container 214, and the opening and closing lid 225 is opened and closed when the rotary pin 228 is revolved by a motor.

The sheet P is transported in a direction shown by a white arrow in FIG. 22, and the stamp roller 210 located at the stamp position G (the opening and closing lid of the stamp container is in an open state) is brought into contact with the tip edge P1 of the sheet P, whereby ink is attached to the tip edge P1.

The solenoid actuator 222 is turned OFF immediately before the sheet P is brought into contact with the stamp roller 210, and the arm 216 falls down due to the influence of the sheet P being brought into contact with the stamp container 214. Thereby, the stamp container 214 is retracted downward of the chain gripper 164 and is received in the casings 206A and 206B. Therefore, a normal sheet P which is subsequently transported is not inhibited from being transported.

The first stamper 202 is provided with a stopper mechanism (not shown) that stops the arm 216 at the standby position F.

Meanwhile, in the present embodiment, the retracting mechanism of the stamp container 214 is configured such that the stamp roller 210 is retracted with respect to the chain gripper 164 by revolving the arm and causing the arm to rise and fall, but there is no limitation to such a system insofar as a similar operation can be performed.

[Configuration Example of Recording Head]

Next, a configuration example of the recording heads 20C, 20M, 20Y, and 20K (see FIGS. 1 and 24) will be described. In this example, the structures of the recording heads 20C, 20M, 20Y, and 20K are in common with each other, and thus it is assumed, hereinafter, that the recording head is denoted by sign 320 on behalf of all the recording heads.

Figure 27:
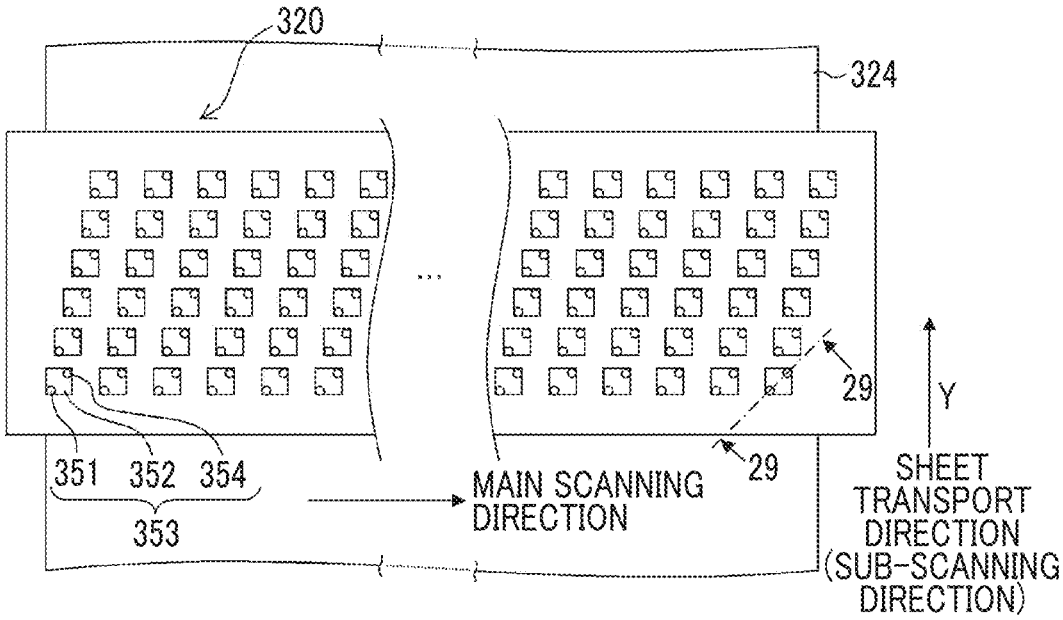
FIG. 27 is a plane perspective view illustrating a structure example of a recording head.
Figure 28:
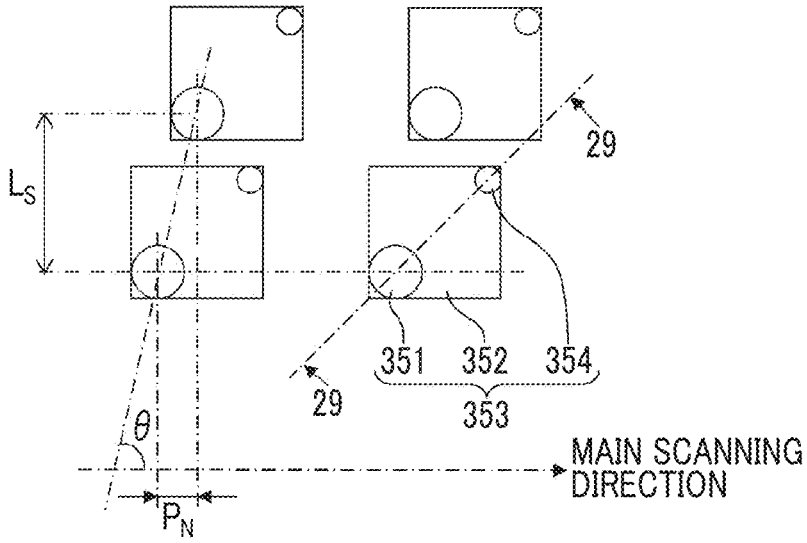
FIG. 28 is a partially enlarged view of FIG. 27.

FIG. 27 is a plane perspective view illustrating a structure example of the recording head 320, and FIG. 28 is a partially enlarged view of FIG. 27. The recording head 320 has a nozzle array of equal to or greater than a length corresponding to the full width of the recording region of the sheet 324 in the main scanning direction (X direction) which is the sheet width direction orthogonal to the sheet transport direction (Y direction).

As shown in FIG. 27, the recording head 320 includes a plurality of ejectors 353 constituted by nozzles 351 which are ink ejection ports, pressure chambers 352 corresponding to the nozzles 351, and the like. The planar shape of the pressure chamber 352 which is provided corresponding to each of the nozzles 351 is approximately square (see FIGS. 27 and 28), and one of both corners on the diagonal line is provided with an outflow port to the nozzle 351, and the other corner is provided with an inflow port (supply port) 354 of ink to be supplied. Meanwhile, the shape of the pressure chamber 352 is not limited to this example. The planar shape may be various forms such as a quadrangle (such as a rhombus or a rectangle), a pentagon, a hexagon, other polygons, a circle, and an ellipse.

Figure 29:
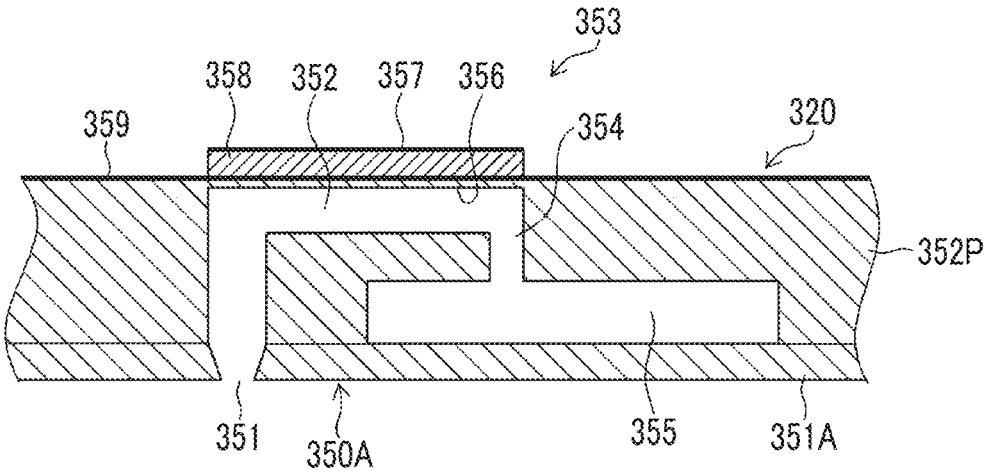
FIG. 29 is a cross-sectional view taken along line 29-29 of FIG. 27.

FIG. 29 is a cross-sectional view illustrating a three-dimensional configuration of one channel's worth of ejector 353 serving as a recording element unit. FIG. 29 is equivalent to a cross-sectional view taken along line 29-29 of FIGS. 27 and 28.

As shown in FIG. 29, the recording head 320 has a structure in which a nozzle plate 351A, a channel plate 352P and the like are stacked and bonded together. The nozzle plate 351A is a member in which the nozzle 351 is formed. In FIG. 29, the lower surface of the nozzle plate 351A is an ink ejection surface 350A. The channel plate 352P is a channel forming member in which the pressure chamber 352 and a channel such as a common channel 355 are formed. That is, the channel plate 352P is a channel forming member, constituting a sidewall portion of the pressure chamber 352, for forming the supply port 354 as a contraction portion (narrowest portion) of an individual supply path that guides ink from the common channel 355 to the pressure chamber 352. Although simply shown in FIG. 29 for convenience of description, the channel plate 352P has a structure in which one or a plurality of substrates are stacked. The nozzle plate 351A and the channel plate 352P can be processed to have a required shape by a semiconductor manufacturing process using silicon as a material.

The common channel 355 communicates with an ink tank (not shown) which is an ink supply source, and ink which is supplied from the ink tank is supplied to each pressure chamber 352 through the common channel 355.

A piezoelectric element 358 including an individual electrode 357 is bonded to a vibration plate 356 constituting a portion of surface (top surface in FIG. 29) of the pressure chamber 352. The vibration plate 356 of this example functions as a common electrode 359 equivalent to the lower electrode of the piezoelectric element 358. Meanwhile, a configuration can also be used in which the vibration plate is formed by a non-conductive material such as silicon or resin. In this case, a common electrode layer is formed on the surface of the vibration plate member by a conductive material such as a metal.

The piezoelectric element 358 is deformed by applying a drive voltage to the individual electrode 357 to thereby lead to a change in the volumetric capacity of the pressure chamber 352, and ink is ejected from the nozzle 351 a pressure change associated therewith.

As shown in FIGS. 27 and 28, a large number of ejectors 353 having such a structure are arrayed in a lattice shape with a constant array pattern along a row direction in the main scanning direction and an oblique column direction having a constant angle θ which is not orthogonal to the main scanning direction.

In the two-dimensional array shown in FIGS. 27 and 28, when a space between adjacent nozzles in the sub-scanning direction is set to Ls, the main scanning direction can be treated equivalent to that in which the respective nozzles 351 are linearly arrayed at a substantially constant pitch $P_N = Ls/\tan\theta$.

Meanwhile, the array form of the nozzles 351 in the recording head 320 is not limited to the shown example, and various nozzle arrangement structures can be applied thereto.

Figure 30A:
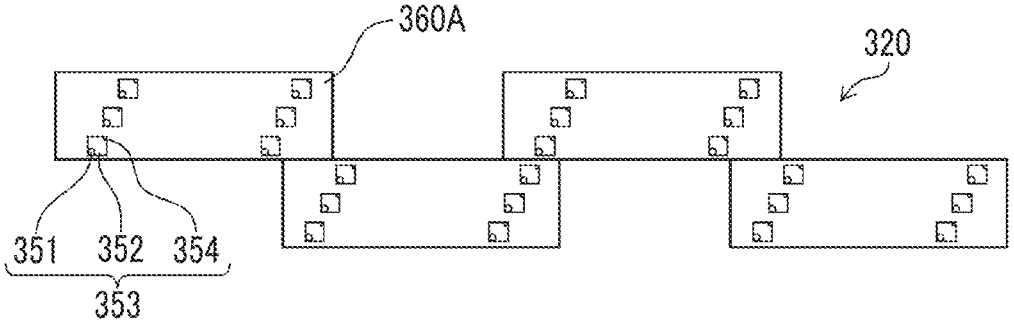
FIGS. 30A and 30B are plane perspective views illustrating another structure example of the recording head.
Figure 30B:
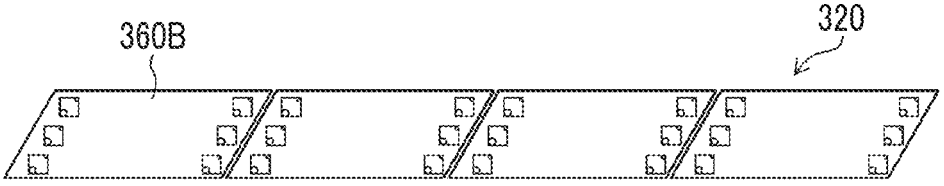

FIGS. 30A and 30B are plane perspective views illustrating another structure example of the recording head. The recording head 320 as shown in FIGS. 30A and 30B can be used instead of the recording head 320 described in FIG. 27. The recording head 320 shown in FIG. 30A is formed as a line head which is configured to be long in the sheet width direction by short head modules 360A in which a plurality of nozzles 351 are arrayed two-dimensionally being arrayed in zigzag and engaged with each other. The recording head 320 shown in FIG. 30B is formed as a line head which is configured to be long by head modules 360B being lined up in a row and engaged with each other. Meanwhile, in FIGS. 30A and 30B, for the purpose of simplifying the illustration, the description of the ejectors 353 which are arrayed two-dimensionally is partially omitted.

Modification Example 8

The measurement amount for each ejector which is acquired by inspecting the ejection state of the ejector is not limited to the landing position shift amount. The measurement amount may include an aspect of measuring the line width of a line pattern for each ejector, or an aspect of measuring a flight direction (that is, flight angle). The line width of the line pattern for each ejector is a value obtained by reflecting the amount of ejected droplets of each ejector. When the line width falls below a thickness of a certain criterion, this case can be determined to be abnormal. A threshold is set with respect to the line width, and the measured line width and the threshold are compared with each other, thereby allowing ejection abnormality to be detected. Meanwhile, the measurement of the line width is equivalent to the indirect measurement of the amount of ejected droplets.

Modification Example 9

In the first to sixth embodiments described above, a description has been given of an example of inspecting the ejection state of each ejector by reading the recording results of the test pattern, and acquiring the measurement amount for each ejector, but means for inspecting the ejection state of the ejector is not limited to this example. For example, inspection means for capturing an image of droplets ejected from the nozzles using a camera, or the like can also be adopted instead of such means or by a combination with the means.

Modification Example 10

In the first to sixth embodiments, the ink jet recording apparatus of a single pass system using a line head has been described. The application range of the present invention is not limited to the ink jet recording apparatus of a single pass system, and can also be applied to an ink jet recording apparatus of a serial scanning system in which image recording is performed while the recording head is scanned in a direction perpendicular to the transport direction of a recording medium.

Modification Example 11

A configuration in which a defective jet is detected during execution of a print job has been described, but the defective jet can also be detected by the same method before the start of a print job.

Advantage of Embodiments

According to the embodiments of the present invention described above, an appropriate threshold for ejection abnormality determination can be set for each ejector in accordance with the content of a printed image, on the basis of printing data. Thereby, it is possible to perform appropriate abnormality detection in accordance with the required quality and contents of the printed image.

In addition, a threshold for ejection abnormality determination is set with respect to the measurement amount such as the landing position shift amount for each ejector which is obtained by inspecting the ejection state of each ejector, and abnormality determination is performed by comparing the measurement amount with the threshold, which leads to the capability of application to a high image quality level required as in a graphic image.

According to the embodiments of the present invention, since an appropriate threshold can be set in accordance with a required image quality, it is possible to prevent excessive abnormality detection from being performed.

Further, according to the embodiments of the present invention, it is also possible to cope with printing of an image in which various types of images are combined.

In addition, as described in the second to fifth embodiments, a plurality of types of threshold are set, and the level of abnormality determination is detected in a stepwise manner, thereby allowing printing to be advanced without stopping printing while preventing streaks from being generated.

In the embodiments of the present invention described above, changes, additions, and deletions of components can be made appropriately without departing from the spirit or scope of the present invention. The present invention is not limited to the embodiments described above, and a lot of modifications can be made by those ordinarily skilled in the art within the technical idea of the present invention.

What is claimed is:

1. An ink jet recording apparatus comprising:

an ink jet head having a plurality of ejectors that eject droplets;

a medium transport unit that transports a recording medium;

a calculation unit that calculates an index value relevant to a droplet ejection amount for each of the ejectors which is expected during recording of a printed image with respect to each of the plurality of ejectors, on the basis of printing data for specifying contents of the printed image which is recorded on the recording medium by the ink jet head;

a threshold determination unit that determines a threshold for ejection abnormality determination for each of the ejectors, in accordance with the index value for each of the ejectors calculated by the calculation unit;

a threshold storage unit that stores the threshold determined for each of the ejectors by the threshold determination unit; and an abnormality determination unit that determines presence or absence of an ejection abnormality by comparing a measurement amount of each of the ejectors obtained by inspecting an ejection state of the ejector with the threshold determined for each of the ejectors relating to the measurement amount, wherein the index value is a value indicating an average ejection amount per unit pixel for each of the ejectors which is estimated from the printing data, or a value indicating a total ejection amount within a specific pixel region for each of the ejectors which is estimated from the printing data, the printing data is continuous-tone image data indicating an ink gradation value, and the calculation unit calculates the average ejection amount for each of the ejectors or the total ejection amount for each of the ejectors, on the basis of a half-tone dot ratio table in which a relationship between an ink gradation value and an appearance ratio of dot types in a half-tone process is specified, a standard droplet amount per dot for each dot type, and an ink gradation value of a pixel in which each of the ejectors takes charge of recording for each of the ejectors.

2. The ink jet recording apparatus according to claim 1, wherein the calculation unit calculates a moving average of an ejection amount of the ejector with respect to a medium transport direction in which the recording medium is transported by the medium transport unit, and obtains a representative value of the moving average as a value indicating the average ejection amount of the index value.

3. An ink jet recording apparatus comprising:

an ink jet head having a plurality of ejectors that eject droplets;

a medium transport unit that transports a recording medium;

a calculation unit that calculates an index value relevant to a droplet ejection amount for each of the ejectors which is expected during recording of a printed image with respect to each of the plurality of ejectors, on the basis of printing data for specifying contents of the printed image which is recorded on the recording medium by the ink jet head;

a threshold determination unit that determines a threshold for ejection abnormality determination for each of the ejectors, in accordance with the index value for each of the ejectors calculated by the calculation unit;

a threshold storage unit that stores the threshold determined for each of the ejectors by the threshold determination unit; and an abnormality determination unit that determines presence or absence of an ejection abnormality by comparing a measurement amount of each of the ejectors obtained by inspecting an ejection state of the ejector with the threshold determined for each of the ejectors relating to the measurement amount, wherein the index value is a value indicating an average ejection amount per unit pixel for each of the ejectors which is estimated from the printing data, or a value indicating a total ejection amount within a specific pixel region for each of the ejectors which is estimated from the printing data, and the calculation unit calculates a moving average of an ejection amount of the ejector with respect to a medium transport direction in which the recording medium is transported by the medium transport unit, and obtains a representative value of the moving average as a value indicating the average ejection amount of the index value.

4. An ink jet recording apparatus comprising:

an ink jet head having a plurality of ejectors that eject droplets;

a medium transport unit that transports a recording medium;

a calculation unit that calculates an index value relevant to a droplet ejection amount for each of the ejectors which is expected during recording of a printed image with respect to each of the plurality of ejectors, on the basis of printing data for specifying contents of the printed image which is recorded on the recording medium by the ink jet head;

a threshold determination unit that determines a threshold for ejection abnormality determination for each of the ejectors, in accordance with the index value for each of the ejectors calculated by the calculation unit;

a threshold storage unit that stores the threshold determined for each of the ejectors by the threshold determination unit; and an abnormality determination unit that determines presence or absence of an ejection abnormality by comparing a measurement amount of each of the ejectors obtained by inspecting an ejection state of the ejector with the threshold determined for each of the ejectors relating to the measurement amount, wherein the index value is a value indicating an average ejection amount per unit pixel for each of the ejectors which is estimated from the printing data, or a value indicating a total ejection amount within a specific pixel region for each of the ejectors which is estimated from the printing data, the calculation unit calculates a value indicating an average ejection amount per unit pixel in some or all of pixel groups in which each of the ejectors takes charge of recording for each of the ejectors or a value indicating a total ejection amount of some or all of pixel groups in which each of the ejectors takes charge of recording for each of the ejectors on the basis of a half-tone image corresponding to the printing data and a standard droplet amount per dot for each dot type, and the calculation unit calculates a moving average of an ejection amount of the ejector with respect to a medium transport direction in which the recording medium is transported by the medium transport unit, and obtains a representative value of the moving average as a value indicating the average ejection amount of the index value.

5. An ink jet recording apparatus comprising:

an ink jet head having a plurality of ejectors that eject droplets;

a medium transport unit that transports a recording medium;

a calculation unit that calculates an index value relevant to a droplet ejection amount for each of the ejectors which is expected during recording of a printed image with respect to each of the plurality of ejectors, on the basis of printing data for specifying contents of the printed image which is recorded on the recording medium by the ink jet head;

a threshold determination unit that determines a threshold for ejection abnormality determination for each of the ejectors, in accordance with the index value for each of the ejectors calculated by the calculation unit;

a threshold storage unit that stores the threshold determined for each of the ejectors by the threshold determination unit; and an abnormality determination unit that determines presence or absence of an ejection abnormality by comparing a measurement amount of each of the ejectors obtained by inspecting an ejection state of the ejector with the threshold determined for each of the ejectors relating to the measurement amount, wherein the printing data is continuous-tone image data indicating an ink gradation value, and the index value is a value indicating an average ink gradation value in some or all of pixel groups in which each of the ejectors takes charge of recording for each of the ejectors, or a value indicating a total ink gradation value in some or all of pixel groups in which each of the ejectors takes charge of recording for each of the ejectors.

6. The ink jet recording apparatus according to claim 5, wherein the calculation unit calculates a moving average of an ink gradation value of a pixel corresponding to the ejector with respect to a medium transport direction in which the recording medium is transported by the medium transport unit, and obtains a representative value of the moving average as a value indicating the average ink gradation value of the index value.

7. The ink jet recording apparatus according to claim 5, further comprising:

a test pattern recording control unit that performs control for causing the ink jet head to record a test pattern for inspecting the ejection state of the ejector;

an image reading unit that reads the test pattern recorded by the ink jet head; and an image analysis unit that analyzes a read image of the test pattern acquired through the image reading unit to acquire a measurement amount for each of the ejectors.

8. The ink jet recording apparatus according to claim 7, wherein the recording of the test pattern and the acquisition of the measurement amount are performed during execution of a print job for recording the printed image on the basis of the printing data, and the determination by the abnormality determination unit is performed during the execution of the print job.

9. The ink jet recording apparatus according to claim 5, wherein the ink jet head is a line head in which the plurality of ejectors are arrayed in a medium width direction orthogonal to a medium transport direction in which the recording medium is transported by the medium transport unit, and performs image recording in a single pass system.

10. The ink jet recording apparatus according to claim 5, wherein the measurement amount is a landing position shift amount.

11. An ink jet recording apparatus comprising:

an ink jet head having a plurality of ejectors that eject droplets;

a medium transport unit that transports a recording medium;

a calculation unit that calculates an index value relevant to a droplet ejection amount for each of the ejectors which is expected during recording of a printed image with respect to each of the plurality of ejectors, on the basis of printing data for specifying contents of the printed image which is recorded on the recording medium by the ink jet head;

a threshold determination unit that determines a threshold for ejection abnormality determination for each of the ejectors, in accordance with the index value for each of the ejectors calculated by the calculation unit;

a threshold storage unit that stores the threshold determined for each of the ejectors by the threshold determination unit;

an abnormality determination unit that determines presence or absence of an ejection abnormality by comparing a measurement amount of each of the ejectors obtained by inspecting an ejection state of the ejector with the threshold determined for each of the ejectors relating to the measurement amount; and a correspondence relation data storage unit in which correspondence relation data having a correspondence relation between the index value and the threshold for ejection abnormality determination specified therein is stored, wherein the threshold determination unit determines the threshold for each of the ejectors using the correspondence relation data.

12. An ink jet recording apparatus comprising:

an ink jet head having a plurality of ejectors that eject droplets;

a medium transport unit that transports a recording medium;

a calculation unit that calculates an index value relevant to a droplet ejection amount for each of the ejectors which is expected during recording of a printed image with respect to each of the plurality of ejectors, on the basis of printing data for specifying contents of the printed image which is recorded on the recording medium by the ink jet head;

a threshold determination unit that determines a threshold for ejection abnormality determination for each of the ejectors, in accordance with the index value for each of the ejectors calculated by the calculation unit;

a threshold storage unit that stores the threshold determined for each of the ejectors by the threshold determination unit;

an abnormality determination unit that determines presence or absence of an ejection abnormality by comparing a measurement amount of each of the ejectors obtained by inspecting an ejection state of the ejector with the threshold determined for each of the ejectors relating to the measurement amount; and an abnormality notification unit that notifies a user of an abnormality in accordance with a determination result by the abnormality determination unit, wherein a plurality of types of threshold having different degrees of the ejection abnormality are determined as the threshold with respect to each of the plurality of ejectors, a first threshold having a relatively high degree of the ejection abnormality and a second threshold having a relatively low degree of the ejection abnormality are determined as the plurality of types of threshold, and in case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, a notification aspect by the abnormality notification unit is made different.

13. The ink jet recording apparatus according to claim 12, further comprising a stamp processing unit that affixes a mark to an end of the recording medium in accordance with the determination result by the abnormality determination unit, wherein in case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, a stamp process by the stamp processing unit as the abnormality notification unit is made different.

14. The ink jet recording apparatus according to claim 12, further comprising an output location change processing unit that changes an output location of the recording medium in accordance with the determination result by the abnormality determination unit, wherein in case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, the output location by the output location change processing unit as the abnormality notification unit is made different.

15. The ink jet recording apparatus according to claim 12, further comprising an abnormality information providing processing unit that provides information for causing a user to perceive abnormality in accordance with a determination result by the abnormality determination unit, wherein in case of an ejection abnormality is shown in which the measurement amount is higher than the degree of the ejection abnormality specified by the second threshold and is equal to or less than the degree of the ejection abnormality specified by the first threshold, and in case of an ejection abnormality is shown in which the measurement amount is higher than the degree of the ejection abnormality specified by the first threshold, an information providing aspect by the abnormality information providing processing unit as the abnormality notification unit is made different.

16. An abnormality detection method of an ejector in an ink jet recording apparatus that transports a recording medium and records an image on the recording medium using an ink jet head having a plurality of ejectors that ejects droplets, the method comprising:

a calculation step of calculating an index value relevant to a droplet ejection amount for each of the ejectors which is expected during recording of a printed image with respect to each of the plurality of ejectors, on the basis of printing data for specifying contents of the printed image which is recorded on the recording medium by the ink jet head;

a threshold determination step of determining a threshold for ejection abnormality determination for each of the ejectors, in accordance with the index value for each of the ejectors calculated in the calculation step;

a threshold storage step of storing the threshold determined for each of the ejectors in the threshold determination step; and an abnormality determination step of determining presence or absence of an ejection abnormality by comparing a measurement amount of each of the ejectors obtained by inspecting an ejection state of the ejector with the threshold determined for each of the ejectors relating to the measurement amount, wherein the printing data is continuous-tone image data indicating an ink gradation value, and the index value is a value indicating an average ink gradation value in some or all of pixel groups in which each of the ejectors takes charge of recording for each of the ejectors, or a value indicating a total ink gradation value in some or all of pixel groups in which each of the ejectors takes charge of recording for each of the ejectors.

* * * * *